US010767420B2

(12) United States Patent
McDonough et al.

(10) Patent No.: US 10,767,420 B2
(45) Date of Patent: Sep. 8, 2020

(54) ROLLER CONE DRILL BIT WITH EVENLY LOADED CUTTING ELEMENTS

(71) Applicant: SMITH INTERNATIONAL, INC., Houston, TX (US)

(72) Inventors: Scott McDonough, Houston, TX (US); Joshua Gatell, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 307 days.

(21) Appl. No.: 15/846,481

(22) Filed: Dec. 19, 2017

(65) Prior Publication Data

US 2018/0106113 A1 Apr. 19, 2018

Related U.S. Application Data

(63) Continuation-in-part of application No. PCT/US2016/037940, filed on Jun. 16, 2016, and a continuation-in-part of application No. PCT/US2016/052899, filed on Sep. 21, 2016.

(60) Provisional application No. 62/187,915, filed on Jul. 2, 2015, provisional application No. 62/221,614, filed on Sep. 21, 2015.

(51) Int. Cl.
*E21B 10/16* (2006.01)

(52) U.S. Cl.
CPC ..... *E21B 10/16* (2013.01)

(58) Field of Classification Search
CPC ..... E21B 10/16
See application file for complete search history.

(56) References Cited

U.S. PATENT DOCUMENTS

| | | | |
|---|---|---|---|
| 6,516,293 | B1 | 2/2003 | Huang et al. |
| 6,785,641 | B1 | 8/2004 | Huang |
| 7,011,170 | B2 | 3/2006 | Ledgerwood, III et al. |
| 7,234,549 | B2 | 6/2007 | McDonough et al. |
| 7,292,967 | B2 | 11/2007 | McDonough et al. |
| 7,370,711 | B2 | 5/2008 | Singh |
| 7,686,104 | B2 | 3/2010 | Singh et al. |
| 2004/0104053 | A1 | 6/2004 | Chen |
| 2004/0243367 | A1 | 12/2004 | McDonough et al. |

(Continued)

FOREIGN PATENT DOCUMENTS

WO WO2011017642 A2 2/2011

OTHER PUBLICATIONS

International Search Report and Written Opinion issued in International Patent Application No. PCT/US2016/037940, dated Oct. 24, 2016, 26 pages.

(Continued)

*Primary Examiner* — Giovanna Wright

(57) ABSTRACT

A drill bit is used for drilling through earthen formations and forming a wellbore. The drill bit includes a bit body having a bit axis, and at least a first cone and a second cone coupled to the bit body. Each of the first and the second cones has a backface, a nose opposite the backface, and a cone axis of rotation. An array of cutting elements coupled to the first or second cones is in a band that lies between the backface and the nose. The cutting elements in the band are arranged at radial positions with respect to the bit axis and at least two adjacent cutting elements are at a same radial position within the array, and the remaining cutting elements are at different radial positions within the array.

20 Claims, 33 Drawing Sheets

(56) References Cited

U.S. PATENT DOCUMENTS

| | | | | |
|---|---|---|---|---|
| 2005/0194191 | A1 | 9/2005 | Chen et al. | |
| 2007/0034411 | A1* | 2/2007 | Singh | E21B 10/16 175/77 |
| 2007/0034414 | A1* | 2/2007 | Singh | E21B 10/16 175/374 |
| 2007/0278015 | A1 | 12/2007 | Boudrare et al. | |
| 2009/0055135 | A1 | 2/2009 | Tang et al. | |
| 2009/0271161 | A1 | 10/2009 | Ricks | |
| 2011/0315452 | A1 | 12/2011 | Buske et al. | |

OTHER PUBLICATIONS

International Search Report and Written Opinion issued in International Patent Application No. PCT/US2016/052899, dated Dec. 28, 2016, 15 pages.

International Preliminary Report on Patentability issued in International Patent Application No. PCT/US2016/037940 dated Jan. 2, 2018, 20 pages.

International Preliminary Report on Patentability issued in International Patent Application No. PCT/US2016/052899 dated Mar. 27, 2018, 11 pages.

* cited by examiner

ROLLER CONE DRILL BIT WITH EVENLY LOADED CUTTING ELEMENTS

CROSS-REFERENCE TO RELATED APPLICATIONS

This application is a continuation-in-part of International Patent Application No. PCT/US2016/037940, filed Jun. 16, 2016, which claims the benefit of U.S. Patent Application No. 62/187,915, filed Jul. 2, 2015. This application is also a continuation-in-part of International Patent Application No. PCT/US2016/052899 filed Sep. 21, 2016, which claims priority to U.S. Patent Application No. 62/221,614, filed on Sep. 21, 2015. Each of the foregoing is hereby incorporated herein by this reference, in its entirety.

BACKGROUND

An earth-boring drill bit can be mounted on the lower end of a drill string and rotated by rotating the drill string at the surface, actuation of downhole motors or turbines, or both. With weight applied to the drill string, the rotating drill bit engages the earthen formation and proceeds to form a wellbore along a predetermined path toward a target zone. The wellbore thus created will have a diameter generally equal to the diameter or "gage" of the drill bit.

An earth-boring bit in common use today includes one or more rotatable cutters that perform a cutting function due to the rolling movement of cutting elements of the cutters acting against the formation material. The cutters roll and slide upon the bottom of the wellbore as the bit is rotated, the cutting elements thereby engaging and disintegrating the formation material in its path. The rotatable cutters may be generally conical in shape and are therefore sometimes referred to as roller cones or roller cone cutters. The wellbore is formed as the action of the cones remove chips of formation material that are carried upward and out of the wellbore by drilling fluid that is pumped downwardly through the drill pipe and out of the bit.

The earth disintegrating action of the roller cones is enhanced by providing a plurality of cutting elements on the cutters. Cutting elements may include teeth integrally formed with the cone, or inserts attached to the cone. In each instance, the cutting elements on the rotating cutters break up the formation to form the new wellbore by a combination of gouging and scraping or chipping and crushing.

SUMMARY

Some embodiments of the present disclosure are directed to a roller cone bit having a cutting element arrangement that evens the load distribution during a drilling operation. The shape of the cone is such that a contact profile with a bottom of the wellbore is not horizontal, but rather has a maximum depth with respect to the bit axis, curving up toward each of the nose and the gage of the bit. Some embodiments of a roller cone bit bias an array of cutting elements so that a load on cutting elements farther down the bit axis/wellbore is more even with the load on other cutting elements within the array. This may be accomplished by increasing the load on a cutting element experiencing a load less than the average load experienced by a cutting element in the array, decreasing the load on a cutting element experiencing a load greater than the average load for the array, or both. In some embodiments, after achieving a more equal load across the array, the average load experienced by a cutting element in the array is substantially unchanged. Representatively, in some embodiment, this is accomplished by biasing the cutter tip positions within the array so that the number of cutting elements, spacing, or both, is greater on the outer portion of the array. The greater number of cutting elements can more evenly distribute the load on each individual cutting insert within the array. In still further embodiments, more evenly distributing the load on the cutting elements in the array includes biasing the cutting elements so that their tips are more level with a line perpendicular to the bit axis deviating from a spline along the cutting element tips or the bottom of the hole, when viewed in the bottomhole profile. In other words, the cutting element tips located farthest down a wellbore during a drilling operation are more level with cutting element tips farther up the bit axis than they would be if they had followed the curvature of the bottom hole profile spline.

The above summary is not an exhaustive list of aspects of the present disclosure. It is contemplated that the disclosure includes any embodiments that can be practiced from suitable combinations of any the various aspects summarized above, as well as those disclosed in the in the description herein.

BRIEF DESCRIPTION OF THE DRAWINGS

The embodiments disclosed herein are illustrated by way of example and not by way of limitation in the figures. Except for schematic illustrations, the figures should be considered to scale for some embodiments, and thus illustrate example dimensions and relationships between elements; however, such embodiments are illustrative and are not to scale for other embodiments within the present disclosure.

DETAILED DESCRIPTION

Some aspects of the present disclosure relate generally to earth-boring bits used to drill a wellbore. More particularly, some embodiments of the disclosure relate to roller cone bits and to an improved cutting structure for such bits. Still more particularly, some aspects of the present disclosure relate to an insert or cutting element array with a more even load distribution so as to increase bit durability.

Figure 1:
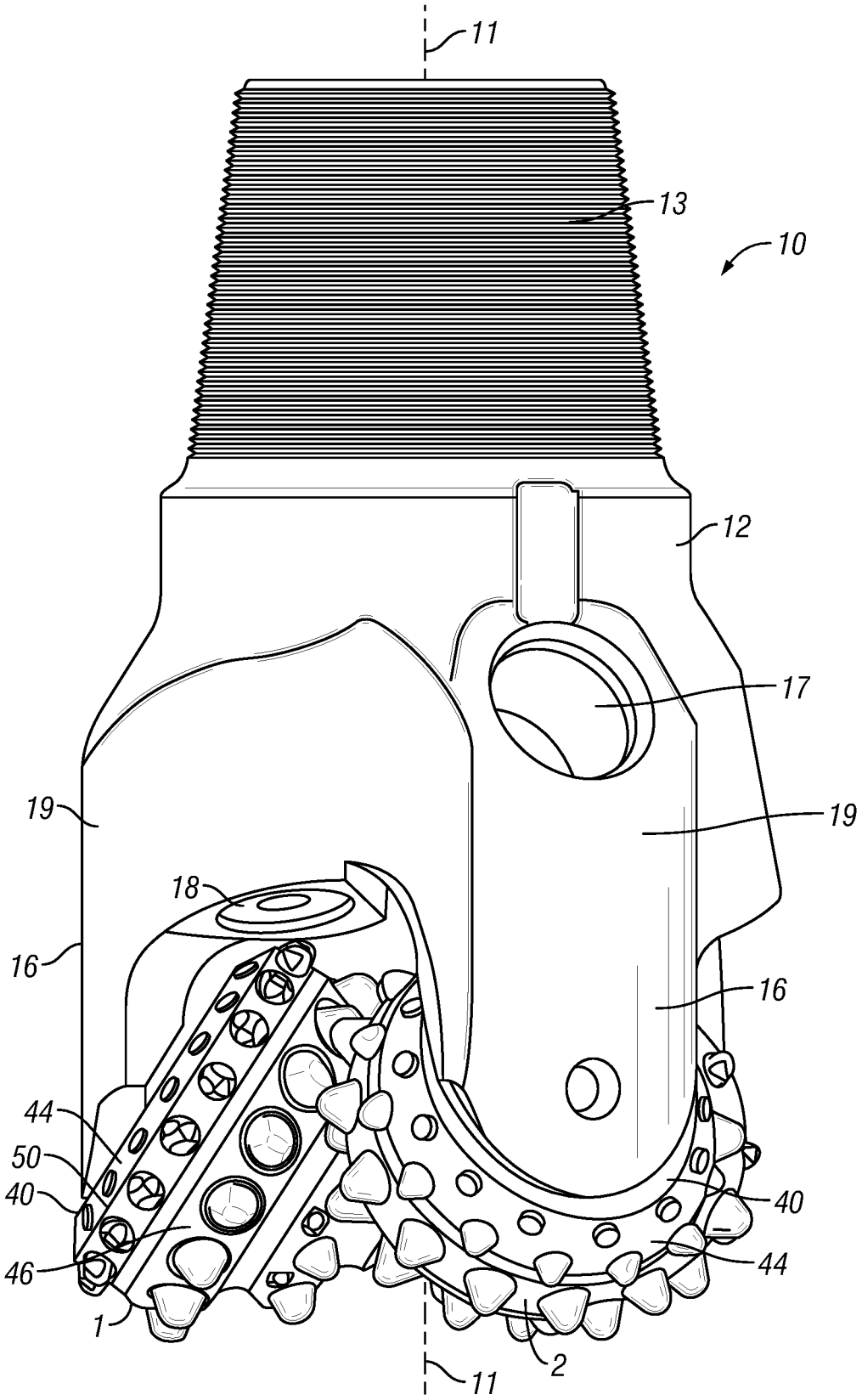
FIG. 1 is a perspective view of an earth-boring bit in accordance with the principles of some embodiments of the present disclosure.

Referring to FIG. 1, an earth-boring bit 10 with a central axis 11 includes a bit body 12 having a threaded section 13 at its upper end that is adapted for securing the bit to a drill string (not shown). Bit 10 has a predetermined gage diameter as defined by the outermost reaches of three roller cones 1, 2, 3 (cones 1 and 2 shown in FIG. 1) that are rotatably mounted on bearing shafts coupled to the bit body 12. Bit body 12 includes three sections or legs 19 (two shown in FIG. 1) that are welded together or otherwise coupled to form bit body 12. Bit 10 further includes a plurality of nozzles 18 that direct drilling fluid toward a bottom of the wellbore and around cones 1, 2, 3. Bit 10 includes lubricant reservoirs 17 that supply lubricant to the bearings that support each of the cones 1, 2, 3. Bit legs 19 include a shirttail portion 16 that serves to protect the cone bearings and cone seals from damage caused by cuttings and debris entering between leg 19 and its respective cone 1, 2, 3.

Figure 2:
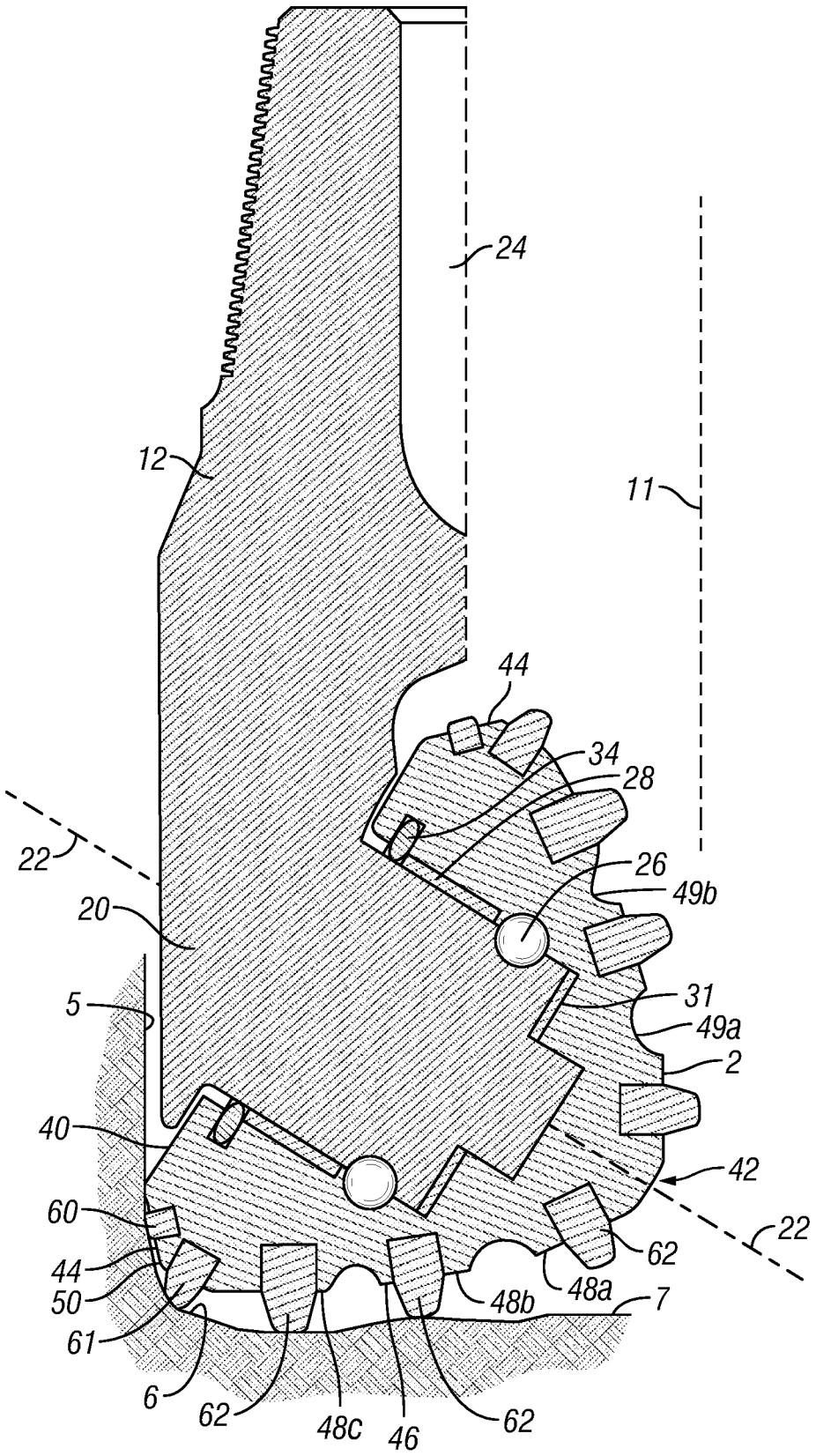
FIG. 2 is a partial section view taken through one leg and one roller cone of the bit of FIG. 1.

Referring now to FIGS. 1 and 2, each cone 1, 2, 3 may be mounted on a pin or journal 20 extending from bit body 12, and may be adapted to rotate about a cone axis of rotation 22 oriented generally downwardly and inwardly toward the center of the bit 10. Each cone 1, 2, 3 or other cutter is secured on pin 20 by locking balls 26. In the embodiment shown, radial and axial thrust are absorbed by journal sleeve 28 and thrust washer 31. The bearing structure shown is generally referred to as a journal bearing or friction bearing; however, embodiments of the present disclosure are not limited to use in bits having such structure, but may equally be applied in a roller bearing bit where cones 1, 2, 3 would be mounted on pin 20 with roller bearings between the cone and the journal pin 20, or even on cones oriented generally downwardly and outwardly away from the center of the bit. In both roller bearing and friction bearing bits, lubricant may be supplied from reservoir 17. The lubricant may be sealed in the bearing structure, and drilling fluid excluded therefrom, by an annular seal 34, which may take many forms. Drilling fluid pumped from the surface may pass through fluid passage 24 where it is circulated through an internal passageway (not shown) to nozzles 18 (FIG. 1). The wellbore created by bit 10 includes sidewall 5, corner portion 6, and bottom 7.

Referring still to FIGS. 1 and 2, each cone 1, 2, 3 may include a generally planar backface 40 and nose portion 42. Cones 1, 2, 3 may further include a generally frustoconical surface 44 adjacent to backface 40 and adapted to retain or include cutting elements that scrape or ream the sidewalls of the wellbore as the cones rotate about the wellbore bottom. Frustoconical surface 44 will be referred to herein as the "heel" surface, it being understood that the same surface may be sometimes referred to by others in the art as the "gage" surface.

Extending between heel surface 44 and nose 42 is a generally conical surface 46 adapted to support cutting elements that gouge or crush the wellbore bottom 7 as the cones 1, 2, 3 rotate. Heel surface 44 and conical surface 46 may converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between heel surface 44 and the conical surface 46. Conical surface 46 may be divided into a plurality of regions or bands 48, generally referred to as "lands," which support and secure the cutting elements as described in more detail herein. Cone 2 includes three such lands 48*a*, 48*b*, 48*c*. In some embodiments, cones 1, 2, 3 may include grooves 49, formed in cone surface 46 between adjacent lands 48*a*, 48*b*, 48*c*. Optionally, one or more of the lands 48*a*, 48*b*, 48*c* may be generally frustoconical.

In FIGS. 1 and 2, each cone 1, 2, 3 includes a plurality of wear resistant teeth, inserts, or other cutting elements 60, 61, 62, 63. It should be understood that while the description may describe "inserts," integral teeth, or other cutting elements may also be employed. Thus, "inserts" and other cutting element may be used interchangeably in embodiments of the present disclosure. The illustrated inserts each include a generally cylindrical base portion with a central axis, and a cutting portion that extends from the base portion and includes a cutting surface for cutting formation material. The cutting surface may be planar or non-planar. The cutting surface may be symmetric or asymmetric relative to the insert axis. A full or partial portion of the base portion of an insert is secured (e.g., by interference fit or brazing) into a mating socket drilled or otherwise formed in the surface of the cone. The "cutting surface" of an insert is defined herein as being that surface of the insert that extends beyond the surface of the cone and engages the formation or workpiece being drilled. The extension height of the cutting element is the distance from the cone surface to the outermost point (i.e., the cutter tip) of the cutting surface (relative to the cone axis) as measured parallel to the insert's axis.

Figure 3A:
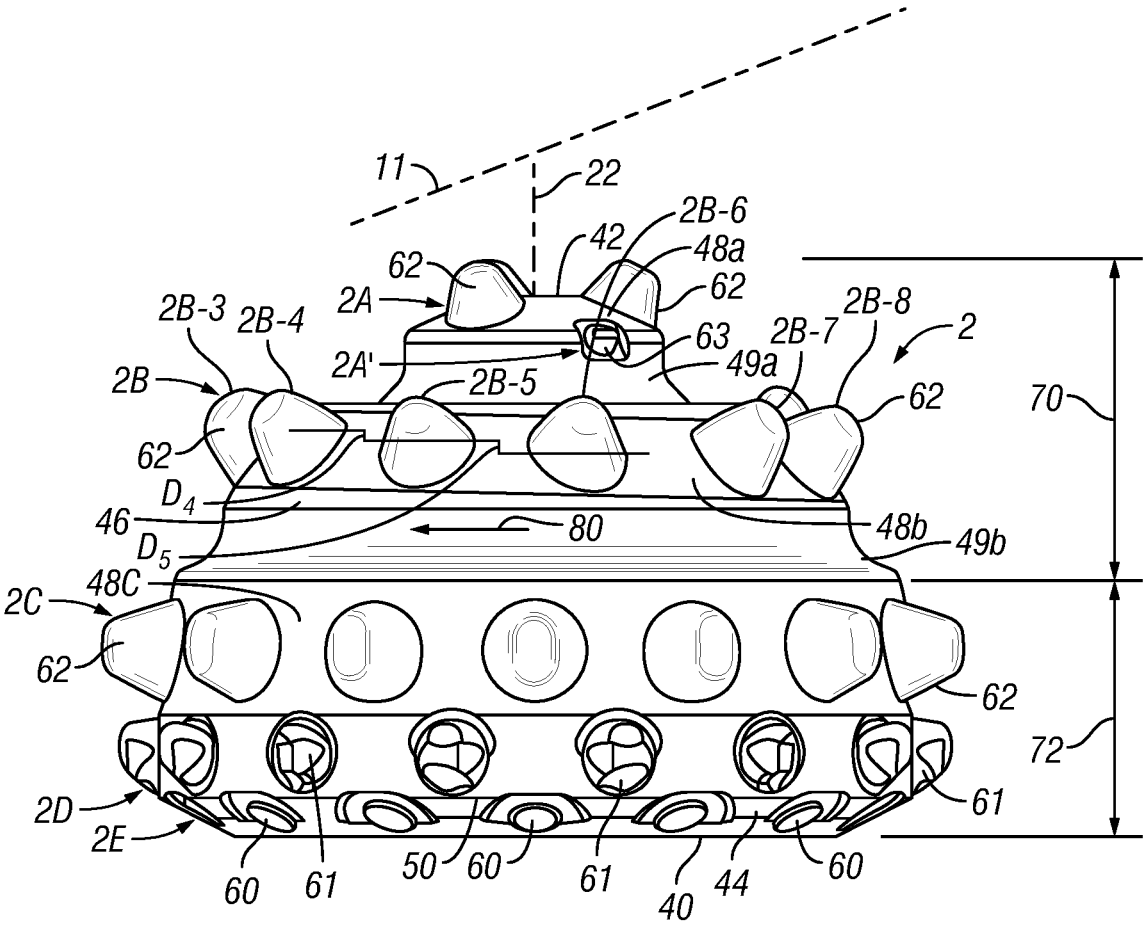
FIGS. 3A and 3B are front and rear elevation views, respectively, of one of the cones of the bit of FIGS. 1 and 2.
Figure 3B:
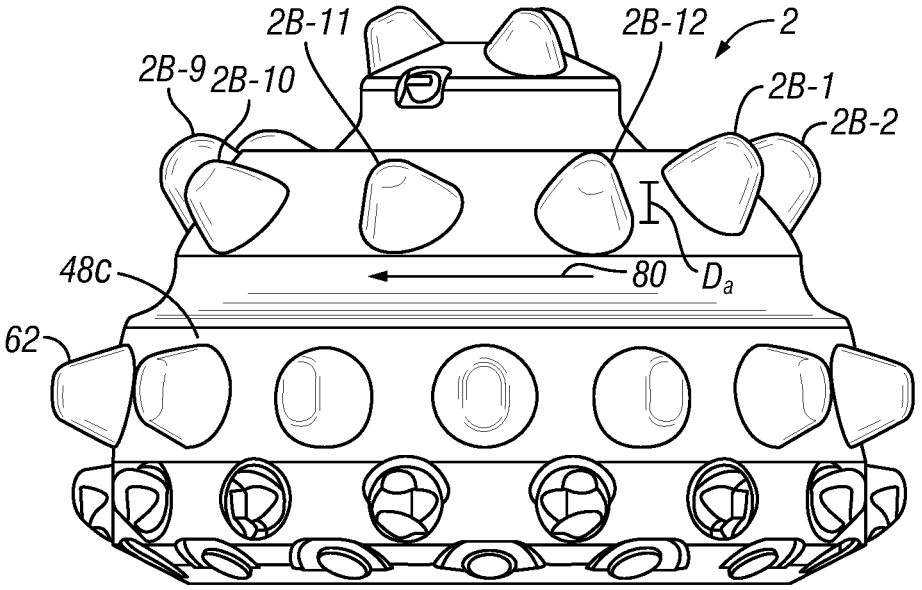

Referring now to FIGS. 3A and 3B, cone 2 is shown in more detail and includes a substantially planar backface 40 and a nose 42 opposite backface 40. Cone 2 further includes a generally frustoconical heel surface 44 adjacent to backface 40 and a generally conical surface 46 extending between heel surface 44 and nose 42. Cone 2 further includes a circumferential row of heel cutting elements 60 extending from heel surface 44. In some embodiments, heel row cutting elements 60 are generally planar elements designed to ream the wellbore sidewall, although rounded, ridged, conical, frustoconical, or other alternative shapes and geometries may be employed.

Adjacent to shoulder 50 and radially inward of the heel row cutters, cone 2 includes a circumferential row of gage cutting elements 61. In some embodiments, elements 61 include a cutting surface having a generally slanted crest and are intended for cutting the corner of the wellbore 6 (FIG. 2), although any of a variety or geometry of cutting elements may be employed in this location. Cone cutting inserts 61 are referred to herein as gage or gage row cutting elements; however, others in the art may describe such cutting elements as heel cutters or heel row cutters.

Between the circumferential row of gage cutting elements 61 and nose 42, cone 2 includes one or more rows, arrays, or other arrangements of bottomhole cutting elements 62. Cutting elements 62 are intended primarily for cutting the bottom of the wellbore and, for example, may include cutting surfaces having a generally rounded chisel shape as shown in FIGS. 3A and 3B, although other shapes and geometries may be employed. Cone 2 may further include one or more ridge cutting elements 63 (one each shown in the views of FIGS. 3A and 3B). Ridge cutting elements 63 are intended to cut portions of the wellbore bottom 7 that are otherwise left uncut by cutting paths of the other bottomhole cutting elements 62.

In FIG. 3A, the cutting elements on cutter 2 may generally be described as being in six different groupings or arrangements. For example, cone 2 includes a nose row 2A, which includes three substantially identical bottomhole cutting elements 62 that are mounted in the cone at nominally the same radial position as measured from the bit axis, and which may cut in a single swath or track in the formation. A radial position includes a distance of a cutter tip from the bit axis, measured along a line perpendicular to the bit axis and intersecting the cutter tip, and a bottomhole depth, measured as the depth where the line perpendicular to the bit axis and intersecting the cutting element tip intersects the bit axis. Radial positions are discussed in more detail with respect to FIGS. 4A-4C. Cone 2 may further include an array 2B of bottomhole cutting elements 62. Array 2B may be considered an array even where cutting elements 62 are not in a circumferential row as are the elements of row 2A, but the row's elements may be, subject to manufacturing tolerances, mounted in about the same radial position relative to the bit axis and therefore may be referred to herein as being redundant cutting elements or as being located in redundant positions. The cutting elements of array 2B may be in at least four, and in some cases at least five, non-uniform radial positions (relative to the bit axis 11) such that the cutting elements in array 2B do not cut in identical paths but instead cut in offset or staggered paths. Cutter arrangements within an array may include, for example, a single spiral arrangement (as illustrated in FIGS. 3A and 3B), multiple spiral arrangements (discussed below with respect to FIGS. 19A and 19B), or a sinusoidal arrangement. As such, in some embodiments, the number of radial positions within an array is may not be related to the number of cutting elements within the array. Having a single spiral arrangement, the cutting elements of array 2B are described as being non-circumferentially arranged, and are therefore arranged differently than in a conventional arrangement where they are placed in circumferential rows.

In some embodiments, each cutting elements of array 2B is of substantially similar size and shape, and at any of a number of radial positions to form an array 2B that is spaced apart from row 2A. In other embodiments, array 2B may include cutting elements having two or more different shapes or geometries. Between row 2A and array 2B may be a row 2A' including one or more ridge cutting elements 63. Continuing to move toward the backface 40, cone 2 may further include a row 2C of bottomhole cutting elements 62 in a circumferential row as are the elements of row 2A, or a non-circumferential row as are the elements of array 2B. Adjacent to row 2C may be gage row cutting elements 61 which, in some embodiments, are arranged in a circumferential row 2D. The heel surface 44 retains a circumferential row 2E of heel row cutter 60.

An annular groove 49*a* may separate row 2A from array 2B. Likewise, a groove 49*b* may be between array 2B and row 2C. Grooves 49*a*, 49*b* permit the cutting elements from adjacent cones 1, 3 to intermesh with the cutting elements of cone 2, and further permit cleaning of the cones by allowing fluid flow between the adjacent rows of cutting elements.

To meet performance expectations of roller cone bits, the cones may be formed as large as possible within the wellbore diameter so as to allow use of the maximum possible bearing size and to provide a retention depth adequate to secure the cutting element base within the cone steel or other material. To achieve maximum cone diameter and still have acceptable insert retention and protrusion, some of the rows of cutting elements may be arranged to pass between the rows of cutting elements on adjacent cones as the bit rotates. In some cases, certain rows of cutting elements extend so far that clearance areas or grooves corresponding to cutting paths taken by cutting elements in these rows are provided on adjacent cones so as to allow the bottomhole cutting elements on adjacent cutters to intermesh farther. The term "intermesh" as used herein is defined to mean overlap of any part of at least one cutting element on one cone with the spline or envelope defined by the maximum extension of the cutting elements on an adjacent cone. Thus, grooves 49*a* and 49*b* allow the cutting surfaces of certain cutting elements of cones 1 and 3 to pass between the cutting elements of row 2A and array 2B, and between array 2B and row 2C, without contacting cone surface 46 of cone 2. In this way, cone 2 may thus be described as being divided into an intermeshed region 70 and a non-intermeshed region 72. In particular, row 2A and array 2B of cone 2 lie in the intermeshed region 70, while the cutting elements of arrangements 2C, 2D, 2E are in the non-intermeshed region.

Referring in more detail to array 2B, cutting elements of array 2B may be arranged around cone 2 at a number of radial positions with respect to bit axis 11, and within a radial distance Da, or radius, of array 2B. The radial distance Da is also referred to herein as the radius of array 2B. The radial positions and radial distance of the cutting elements of array 2B will be described in more detail herein, and in reference to FIG. 4A. For purposes of further explanation, each of the cutting elements 62 of array 2B is assigned a reference numeral 2B-1 through 2B-12, there being twelve cutting elements 62 in array 2B in this embodiment. Cutting elements 2B-1 through 2B-12 are on a generally frustoconical-shaped region or band 48*b* that encircles the cone 2 and which is located in the intermeshed region 70 between the circumferential row 2A and the circumferential row 2C of cutting elements.

In this particular embodiment, the cutting elements 2B-1 through 2B-12 are arranged such that the impact force on, load on, or work done by each of the cutting elements within array 2B during a drilling operation is more evenly distributed among the individual cutting elements. This is in comparison to a conventional spiral arrangement or array, in which, for example, the cutting elements at the farthest outward or outboard positions within the array may experience considerably higher loads than cutting elements at more inward or inboard positions within the array. Representatively, in this embodiment, a count (or number) of cutting elements at radial positions within the array that experience the highest loads is increased. As previously discussed, the highest loads may be found on cutting elements farthest down the wellbore (i.e., on cutting elements closest to a horizontal line tangent to a bottomhole profile or perpendicular to the bit axis). Said another way, a count of cutting elements at one or more of the radial positions experiencing the highest load (e.g. farthest outward radial positions or farthest down the wellbore) is increased in comparison to the count at lower load positions (e.g. more radially inward positions or those farther up the wellbore). In other words, the cutting element density is increased or greater at one end of the array and decreased or lesser at another.

Accordingly, a bit may be designed by adjusting the insert count at each radial position within an array to achieve an array with more equal load distribution across each of the inserts in the array. Methods for designing a bit having arrays with more equal insert load distributions include increasing the load on one or more inserts experiencing less than the average load experienced by an insert in the array (e.g., by decreasing the count of inserts at that radial position), decreasing the load on one or more inserts experiencing a load greater than the average load for the array (e.g., by increasing the count of inserts at that radial position), or both. In some embodiments, after achieving a more equal or distributed load across the inserts in an array, the average load experienced by an insert in the array is substantially unchanged.

It is noted that the term "outboard" is intended to refer to a position radially outward or farther from a bit axis than another position, and the term "inboard" is intended to refer to a position radially inward or closer to a bit axis than another position. In addition, it should be understood that the radius Da of array 2B is intended to refer to a radial distance or width of array 2B in a radial direction, as defined by the radial distance between the farthest outboard position within the array (e.g. cutting element 2B-12) and the furthest inboard position in the given array (e.g. cutting element 2B-1). Each of the cutting elements 2B-1 through 2B-12 within the array 2B, is then considered to be at a corresponding radial position within the radius Da of array 2B. In some embodiments, some of the cutting elements 2B-1 through 2B-12 may be at the same radial position while others are at different radial positions within the radius Da of array 2B.

In the embodiment shown in FIG. 3A and FIG. 3B, cutting elements 2B-10 through 2B-12 are the farthest outboard within the array and may be subject to higher loads than, for example, more inboard cutting elements such as elements 2B-1 through 2B-9. As such, cutting elements 2B-10 through 2B-12 may, in some embodiments, be arranged at the same radial position within the radius Da of array 2B. The remaining cutting elements 2B-1 through 2B-9 may each be at a different radial position within the radius Da of array 2B, or two or fewer of the cutting elements 2B-1 through 2B-9 may be at a same radial position within the radius Da. In other words, the count of cutting elements at an outboard radial position within array 2B (the position corresponding to 2B-10 through 2B-12) may be increased, or greater than, a count of cutting elements at the remaining radial inward or inboard positions within the array 2B. A cutting element density within array 2B may therefore increase radially away from the bit axis. For example, array 2B may have a total of 10 different radial positions within the radius Da of array 2B, with three cutting elements at the most radially outward radial position (e.g. elements 2B-10 through 2B-12) and one cutting element at each of the remaining radial positions (e.g. elements 2B-1 through 2B-9). It should be understood, however, that although in the illustrated embodiment, the array 2B is described as having three cutting elements at the same radial position within the array 2B, more or fewer cutting elements may be arranged at the same radial position. For example, any number of cutting elements less than the total number of cutting elements in the array may be at the same radial position. For example, anywhere from two to eight cutting elements may be at the same radial position within the illustrated array 2B.

In addition, although cutting elements at the most radially outward positions within an array, or most outboard position with respect to the bit axis, may be the cutting elements experiencing the highest load or impact force, in other cases, a cutting element experiencing the highest load force may be at other positions with respect to the bit axis and within the array. For instance, cutting elements closest to the bottom of the hole or those exposed to more of the wellbore wall during a cutting operation may see the higher load in comparison to those farther from the wellbore bottom. Thus, in some cases where the cutting elements are located to the left of, or outboard of the lowest point of the wellbore bottom, the cutting element closest to the bottom of the wellbore, and therefore experiencing the highest load within the array, may be closest to the bit axis, or more radially inward or inboard, than at least some other cutting elements in an array. In such an embodiment, the cutting element count at the more radially inboard position within the array may be higher than for the more outboard positions.

In some embodiments, for an array adjacent to the gage, relatively high-load positions may be at radial positions adjacent to the gage. This may occur when an insert experiences load from the corner region of the wellbore (i.e., from some combination of the bottomhole, the sidewall, and the corner at the interface of the bottomhole and the sidewall). In this case, the insert count may be increased in the radial positions closest to the gage. In other embodiments, an array located adjacent the gage may experience relatively higher loads in the radial positions closest to the maximum depth (relative to the bit axis) on the bottom hole, or the inboard-most positions on the array. In such case, the insert count may be increased in the innermost radial positions to make the loads on each individual insert more equal. In yet other embodiments, a row adjacent the gage may experience higher loads in radial positions both closest to the gage and closest to the bottom hole as compared to radial positions between the outboard and inboard radial positions. In such case, both the outboard and inboard radial positions of the array may have a higher count of inserts as compared to the count at positions between the outboard and inboard positions in order to have more equal load across inserts of an array, as compared to the loads experienced by each insert when an equal count of inserts is located at each radial position.

In addition, it can be seen from FIG. 3A and FIG. 3B that a spacing or distance between each of the different radial positions within array 2B in a radial direction may equal. A spacing or radial distance between adjacent cutting elements within array 2B may therefore be the same in some embodiments. Representatively, a spacing or distance D4 between a radial position of cutting element 2B-4 and a radial position of cutting element 2B-5 (as measured from where the cutting element axis intersects the cutter tip) may be equal to, or otherwise the same as, a spacing or distance D5 between a radial position of cutting element 2B-5 and a radial position of cutting element 2B-6. Although spacing between cutting elements 2B-4, 2B-5, and 2B-6 are shown, it should be understood that each of the remaining adjacent cutting elements (i.e., cutting elements 2B-1 through 2B-4 and 2B-6 to 2B-12) may have the same spacing or radial distance with respect to one another, such that each of the radial positions within the array 2B may be considered evenly spaced in the radial direction. In other embodiments, however, the spacing may vary between adjacent inserts or cutting elements in the array 2B.

Figure 4A:
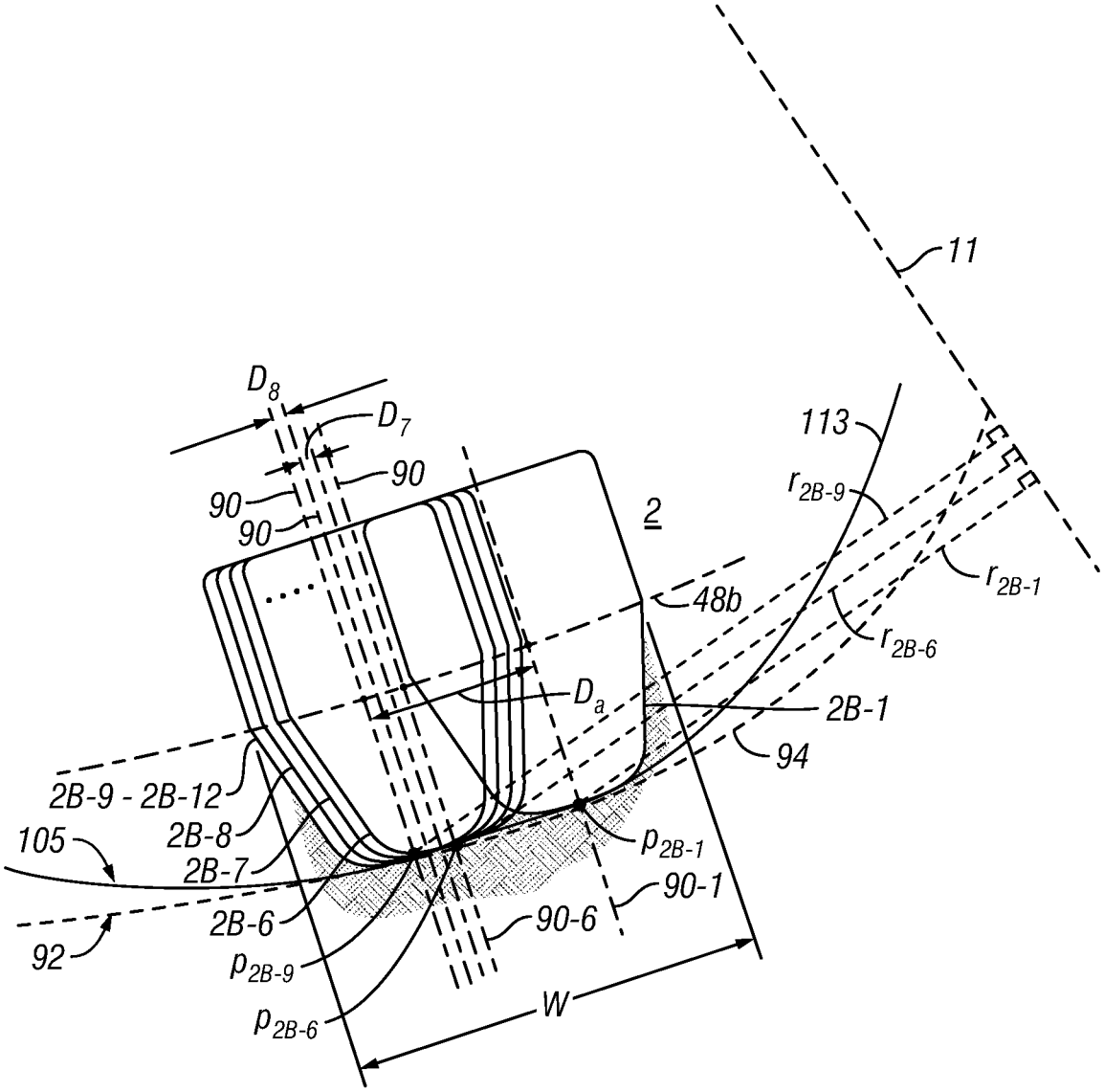
FIG. 4A is a magnified, partial view showing, in rotated profile, the cutting path of certain of the cutting elements in the cone of FIGS. 3A and 3B.

As cone 2 rotates in the direction represented by arrow 80, each of the cutting elements on the cone may periodically hit the wellbore bottom, with each hit intended to dislodge a volume of the formation material in order to advance a wellbore. Using array 2B as an example, when the cutting surfaces of cutting elements 2B-1 through 2B-12 are viewed as they would appear if rotated into a single plane, hereafter referred to as viewed "in rotated profile," "in rotated bottomhole profile," or "in aggregated profile,", the cutter surfaces of the cutting elements are positioned as shown in FIG. 4A. In this enlarged view, it can be seen that the cutting elements 2B-9 to 2B-12 (which appear as one profile because they overlap) each include a cutting surface that cuts closer to the bottom 92 of the wellbore 94 than cutting element 2B-1, which is the radially-innermost cutting element of the array, and which has a cutting surface that cuts closest to the bit axis 11 and farthest from the wellbore bottom 92. Because cutting elements 2B-9 to 2B-12 are closest to the bottom 92, they may experience higher loads than elements 2B-1 through 2B-8 within array 2B. It can further be seen that cutting elements 2B-6 to 2B-8 may also include cutting surfaces that cut progressively closer to the bit axis 11 than cutting elements 2B-9 to 2B-12. The profiles of elements 2B-2 through 2B-5 have been omitted for clarity. It will nevertheless be understood that cutting elements 2B-2 through 2B-5 may cut at positions radially between cutting elements 2B-1 and 2B-6. The portion of array 2B of cutting elements, where a series of adjacent elements are positioned progressively farther (or closer) to the bit axis, may also be referred to herein as a spiral arrangement or spiral array. It is further noted that, in this embodiment, array 2B is located to the right of (as viewed in FIG. 4A), or inboard to, the lowest point 105 on a spline 113, which is formed through the cutting element tips farthest from the cone surface. It should be understood that where the array is inboard to the lowest point 105 on the spline 103, the farther outboard cutting elements within the given array may experience higher loads than the farther inboard cutting elements (which may be higher up the wellbore). In other cases, where the array of cutting elements is to the left of (as viewed in FIG. 4A), or outboard to, the lowest point on the spline, the farther inboard cutting elements within a given array may experience higher loads than the farther outboard cutting elements (which may be higher up the wellbore).

In this specific arrangement, the radial positions of the cutting elements 2B-9 through 2B-12 with respect to the bit axis are the same, as previously discussed, and the profiles therefore overlap and appear as a single profile. A radial distance Da between cutting elements 2B-9 through 2B-12 may therefore be zero. The remaining cutting elements 2B-1 through 2B-8, however, may be staggered (e.g., equally, in a stepped arrangement, or in other manners) in an inward direction from cutting element 2B-9. Where equally staggered, the cutting element tip axis 90 of each of the cutting elements 2B-1 through 2B-8 may be spaced a uniform radial distance from the element axis of the immediately adjacent cutting elements as discussed herein. For example, a radial distance D7 between cutting elements 2B-7 and 2B-8 and a radial distance D8 between cutting elements 2B-8 and 2B-9 may be about equal.

In some embodiments, where elements 2B-1 through 2B-12 have a diameter of 0.5625 in. (14.3 mm), D7 and D8 are both approximately 0.015 in. (0.38 mm). Other radial positions and offsets may be employed. For example, for bits having diameters of between 7⅞ in. (20 cm) and 8¾ in. (22 cm), D7 and D8 may both be between 0.01 in. (0.25 mm) and 0.1 in. (2.5 mm). In other embodiments, for the same or different sized bits, the radial distance (e.g., D7 and D8) may be within a range having lower or upper limits including any of 0.005 in. (0.13 mm), 0.01 in. (0.25 mm), 0.025 in. (0.635 mm), 0.05 in. (1.27 mm), 0.075 in. (1.91 mm), 0.1 in. (2.5 mm), 0.125 in. (3.2 mm), 0.15 in. (3.8 mm), 0.2 in. (5.1 mm), 0.3 in. (7.6 mm), 0.5 in. (12.7 mm), or values therebetween. In other embodiments, the radial distance may be less than 0.005 in. (0.13 mm) or greater than 0.5 in. (12.7 mm).

In the illustrated embodiment, each of the twelve cutting elements 2B-1 through 2B-12 may be angularly spaced about the cone axis 22 at centered, angular intervals between 20° and 45° (e.g., 25.70° or 30°); however, as desired or helpful for clearance with other inserts, the angular positioning of the cutting elements 2B-1 through 2B-12 may be uniform or non-uniform. In the rotated profile shown in FIG. 4A, the inserts may be positioned in the cone 2 at a uniform angle (e.g., between 0.1° and 5°, such as at 0.5°) relative to the bit axis 11 and generally perpendicular to the cone surface; however, in other embodiments, that angle may be more or less, and the angle need not be uniform for each cutting element of an array. The composite cutting profile represented by the overlapping cutting profiles of cutting elements 2B-1 through 2B-12 has a width W, as measured generally normal to the surface of frustoconical region 48*a* in this rotated profile.

As cone 2 rotates in the wellbore, cutting elements 2B-1 through 2B-12 will cut substantially the entire width W of the adjacent formation. In particular, the array may cut a substantially smooth swath, leaving little or no uncut wellbore bottom between the cutting element axes of the radially-innermost and outermost cutting elements. In other words, the cutting elements are positioned closely enough such that, in rotated profile, uncut ridges of formation may not be formed between the adjacent cutting positions within the composite profile. The overlapping and relatively close positioning, in rotated profile, of the cutting elements in array 2B shown in FIG. 4A may restrict, or even prevent, ridges from forming. For this reason, the array 2B and its rotated profile W may be fairly described as being free of cutting voids or ridge-producing voids.

The increased cutter count at radial positions within the array 2B that are susceptible to higher loads (e.g., closer to the lowest point 105 on spline 113), results in improved load distribution per cutter in at least some embodiments. Further, because no individual insert is experiencing a comparatively high load as it engages the formation, the likelihood that the cutting tip of an element will be damaged or otherwise fail is reduced, which in turn increases the overall bit life and rate of penetration (ROP).

In addition, as noted herein, cutting elements 62 of array 2B may be in a plurality of differing radial positions with respect to bit axis 11. It should be understood that, in some embodiments, the radial position of a particular cutting element on a cone is measured from the bit axis 11 (perpendicular thereto) to the tip of the cutting element when the particular cutting element is farthest from the bit axis 11, or at its bottom-most or bottom-hole engaging position, when viewed in rotated profile. For instance, as illustrated in FIG. 4A, cutting element 2B-1 has a central axis 90-1 that intersects the cutting surface tip of cone 2 at radial position p2B-1 when viewed in rotated profile. The radial position p2B-1 of cutting element 2B-1 can be defined by radial distance r2B-1 measured perpendicularly from bit axis 11 to the intersection point between axis 90-1 and the tip of cutting element 2B-1. Likewise, cutting element 2B-6 has a central axis 90-6 that intersects the cutting surface tip of cone 2 at radial position p2B-6 when viewed in rotated profile. The radial position of cutting element 2B-6 can be defined by radial distance r2B-6 measured perpendicularly from bit axis 11 to the intersection point between axis 90-6 and the tip of cutting element 2B-6. Thus, as illustrated in FIG. 4A, cutting element 2B-1 and cutting element 2B-6 have different radial positions with respect to bit axis 11 as defined by differing radial distances r2B-1 and r2B-6, respectively, with cutting element 2B-6 being farther outboard than cutting element 2B-1.

In addition, as noted above, cutting elements 62 of array 2B may be in any of a number of different radial positions within a radius Da of array 2B. In FIG. 4A, the radius Da of array 2B is the distance between radial position p2B-1 (the farthest inboard location within array 2B) and radial position p2B-9 (the farthest outboard location within array 2B). The radial position p2B-9 of cutting element 2B-9 can be defined by radial distance r2B-9 measured from bit axis 11, as discussed herein. Thus, in this case, there are nine different radial positions p2B-1 to p2B-9 within the radius Da of array 2B, with one cutting element at each of radial positions p2B-1 to p2B-8 and three cutting elements at radial position p2B-9. It should be understood that although not each of the nine different radial positions p2B-1 to p2B-9 is illustrated in FIG. 4A, those that are not shown may be at evenly spaced positions between p2B-1 and p2B-9.

Figure 4B:
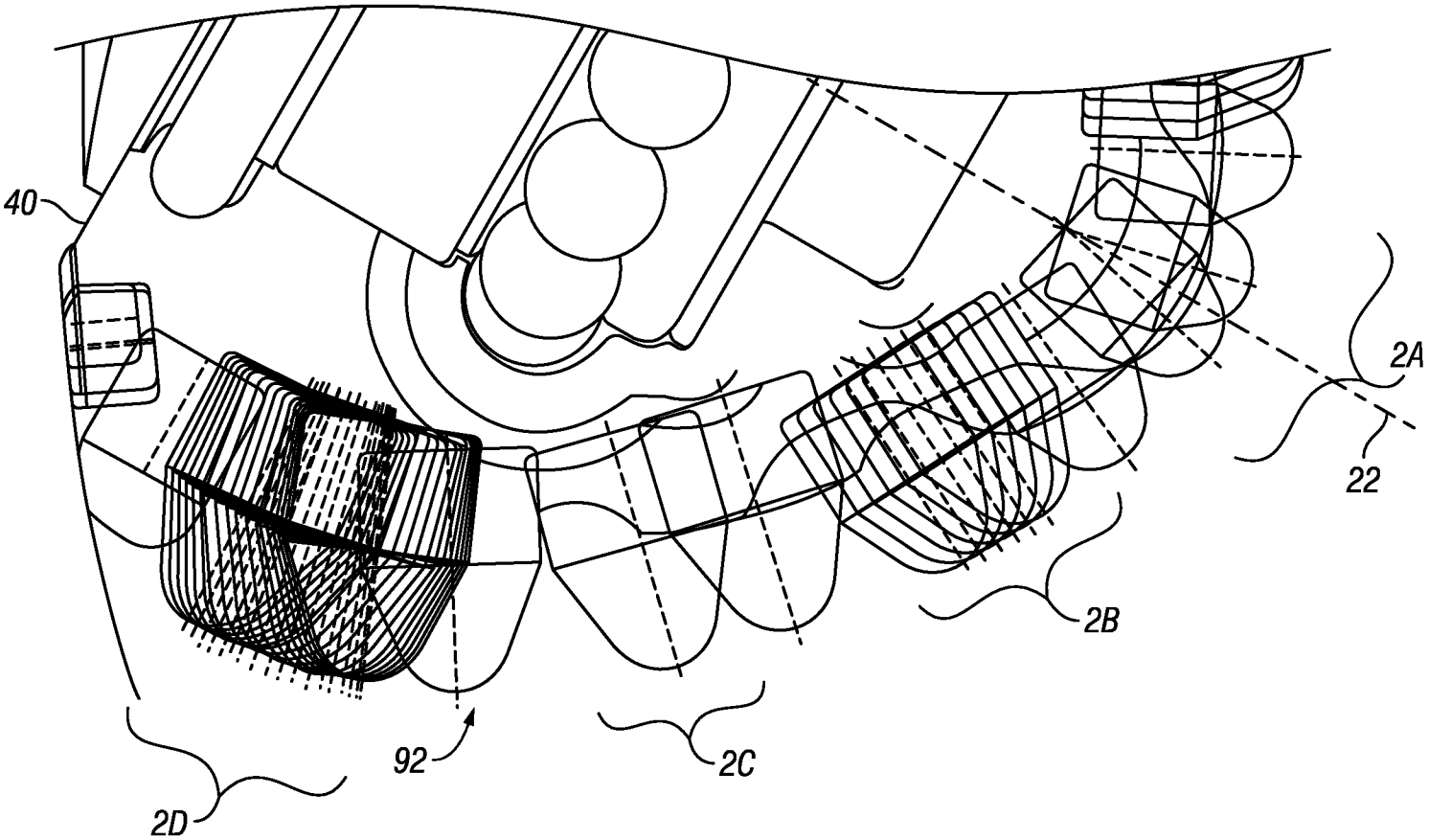
FIG. 4B is a magnified, partial, aggregated profile view showing the cutting paths of certain of the cutting elements in the cone of FIGS. 3A and 3B.

FIG. 4B is a partial section view showing, in rotated profile, the cutting profiles of the cutting elements of FIG. 4A in combination with the remaining cutting elements shown in FIG. 3A and FIG. 3B. In particular, from this view, it can be seen that the cutting elements within respective ones of the arrays 2A-2D overlap with one another to cut the wellbore bottom with minimal ridges or tracking along the wellbore. In addition, it should be noted that some of the cutting elements within each of arrays 2A-2D have been omitted for the sake of clarity and conciseness.

Figure 4C:
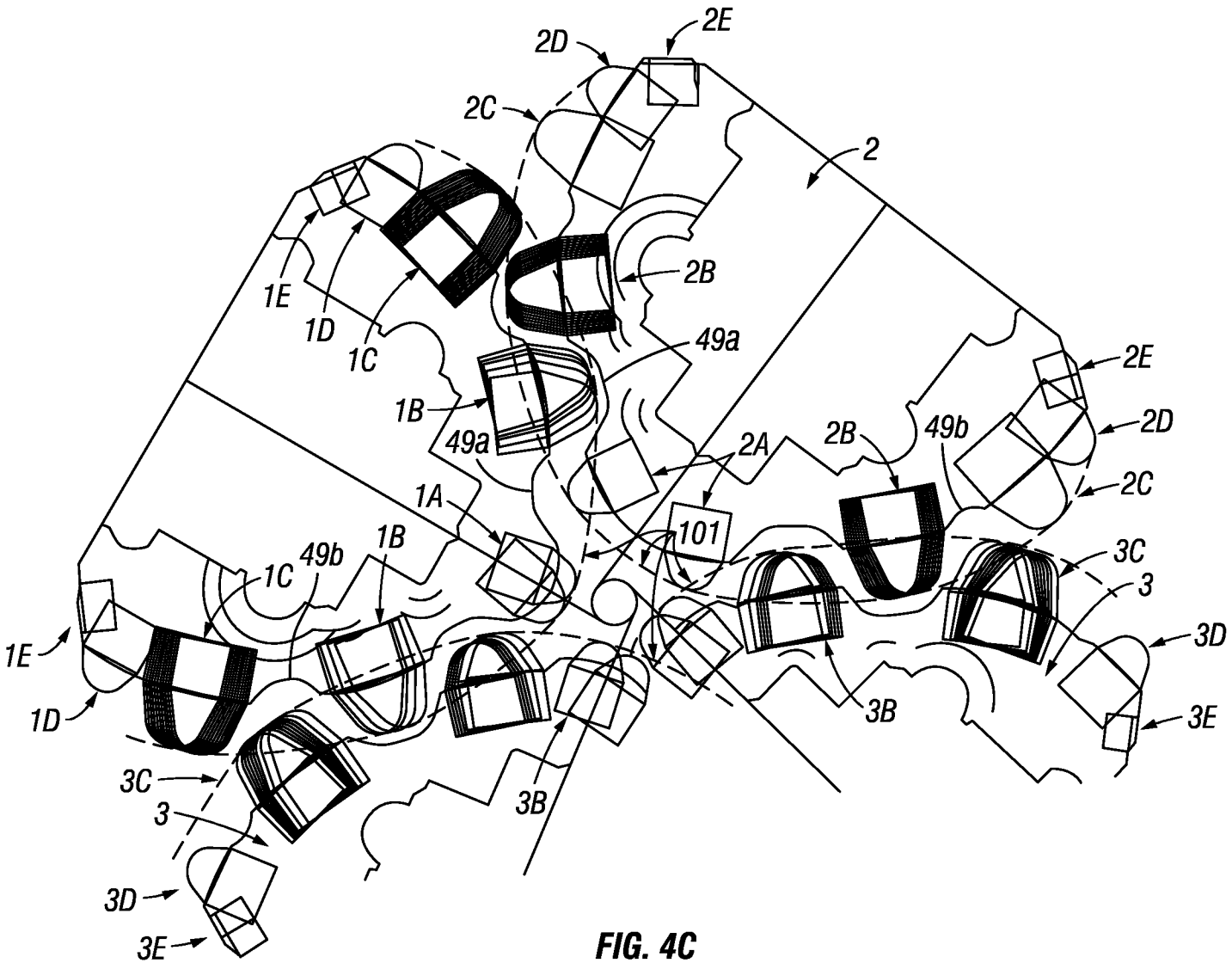
FIG. 4C is a schematic representation of a cross-sectional view of the three roller cones of the bit of FIG. 1.

FIG. 4C is a schematic representation of a cross-sectional view of the three roller cones of the bit shown in FIG. 1. From this view, the intermesh and non-intermeshing cutting element arrangements can be seen. As previously discussed, intermeshing cutting elements on one cone may overlap with the spline or envelope (e.g. envelopes 101) defined by the maximum extension of the cutting elements on an adjacent cone. In addition, it should be recognized that the uneven load distribution may be greatest within arrays in the intermesh region 70. Therefore, in some embodiments, arrays within intermesh region 70 are biased—either by adjusting the count of cutting elements at each radial position or by adjusting the spacing between radial positions—to improve the load distribution as disclosed herein. For example, array 1B of cone 1 intermeshes with cone 2 between array 2B and row 2A, and intermeshes with cone 3 between array 3B and array 3C. Further, array 2B (which includes, in some embodiments, an increased cutter count as disclosed in reference to FIGS. 3A and 3B) of cone 2 intermeshed with cone 1 between array 1B and array 1C, and intermeshes with cone 3 between array 3B and array 3C. Still further, array 3B of cone 3 intermeshes with cone 1 between group 1A and array 1B, and intermeshes with cone 2 between row 2A and array 2B. Array 3C of cone 3 also intermeshes with cone 1 and cone 2. Specifically array 3C intermeshes with cone 1 between array 1B and array 1C, and intermeshes with cone 2 between array 2B and array 2C. Thus, cone 1 has two arrays at least partially in intermesh region 70 (array 1B and a portion of array 1C), and one array partially in non-intermesh region 72 (remaining portion of array 1C). Cone 2 has one array in intermesh region 70 (array 2B), and one row in non-intermesh region 72 (row 2C). Lastly, cone 3 has two arrays in intermesh region 70 (array 3B and array 3C). Within intermesh region 70, substantial bottom hole coverage is provided by rows 1A-3A and by arrays 1B-3B, and portions of 3C. In non-intermeshed region 72, outside or radially distant from the intermeshed region 70, substantial bottomhole coverage is provided by array 1C, row 2C, and portions of array 3C. Gage rows 1D-3D generally cut the corner 6 of the wellbore, and thus cut a portion of sidewall 5 and bottomhole 7. Further, heel rows 1E-3E ream the wellbore sidewall 5.

It is further noted that in the examples provided herein, cutting elements in the non-intermeshed region of the cone in an array may restrict or even prevent the cutting elements from falling within previously-made indentations so as to lessen the likelihood of bit tracking. The composite cutting profiles provided by these arrays further enhance bottomhole coverage by eliminating large, uncut regions. To resist tracking, the cutting elements of an array of non-circumferentially arranged elements may be at four or more different radial positions. In some embodiments, an array includes at least 5 different radial positions. The larger the cone diameter in the region in which the array of elements is to be placed, the greater the number of different radial positions that can be employed for same or similarly sized cutting elements. For example, with respect to cones 2 and 3, for a 7⅞ in. (20 cm) diameter bit 10, six, seven, eight, nine, or more radial positions may be used in cutter arrays that are immediately adjacent and radially inboard from a gage row.

Figure 5A:
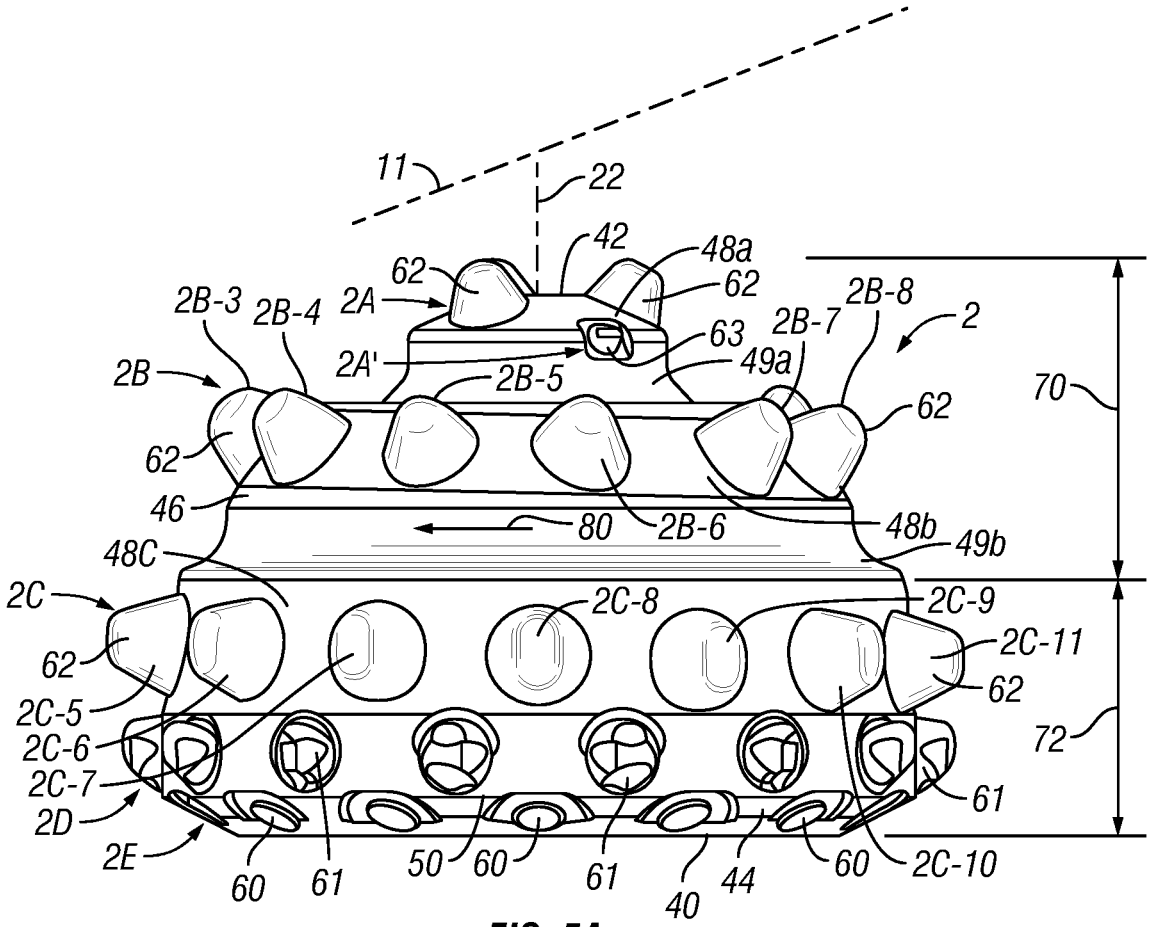
FIGS. 5A and 5B are front and rear elevation views, respectively, of another of the cones of the bit of FIGS. 1 and 2.
Figure 5B:
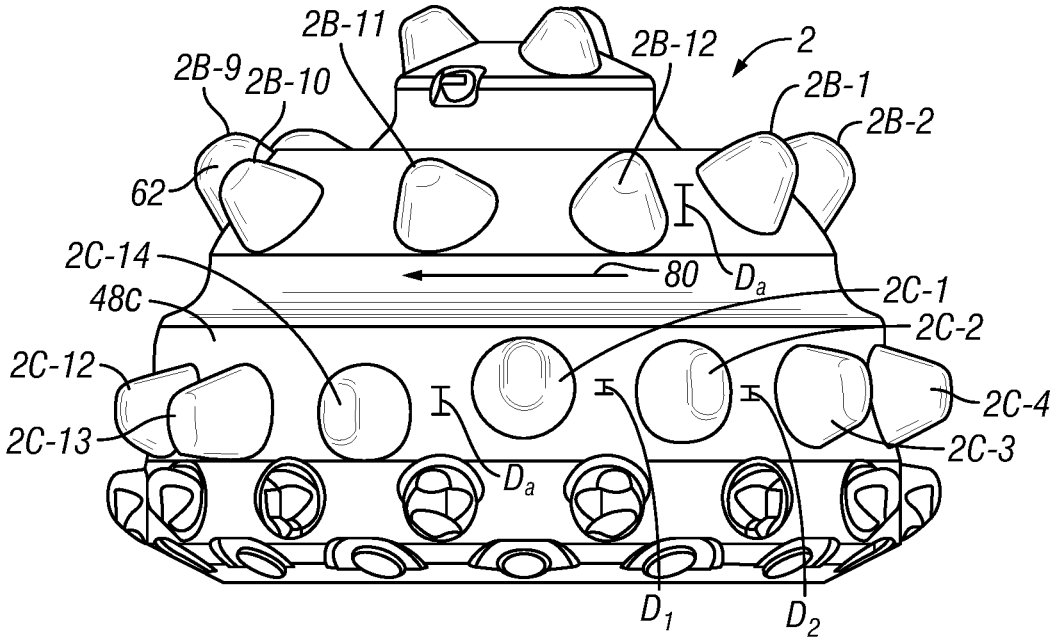

Referring now to FIGS. 5A and 5B, another embodiment of cone 2 is shown. Cone 2 is substantially similar to cone 2 described in reference to FIGS. 3A and 3B, except in this embodiment, cutting elements 62 in cutter arrangement 2C are in an arrangement similar to array 2B described in reference to FIGS. 3A and 3B. Representatively, as previously discussed, cone 2 generally includes a substantially planar backface 40, a nose 42 opposite backface 40, a generally frustoconical heel surface 44 adjacent backface 40, and a generally conical surface 46 extending between heel surface 44 and nose 42. Cone 2 further includes a circumferential row of heel cutting elements 60 extending from heel surface 44. In this embodiment, heel row cutting elements 60 are generally planar elements designed to ream the wellbore sidewall, though other cutter geometries and shapes may be used.

Adjacent to shoulder 50 and radially inward of the heel row cutters, cone 2 includes a circumferential row of gage cutting elements 61. In this embodiment, cutting elements 61 include a cutting surface having a generally slanted crest and are intended for cutting the corner 6 (FIG. 2) of the wellbore, although any of a variety of cutting element shapes and geometries may be employed in this position.

Between the circumferential row of gage cutting elements 61 and nose 42, cone 2 includes a number of rows and other arrangements of bottomhole cutting elements 62 intended primarily for cutting the bottom of the wellbore and, for example, may include cutting surfaces having a generally rounded chisel shape as shown, although other shapes and geometries may be employed. Cone 2 further may include a one or more ridge cutting elements 63.

Referring again to FIG. 5A, the cutting elements on cutter 2 may generally be described as being in various (e.g., six) different groupings or arrangements. For example, cone 2 includes a nose row 2A, which includes three substantially identical bottomhole cutting elements 62 that are mounted in the cone at nominally the same radial position so that these cutting elements 62 cut in a single swath or track in the formation. Cone 2 further includes an array 2B of bottomhole cutting elements 62. Array 2B is identical to the array 2B disclosed in reference to FIG. 3A and FIG. 3B and therefore will not be described in great detail in reference to FIGS. 5A and 5B. Between row 2A and array 2B is a row 2A' including a plurality of ridge cutting elements 63.

Continuing to move toward the backface 40, cone 2 includes an array 2C of bottomhole cutting elements 62, which is similar to array 2B. In particular, as described in more detail herein, the cutting elements of array 2C are not in a circumferential row as are the elements of row 2A, but are instead a number of radial positions (relative to the bit axis 11) like those of array 2B such that the cutting elements in array 2C do not cut in identical paths but instead cut in offset or staggered paths. Having this arrangement, the cutting elements of 2C are considered non-circumferentially arranged. Adjacent to array 2C are the gage row cutting elements 61 which, in this embodiment, are arranged in a circumferential row 2D. The heel surface 44 retains a circumferential row 2E of heel row cutter 60.

Referring in more detail to array 2C, it can be seen that the cutting elements of array 2C are arranged at a number of radial positions with respect to bit axis 11, which are within a radius Da of array 2C. For purposes of further explanation, each of the inner row cutting elements 62 of array 2C is assigned a reference numerals 2C-1 through 2C-14, there being fourteen cutting elements 62 in array 2C in this embodiment. Cutting elements 2C-1 through 2C-14 are on a generally frustoconical-shaped region or band 48*c* which encircles the cone and which may be located in the non-intermeshed region 72 between the circumferential row 2D of gage row cutting elements and array 2B of the intermeshed region 70.

In this particular embodiment, it can be seen that cutting elements 2C-12 through 2C-14, which are considered to be at outboard radial positions with respect to bit axis 11, are at a same radial position within the radius Da of array 2C, while cutting elements 2C-1 through 2C-11, which are considered to be at more inboard radial positions, are at different radial positions within the radius Da of array 2C. More specifically, the cutting elements 2C-1 through 2C-14 are arranged such that the impact force or load on each of the cutting elements within array 2C during a drilling operation is more evenly distributed among the cutting elements within the array. Representatively, in this embodiment, a count of cutting elements at radial positions within the array that experience the highest loads (i.e. are located at the greatest depth, relative to the bit axis) is increased with respect to the more inboard elements in that a count of cutting elements at one or more of the farthest outward radial positions within the radius Da of array 2C is increased. At the more radially inbound positions, a single cutting element or multiple cutting elements may located at any particular radial position.

In the case of the embodiment shown in FIGS. 5A and 5B, the farthest outboard cutting elements 2C-12 through 2C-14 are subject to higher loads than, for example, more inboard cutter such as elements 2C-1 through 2C-3. As such, cutting elements 2C-12 through 2C-14 are arranged at the same radial position within the radius Da of array 2C. The remaining cutting elements 2C-1 through 2C-11 may be at different radial positions (relative to the elements 2C-12 to 2C-14 or with respect to each other) within the radius Da of array 2C. The count of cutting elements at an outboard radial position within array 2C (the position corresponding to 2C-12 through 2C-14) may be increased, or greater than, a count of cutting elements at the remaining radially inward or inboard positions within the array 2C. Array 2C may, in some embodiments, have a total of 12 different radial positions within the radius Da of array 2C, with three cutting elements at the most radially outward radial position (e.g. elements 2C-12 through 2C-14) and one cutting element at each of the remaining radial positions (e.g. elements 2C-1 through 2C-11). It should be understood, however, that although in the illustrated embodiment, the array 2C is described as having three cutting elements at the same radial position within the array 2C, more or fewer cutting elements may be at the same radial position. For example, any number of cutting elements less than the total number in the array may be at the same radial position, with at least two of the cutting elements being at different radial positions. For example, anywhere from two to eight cutting elements may be at the same radial position within array 2C, and such radial position include any position within radius Ra, or there may be multiple cutting elements at multiple, different radial positions within radius Ra, (e.g., there may be four cutting elements at a most radially outward position and two cutting elements at each of five more radially inward positions).

In addition, it can be seen from FIGS. 5A and 5B that a spacing or distance between each of the different radial positions within array 2C in a radial direction may be equal or substantially equal (equal within manufacturing tolerances), such that a spacing or radial distance between adjacent cutting elements at different radial positions within array 2C may be the same. Representatively, a spacing or distance D1 between a radial position of cutting element 2C-1 and a radial position of cutting element 2C-2 may be equal to a spacing or distance D2 between a radial position of cutting element 2C-2 and a radial position of cutting element 2C-3. Although the spacing between 2C-1, 2C-2, and 2C-3 is shown, it should be understood that each of the remaining adjacent cutting elements (cutting elements 2C-4 through 2C-12) have the same spacing or radial distance with respect to one another such that each of the radial positions within the array 2C may be evenly spaced in the radial direction, although in other embodiments one or more unequal spacing or radial distances may be used.

Figure 6:
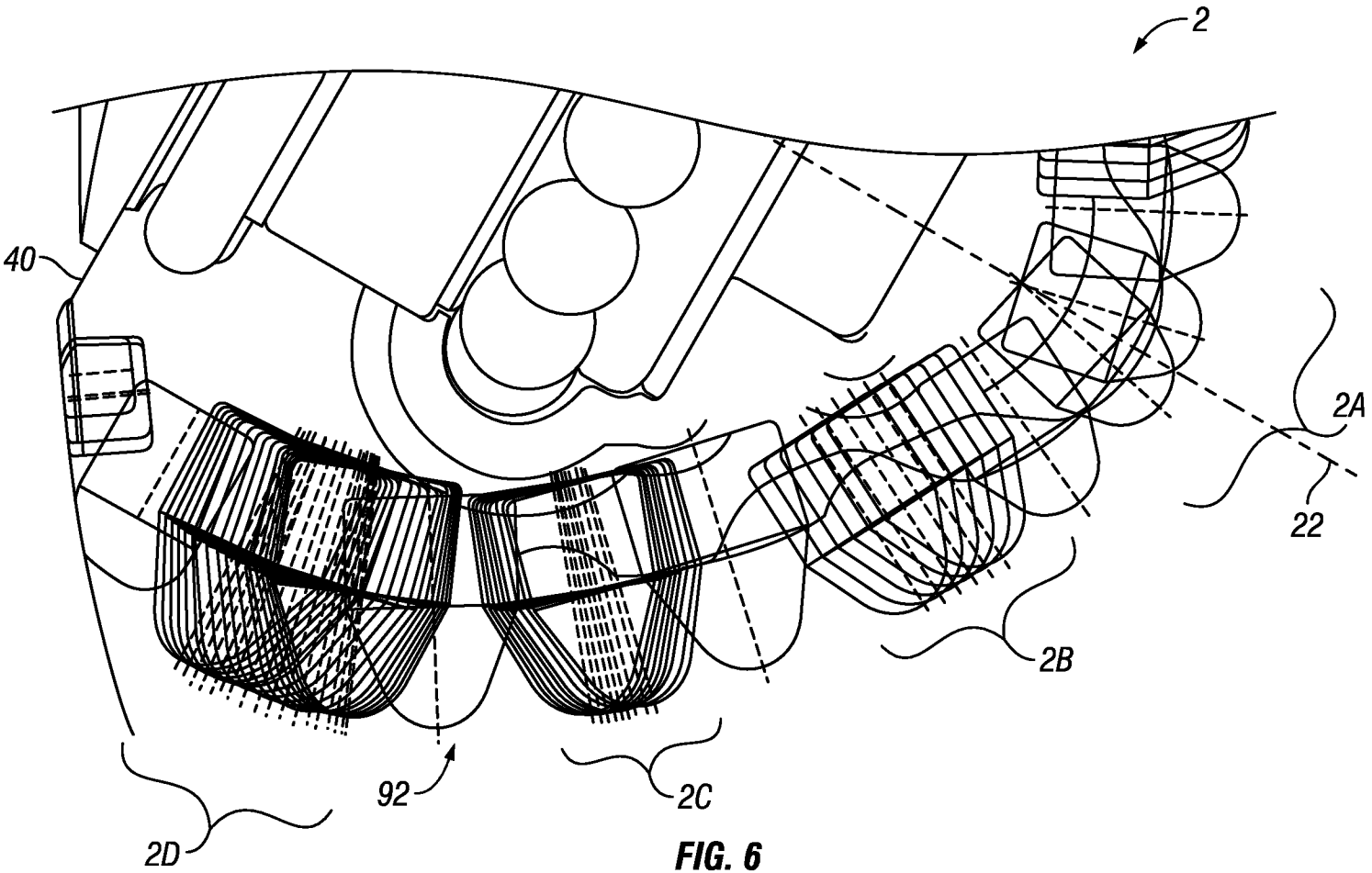
FIG. 6 is a magnified, partial, aggregated profile view showing the cutting paths of certain of the cutting elements in the cone of FIGS. 5A and 5B.

When the cutting surfaces of cutting elements 2C-1 through 2C-14 are viewed as they would appear if rotated and aggregated into a single plane, the cutter surfaces of the cutting elements of array 2C would have similar configuration to the cutting elements of array 2B shown in FIG. 3A. For example, as can be seen from FIG. 6, the cutting elements of array 2C are at a number of different radial positions within array 2C and may be evenly spaced such that the profile looks similar to the profile of array 2B, which was discussed in reference to FIGS. 4A and 4B. It should be understood that the cutter profiles of some of the cutting elements in arrays 2A-2D are omitted for the purpose of clarity and conciseness.

The increased cutter count at radial positions within the array 2C that are susceptible to higher loads (i.e. closer to the wellbore bottom 92), may results in improved load distribution per cutter, in some embodiments of the present disclosure. Because no individual insert is experiencing a comparatively high load as it engages the formation, the likelihood that the cutting tip of each of the elements will be damaged or otherwise fail is reduced, which in turn increases the overall bit life.

Figure 7A:
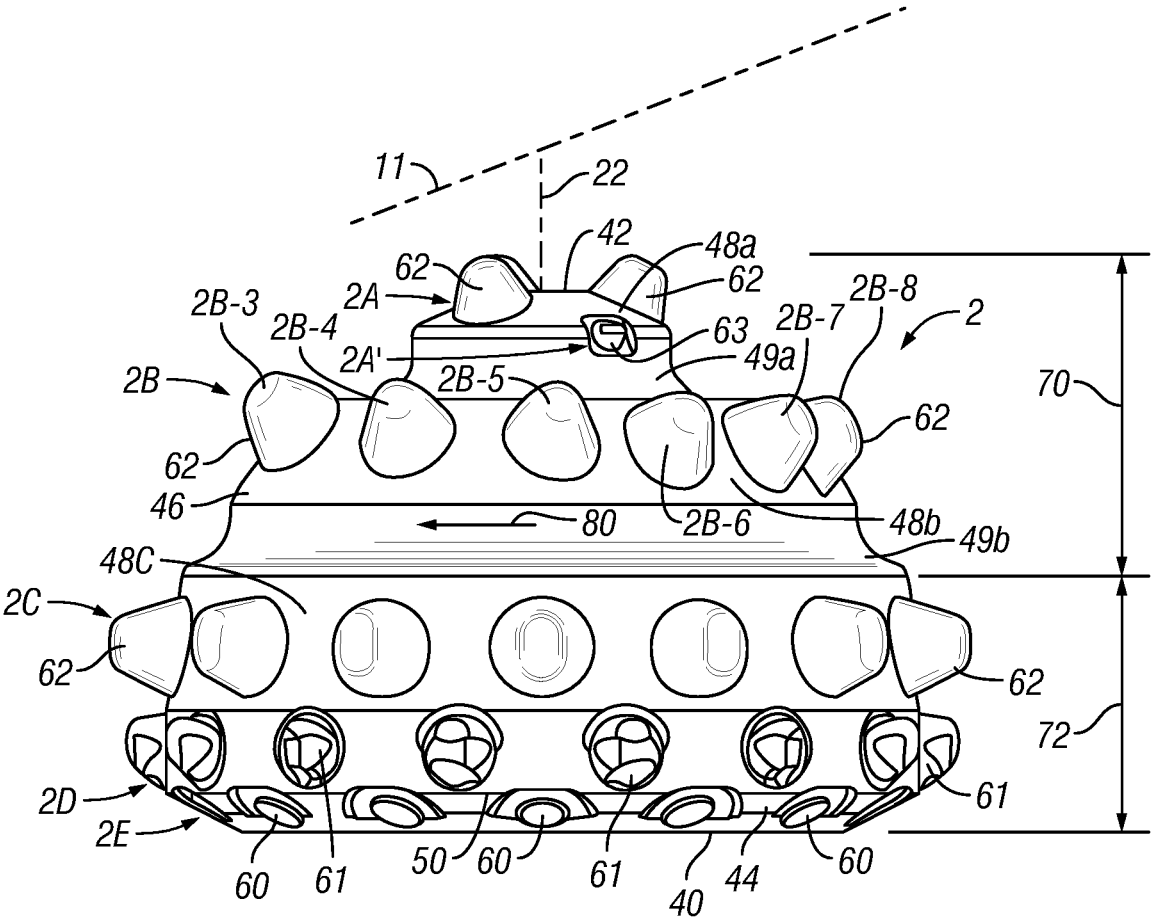
FIGS. 7A and 7B are front and rear elevation views, respectively, of another of the cones of the bit of FIGS. 1 and 2.
Figure 7B:
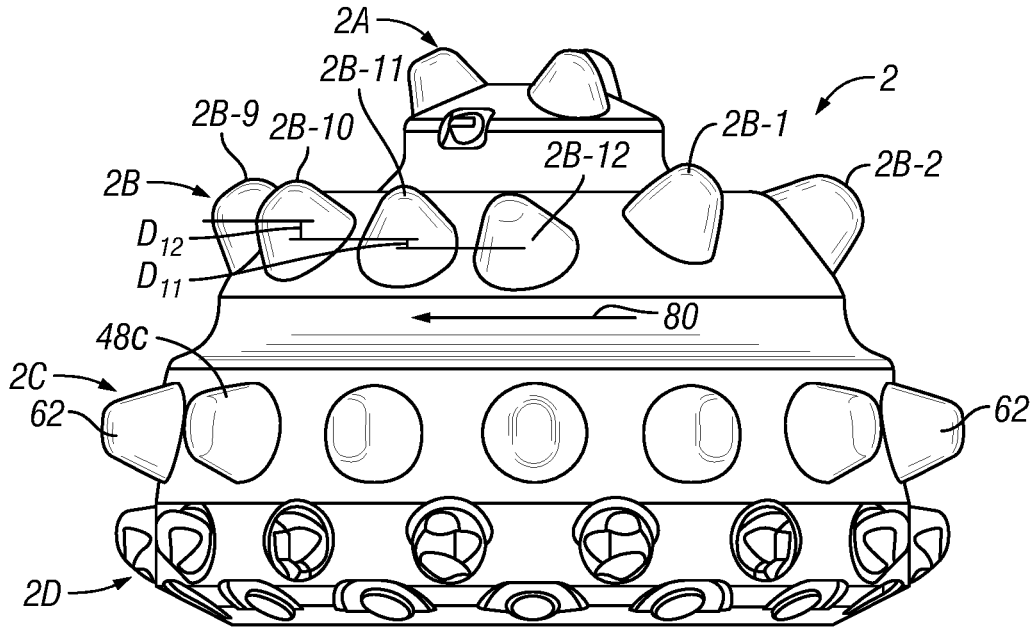

Referring now to FIGS. 7A and 7B, another embodiment of a cone 2 in which a load is more evenly distributed among the cutting elements is described. Cone 2 may be similar to and include features such as those previously discussed in reference to cone 2 in FIGS. 3A and 3B. As such, a detailed discussion of each feature of cone 2 of FIGS. 7A and 7B will be omitted for the sake of conciseness. In this embodiment, however, a more even load distribution among the cutting elements 2B-1 to 2B-12 of array 2B is achieved by modifying a spacing or radial distance between adjacent cutting elements. In particular, in this embodiment, a spacing or radial distance between two or more of cutting elements 2B-1 to 2B-12 is uneven or otherwise non-uniform. In one aspect, the spacing or distance is tighter between cutting elements exposed to the highest loads during a drilling operation, such as for cutting elements closest to the bottom of the wellbore, or closest to a horizontal line tangent to a spline of the cutting elements, as described in more detail in reference to FIG. 8. In some aspects, a cutting element density within the higher load positions of the array is increased with respect to the cutting element density in lower load areas. For example, in this embodiment, a spacing or radial distance between adjacent cutting elements at the more outboard positions or radially outward radial positions within array 2B is smaller than (or less than) the spacing or radial distance between adjacent cutting elements at the more inboard positions or more radially inward radial positions within array 2B. For example, cutting element 2B-12 at the most radially outward position within array 2B or farthest outboard from bit axis 11 may be exposed to the highest load forces during a drilling operation because it is the closest, or closer, to the bottom of the hole than other cutting elements in the array. In addition, this cutting element 2B-12 may have a single adjacent cutter (cutter 2B-11), which may cause cutting element 2B-12 to experience greater loads as compared to cutting elements in array 2B that have two adjacent cutting elements over which loads are distributed. The next inboard cutting element 2B-11 will also be exposed to high load forces, but they may be less than cutting element 2B-12. The load forces on the cutting elements may gradually decrease as one continues radially inward along array 2B, with cutting element 2B-1 generally experiencing the lowest load forces among the cutting elements in array 2B. It has been found in reviewing embodiments of the present disclosure, however, that by decreasing a radial distance or spacing between cutting elements exposed to the highest load forces, the load within array 2B can be more evenly distributed. Thus, in this example, the load force distribution among cutting elements 2B-1 to 2B-12 within array 2B is more evenly distributed by making a spacing or radial distance between the radial positions of adjacent cutting elements 2B-11 and 2B-12 smaller than the spacing or radial distance between that of adjacent cutting elements 2B-10 and 2B-11, and the spacing between adjacent cutting elements 2B-10 and 2B-11 is smaller than a spacing between the next inboard adjacent cutting elements, and so on, until the farthest inboard cutting element (e.g. cutting element 2B-1) is reached. In other words, a radial distance D12 between radial positions of cutting elements 2B-11 and 2B-12 may be less than that of each other adjacent cutting element radial position within array 2B, and more specifically, a radial distance D11 between radial positions of cutting elements 2B-10 and 2B-11. The spacing or radial distances between adjacent cutting elements may decrease gradually, and in some cases evenly, as one moves radially inward within array 2B, or by varying degrees depending upon the positions of the cutting elements with respect to the wellbore bottom. In some embodiments, the circumferential spacing between cutting elements in the array 2B may be equal or varied. For instance, adjacent cutting elements with closer radial positions may be circumferentially closer than adjacent cutting elements with more distant radial positions, or the opposite could also be true.

Accordingly, a bit may be designed by adjusting the radial spacing, the circumferential spacing, or both, between cutting elements having adjacent radial positions within an array to achieve an array with more equal load distribution across each of the inserts in the array. Methods for designing a bit including arrays with more equal insert loads include increasing the load on one or more inserts experiencing a load less than the average load experienced by an insert in the array (by increasing the spacing between adjacent radial positions), decreasing the load on one or more inserts experiencing a load greater than the average load for the array (by decreasing the spacing between adjacent radial positions), or both. In some embodiments, after achieving a more equal load across the inserts in an array, the average load experienced by an insert in the array is substantially unchanged.

Figure 8:
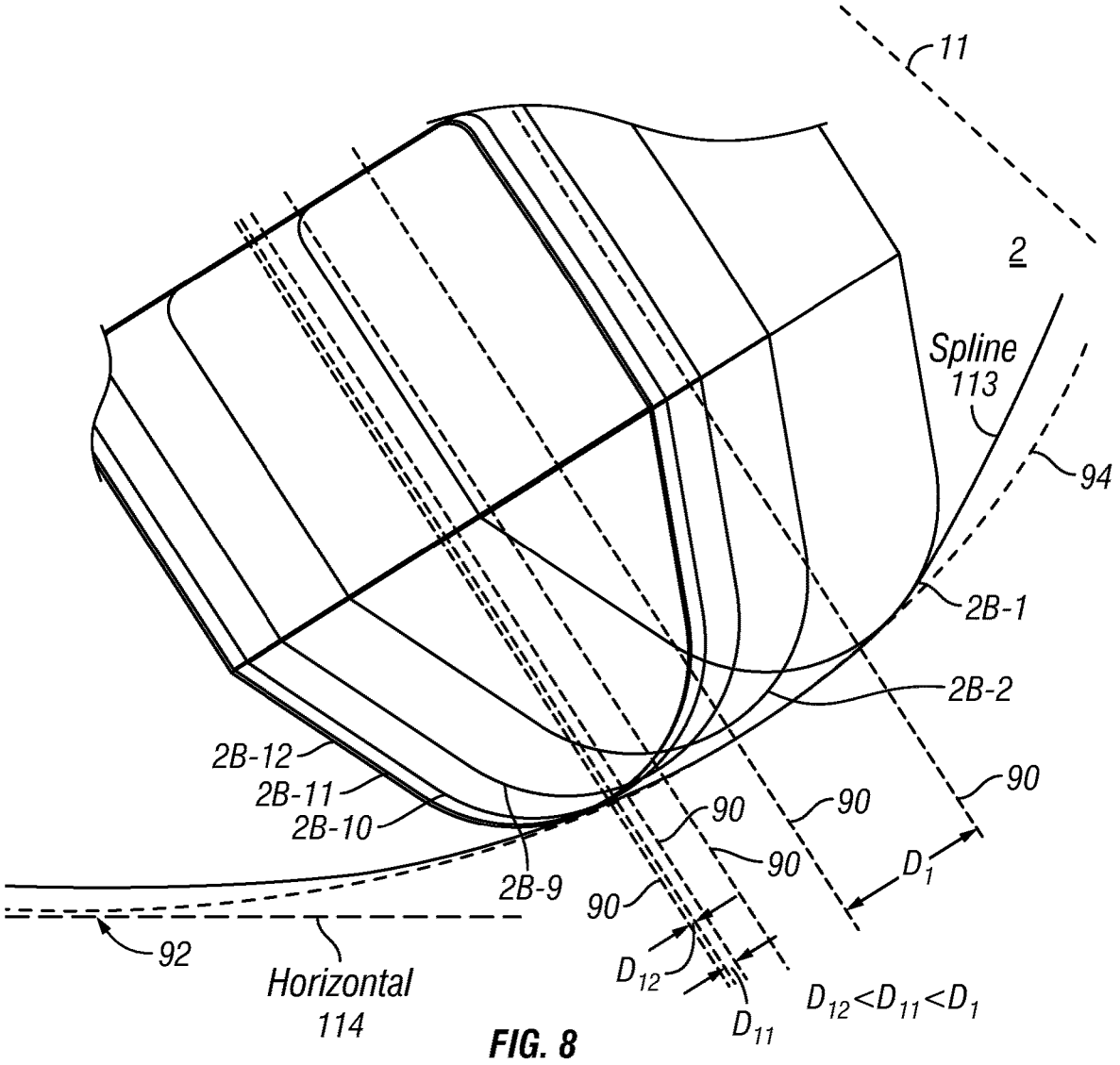
FIG. 8 is a magnified, partial view showing, in rotated profile, the cutting path of certain of the cutting elements in the cone in FIGS. 7A and 7B.

The unequal (or non-uniform) spacing between adjacent cutting elements within array 2B can be seen more clearly from FIG. 8, as viewed in rotated profile. From this view, it can be seen that a spacing or radial distance between the farthest outward adjacent cutting elements in array 2B may be less than a spacing or distance between the farthest inward adjacent cutting elements in array 2B. For example, radial distance D12, between the farthest outward cutting element 2B-12 and the next inward cutting element 2B-11, may be less than the radial distance D1 between the most radially inward cutting element 2B-1 and the next outward cutting element 2B-2. In addition, radial distance D12 may be less than the radial distance D11 of the next adjacent set of cutting elements 2B-11 and 2B-12, which may be less than radial distance D1. Thus, the spacing or radial distance may continue to increase as the cutting elements get closer to the bit axis 11, which may be closer to the most radially inward cutting element 2B-1. The spacing or radial distance between adjacent cutting elements may thus be tighter between cutting elements closest to the wellbore bottom 92. It should be understood that some of the cutting elements of array 2B are not shown in the interest of clarity and conciseness. In addition, although FIG. 8 shows the more radially outward cutting elements being more tightly spaced than the more radially inward cutting elements, it should be understood that the more tightly spaced cutting elements could be within any area or portion of the array 2B, including any portion considered to be closer to horizontal line 114 tangent to a spline 113 of the cutting surfaces, or profile of the wellbore 94, as viewed in the bottomhole profile. In some cases, this area of the array may be a more radially inward or inboard portion of the array.

In some aspects, the spacing or radial distance between cutting element positions is considered biased toward positions taking greater load. Where the number of cutting elements in each position of the array is equal, the bias will generally be to the outermost radial position, or the lowest most position along the bit axis. When there is a large distance from the given array to the next outboard array, the insert position farthest outboard will generally take more load than positions inboard of it. In some embodiments, when the distance from the outboard-most radial position in array to the inboard-most position in an adjacent array is greater than D/(N−1)*(1.1), where D is the width of the array and N is the number of radial positions in the array, the outboard-most radial position in the array will generally see a greater load than other radial positions within the array. So, in order to balance the load within the given array, placing inserts in positions close to the farthest outboard position will help to take on some of that load and hence distribute the load more evenly.

In some cases the radial distance from the next inboard position to the farthest outboard position in the given array will be D/(2*(N−1)), when the most inboard position of the next outboard array is of a distance larger than 2*D/(N−1) to the farthest outboard position of the given array, where D is the distance from the farthest outboard position to the position of the farthest inboard position of the given array, and N is the number of positions in the array. In some embodiments, the distance from the farthest outboard position to the next, nearest inboard position will be between 0 and D/(N−1). In some embodiments, the distance may be D/(2*(N−1)), or from 0 to D/(2*(N−1)).

It should be understood that biasing may occur within a subset of positions within an array. For example, spacing between outboard radial positions may be biased, while spacing between inboard radial positions may be equal. In some embodiments, the spacing between outboard-most radial position and the adjacent radial position is reduced, without reducing spacing between other radial positions, in order to reduce the load on or work done by the two most outboard inserts (or the number of inserts at the two positions). In other embodiments, the spacing between the most inboard radial position and the adjacent (second inboard) radial position is equal to the spacing between the second inboard radial position and the third radial position, while each other remaining position is biased. It should be understood that any combination of equal and non-equal spacing may be used in order to cause the loads on or work done by individual inserts within an array to be more equal than a comparable array with equal spacing between positions and equal count at each position.

It should further be understood that when there is overlap with adjacent arrays, a spacing may be near equal. This is due to the generally more equal distribution of loads on inserts in the array, as well as those in adjacent arrays. When the distance from the end of the given array to the beginning of the next array is close to D/(N−1), the distance from one position to the next in the given array and even the next outboard position may be a gradual increase in distance according to the radial distance from the bit center to the position of each of the positions.

In addition, it should be understood that the spacing, or density, of the cutting elements within the array may be varied in any number of manners, considering manufacturing constraints. In particular, the insert bottoms may take up space within the cone and a minimum distance between the bottoms may be maintained in order to prevent cracking within the cone; however, such constraints may not be in place for teeth integrally formed with the cone. Thus, the spacing between cutting elements may be reduced to any distance, and the density increased, although for inserts a minimal insert bottom distance may be maintained.

Figure 9:
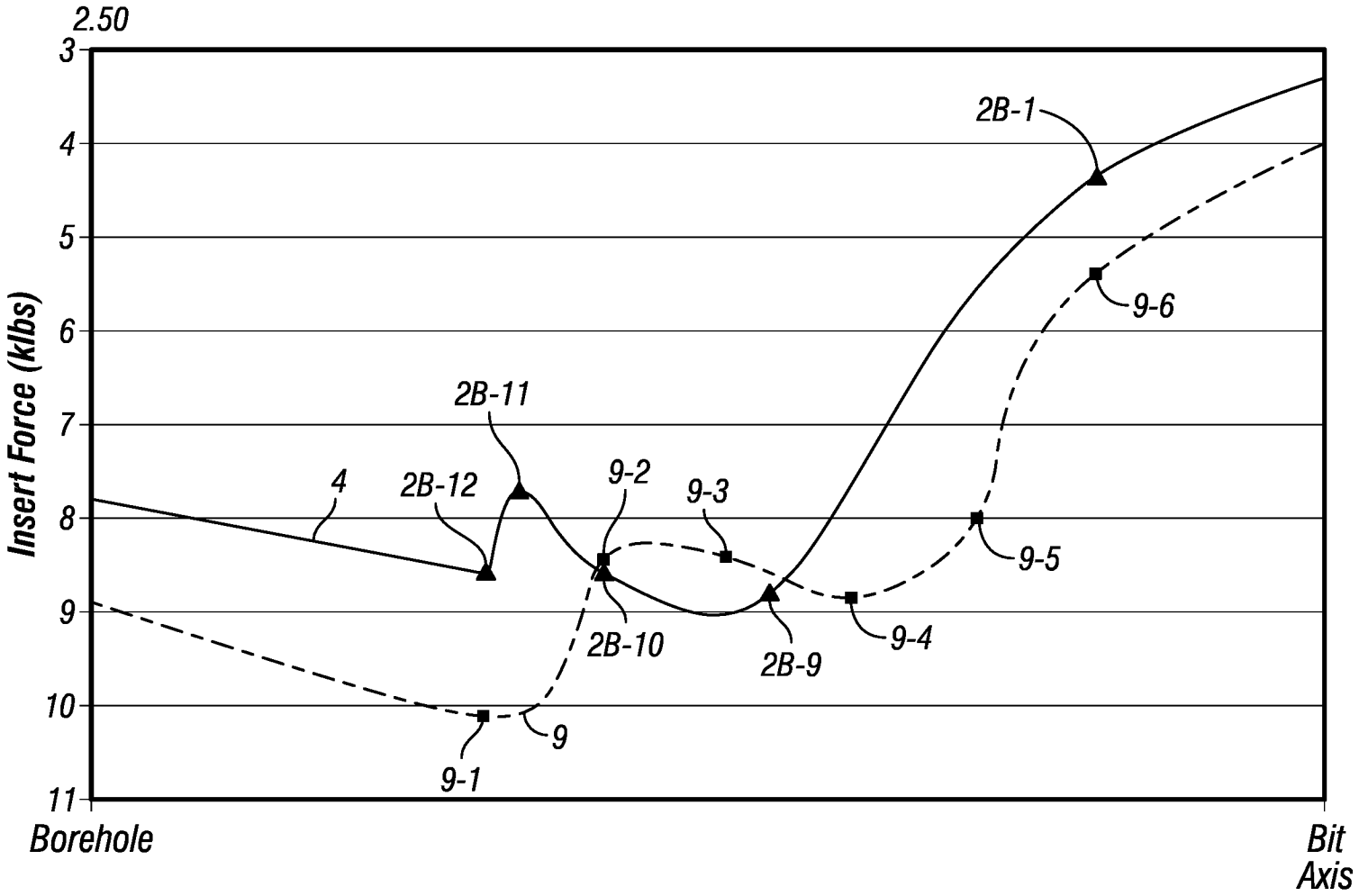
FIG. 9 illustrates the force distribution of a conventional cutting element array and the cutting element array of the cone of FIGS. 7A and 7B.

FIG. 9 is a graph showing an insert force distribution comparison between a conventional array having a spiral configuration with evenly spaced cutting elements and an array having unevenly spaced cutting elements such as array 2B described in FIGS. 7A and 7B. The conventional array is illustrated by dashed line 9 and the uneven array 2B is illustrated using solid line 4. It should be understood that the y-axis represents the insert force in klbs. The x-axis represents the radial distance of the cutting elements from gage (e.g., in inches), with points farthest from the y-axis correspond to cutting elements farthest from gage and therefore closer to the bit axis.

In the graph, the load distribution among the cutting elements 9-1 to 9-6 within the array corresponding to dashed line 9, ranges from approximately 5.4 klbs (24 kN) at cutting element 9-6 farthest from gage (i.e. closest to the bit axis) to approximately 10.1 klbs (45 kN) at insert 9-1 closest to gage (i.e. farthest from the bit axis). Thus, the overall spread between the highest load cutting element and the lowest load cutting element is approximately 4.7 klbs (21 kN). Notably, however, the difference between the load on the highest load cutting element and the load on the next radially inward cutting element may be larger than the inventors of the present application desire. In this case, the load on cutting element 9-1 is approximately 10.1 klbs (45 kN) compared with the load on cutting element 9-2 of approximately 8.4 klbs (37 kN). It may then be desirable to decrease the load on cutting element 9-1 so that it is more similar, or closer to, cutting element 9-2 or a baseline.

As illustrated by line 4 representing uneven array 2B, this can be done by arranging the cutting elements within the array so that their spacing is non-uniform, or otherwise non-evenly spaced. As can be seen from the graph, the range between the highest load cutting element 2B-12 and the lowest load cutting element 2B-1 is from approximately 4.3 klbs (19 kN) to 8.8 klbs (39 kN), which is also a lower overall spread than the conventional arrangement illustrated by line 9. In addition, the difference between the highest load cutting elements and the nearest radially inward cutting elements is considerably lower than was the case with the conventional array. For example, the difference in load between cutting element 2B-12 and cutting element 2B-11 is approximately 1.0 klb (4.4 kN) or less. This is an improvement over the conventional array in which the difference in load between the most radially outward cutting element and the next inward cutting element was about 1.7 klbs (7.6 kN). Thus, in the case of array 2B, the load is more evenly distributed among the cutting elements at the higher load positions (e.g. outermost positions from the bit axis).

Figure 10:
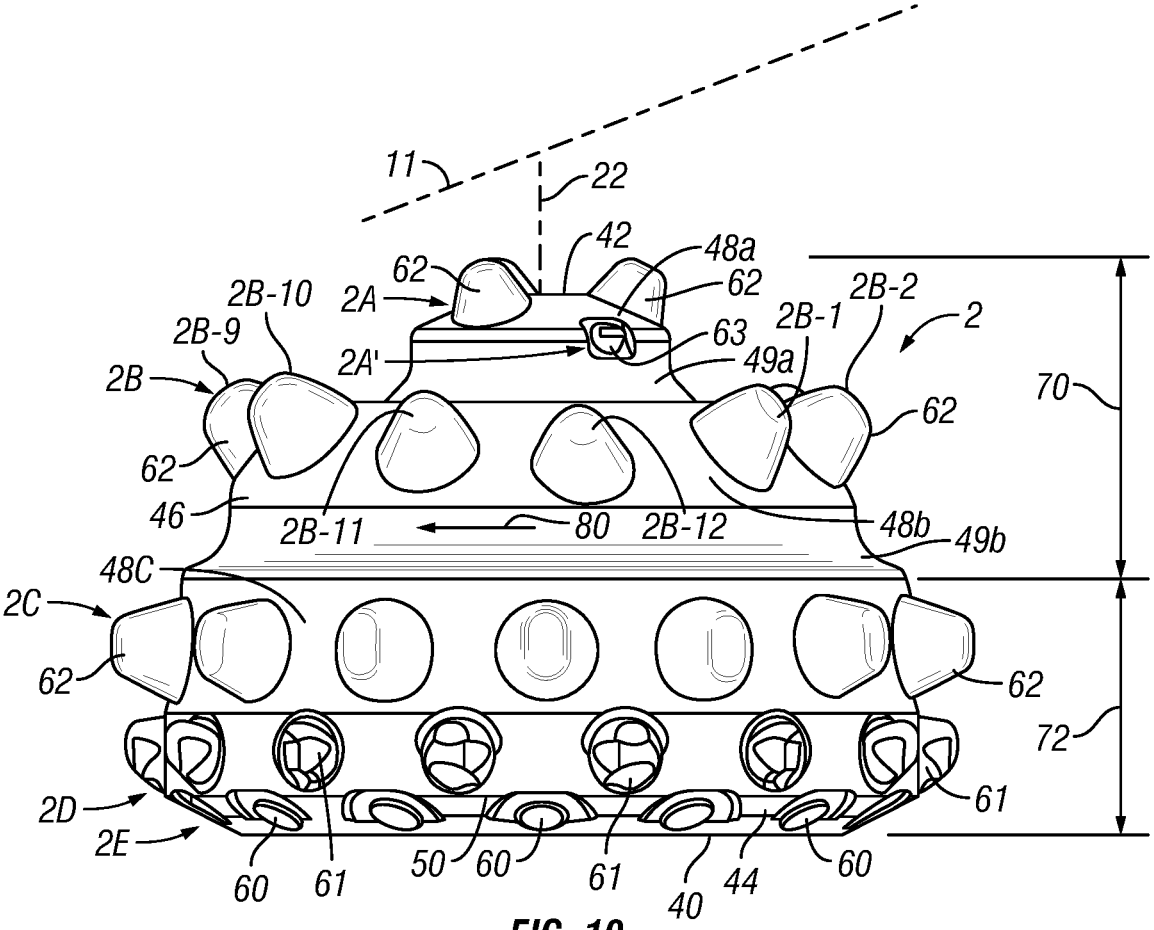
FIG. 10 is a front elevation view of another embodiment of a cone of the bit shown of FIGS. 1 and 2.

Referring now to FIG. 10, another embodiment of a cone 2 for more evenly distributing the load among the cutting elements is described. Cone 2 may include some features previously discussed in reference to cone 2 of FIGS. 3A and 3B, so a detailed discussion of each feature of cone 2 of FIG. 10 will be omitted for the sake of conciseness. In this embodiment, however, a more even load distribution among the cutting elements 2B-1 to 2B-12 of array 2B may be achieved by leveling the cutting element tips so that they are more level with the horizontal than a spline taken through each of the cutting element tips of cone 2.

In particular, as discussed herein, it has been found that cutting elements toward the bottom of a wellbore take more load than cutting elements farther up the wellbore. The cutting elements closest to the horizontal line tangent to the bottom of the wellbore may therefore take on the most load. In some cases, the highest load bearing cutting elements may be those at the most outboard positions with respect to the bit axis. In other cases, the more radially inboard cutting elements may be closer to the wellbore bottom (e.g. the cutting elements closer to the bit axis). In any case, it is believed that one of the reasons for the disparity in loads among the cutting elements is because the cutting elements lower down in the wellbore begin to cut rock before, and for a longer period of time, than the cutting elements higher up. It has therefore been found that by biasing the cutting elements within a given array so that their tips are more level with horizontal, the load on each of the cutting elements within the array is more evenly distributed.

In FIG. 10, array 2B of cone 2 is similar to array 2B described in reference to FIG. 3A and FIG. 3B except in this embodiment, cutting elements 2B-1 to 2B-12 are arranged in a stepped configuration with respect to the outer surface of cone 2. In other words, the extension heights of the cutting elements with respect to the cone axis, are different. In some embodiments, the extension height of the cutting surface may be determined relative to the cone axis. In particular, in this embodiment, a height between the cutting surfaces of cutting elements 2B-1 to 2B-12 is "stepped" such that the cutting surfaces of cutting elements at the furthest outward radial positions within array 2B are farther inboard (i.e. pulled in toward the cone axis 22) than those at more inward positions within the array 2B. For example, the cutting surface of cutting element 2B-12, which is at the farthest outward radial position within array 2B, is closer to the cone surface than the cutting surface of cutting element 2B-11, and the cutting surface of cutting element 2B-11 is closer to the cone surface than the cutting surface of cutting element 2B-10, and so on as one continues toward the most radially inward position within array 2B. In other words, the cutting surface of cutting element 2B-1 will be farthest from the cone surface and the cutting surface of cutting element 2B-12 will be closest to the cone surface. The cutting surfaces of cutting elements 2B-2 to 2B-11 may, therefore, be at a number of stepped heights in between that of cutting elements 2B-1 and 2B-12. Array 2B may have stepped cutting elements along the entire array, which become more horizontal as one continues around the array. The step range may be between the spline and a horizontal plane perpendicular to the bit axis (roughly aligned with the wellbore bottom profile) and could change from insert to insert so that the slope is closer to horizontal. The different step heights among the cutting surfaces may be achieved by, for example, one or more of pushing some cutting elements to a farther inboard position within the cone surface, or pulling others farther outboard from the cone surface.

In some cases, the step height between each of the adjacent cutting elements is even or relatively even along the array such that a line drawn through each of the cutting surfaces forms a slope which is more level with horizontal than a spline (e.g. spline 113 of FIGS. 11 and 12) along the bottomhole profile. The more level the slope is to horizontal than the spline, the more evenly distributed the load may be among the cutting elements within the array. The slope of the insert surfaces and their deviation with respect to a spline can be seen more clearly in the bottomhole profile views of FIG. 11 and FIG. 12.

Figure 11:
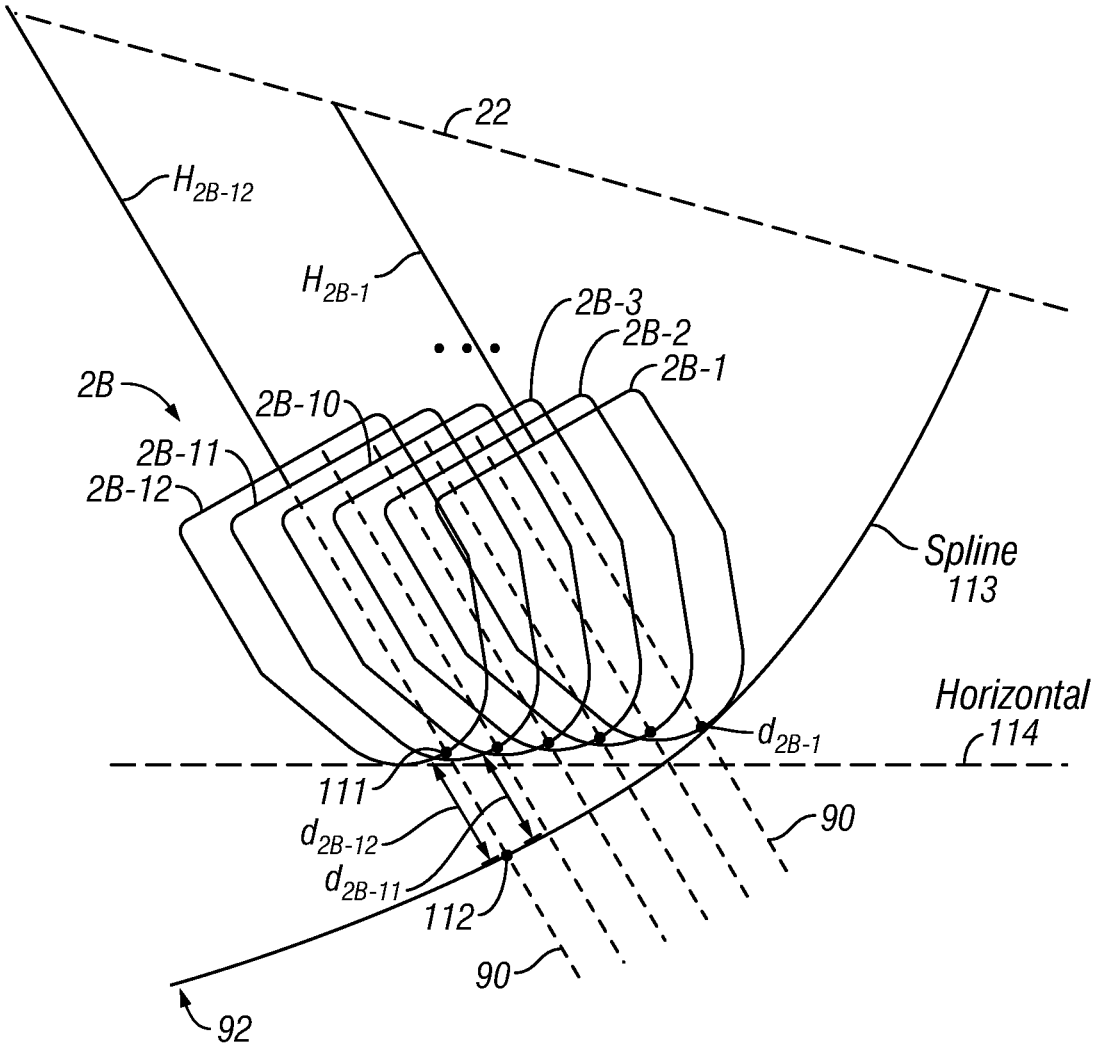
FIG. 11 is a magnified, partial view showing, in rotated profile, the cutting path of certain of the cutting elements in the cone of FIG. 10.

In particular, FIG. 11 shows the rotated profile view of the cutting elements within array 2B. It is noted that some of the cutting elements are omitted in the interest of conciseness. This view illustrates the step height of the cutting surfaces with respect to the cone axis, and one another, as well as their deviation from spline 113. As previously discussed, spline 113 is the curve intersecting the insert tip within each array that is farthest from the cone surface. In other words, in this embodiment, the outermost insert 2B-1 is on the spline and controls the position of the spline with respect to array 2B. Representatively, each cutting element has a cutter axis 90 that intersects the cutting surface at location 111 when viewed in the rotated profile. Location 111 is considered the tip of the cutting surface and therefore the most outwardly extending portion of the cutting element. A height H of the cutting element may then be determined by measuring the distance between location 111 and the point where the cutter axis 90 intersects the cone axis 22. For example, it can be seen that the cutting surface of cutting element 2B-12 has a height H2B-12 as shown and the cutting surface of cutting element 2B-1 has a height H2B-1.

In addition, the deviation of each of the cutting surfaces with respect to spline 113 can also be seen from this view. In particular, the distance d between the tip location 111 of each cutting surface and the location 112 where the cutter axis 90 intersects spline 113 represents the deviation from spline. For example, cutting element 2B-12 deviates a distance d2B-12 from spline 113 while cutting element 2B-11 deviates a distance d2B-11 from spline 113. Distance d2B-11 is less than distance d2B-12; therefore, the cutting surface of cutting element 2B-12 deviates farther from spline 113 than the cutting surface of cutting element 2B-11. In the illustrated embodiment, distance d increases as one goes in an outboard direction along array 2B. In other words, the cutting surfaces of cutting elements at positions nearer the outer radius of array 2B deviate more from spline 113 than the cutting surfaces for cutting elements at positions nearer the inner radius of array 2B.

Still further, it should be understood that in order to improve the load distribution among the array 2B, the cutting surfaces of the cutting elements 2B-1 to 2B-12 may be more level with horizontal 114 than spline 113. In particular, in reference to FIG. 12, it can be seen that a cutting element slope 116 formed through the tips of the cutting element surfaces is more level with horizontal 114 than the spline slope 115. For example, angle 117 represents the angle formed between cutting element slope 116 and horizontal 114, while angle 118 represents the angle formed between horizontal line 114 and spline slope 115. As is evidenced by the degree of angle 117 in comparison to that of angle 118 (angle 117 is less than angle 118), the cutting element slope 116 is considered to be more level with horizontal than spline 113. In addition, it should be understood that the incline of cutting element slope 116 may be anywhere between that of horizontal 114 and spline slope 115, with an example embodiment of the cutting element slope angle 117 being less than the spline slope angle 118 (e.g., the cutting element slope angle 117 may be 25%, 50%, 75%, 90%, 95%, or values therebetween, of spline slope angle 118). Horizontal 114 is represented by, and should be understood to mean, a line parallel to a level bottom of a wellbore. In some embodiments, cutting element 2B-1 is located on the spline. In some embodiments, cutting element 2B-2 deviates from the spline by a distance that is within a range including lower or upper limits including any of 0 in. (0 mm), 0.01 in. (0.25 mm), 0.02 in. (0.51 mm), 0.03 in. (0.76 mm), 0.05 in. (1.27 mm), 0.075 in. (1.91 mm), or values therebetween. For instance, the cutting element 2B-2 may deviate from the spline by a distance that is greater than or equal to 0.030 in. (0.76 mm).

Figure 12:
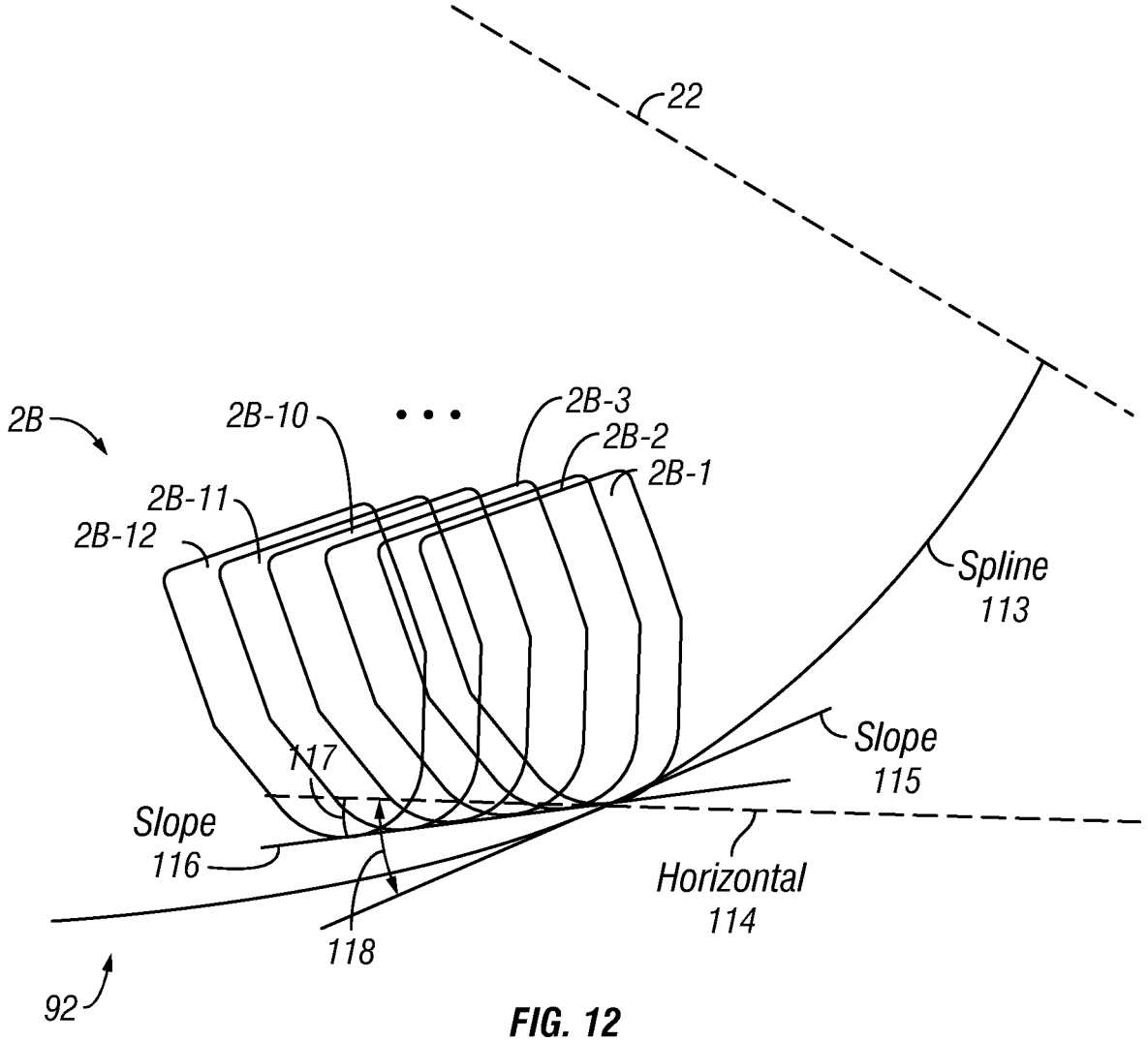
FIG. 12 is a magnified, partial view showing, in rotated profile, the cutting path of certain of the cutting elements in the cone of FIG. 10.

In addition, it can be understood from FIG. 12 that each cutting surface of the cutting elements within array 2B may be radially inward of spline 113 and may not extend outwardly beyond spline 113. For example, each of the cutting surfaces of cutting elements 2B-1 to 2B-12 may deviate away from spline 113 in an inward direction toward cone axis 22, and with the degree of deviation being uniform, or with the degree of deviation increasing uniformly or non-uniformly as the cutting elements get closer to the hole bottom 92 where higher loads may be seen. In other words, a spline formed through the tips of the cutting surfaces may be straight or generally linear, as opposed to curved spline 113.

Figure 13:
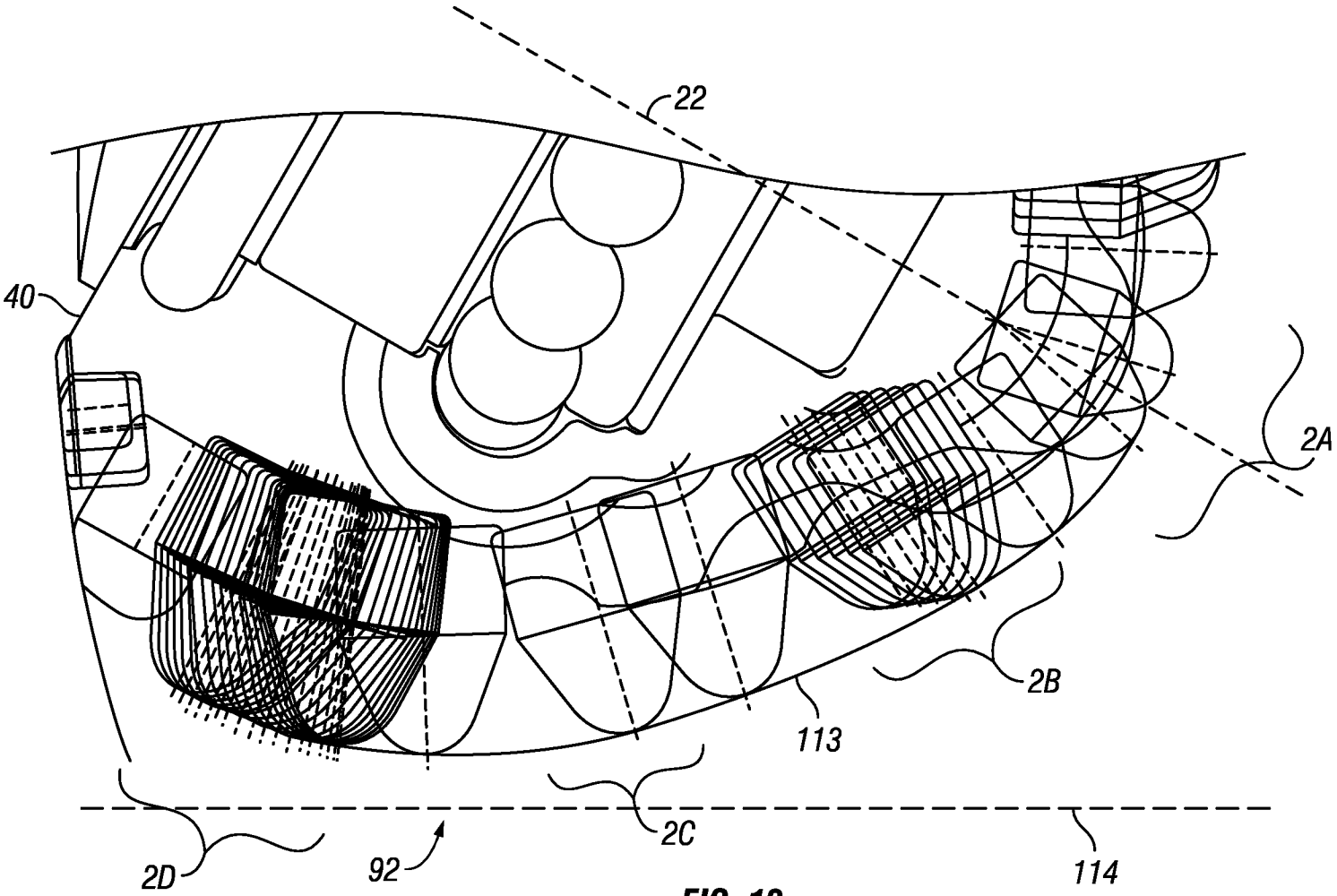
FIG. 13 is a magnified, partial, aggregated profile view showing the cutting path of certain of the cutting elements in the cone of FIG. 10.

FIG. 13 is a partial section view showing, in rotated profile, the cutting profiles of the cutting elements of FIGS. 11 and 12 in combination with the remaining cutting elements shown in FIG. 10. In particular, from this view, it can be seen that the cutting elements within respective ones of the arrays 2A, 2C, and 2D are aligned, or more level with, spline 113, while the cutting elements within array 2B are more aligned, or more level with, horizontal 114.

Figure 14:
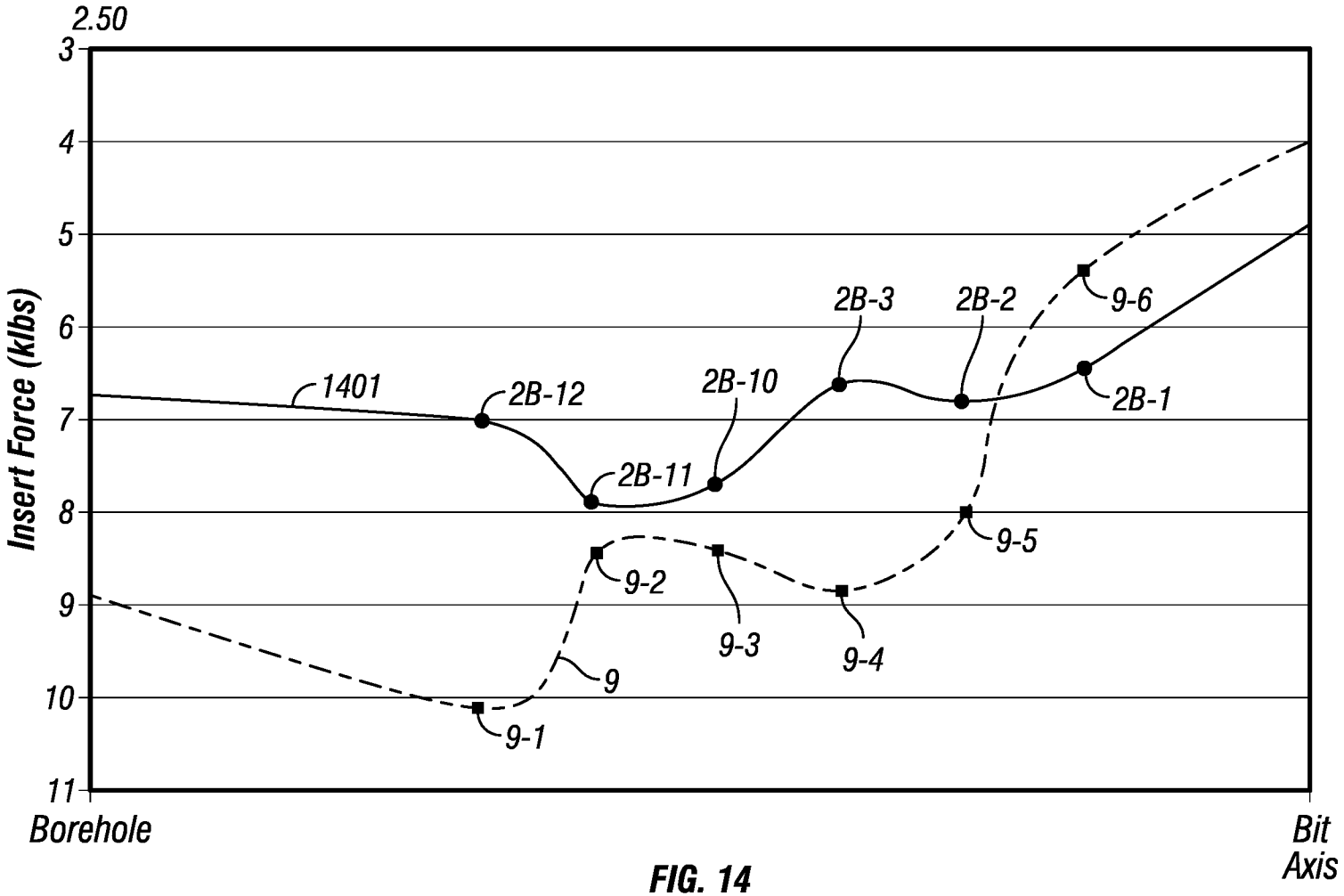
FIG. 14 illustrates the force distribution of a conventional cutting element array and the cutting element array of the cone of FIG. 10.

The more even load distribution achieved by the cutting element arrangement in array 2B will now be described in reference to FIG. 14. Representatively, FIG. 14 is a graph showing an insert force distribution comparison between a conventional array having a spiral configuration within evenly spaced cutting elements and an array having more level cutting elements such as array 2B. The conventional array is illustrated by dashed line 9 and array 2B is illustrated using solid line 1401. It should be understood that the y-axis represents the insert force in klbs, while the x-axis represents the radial distance of the cutting elements from gage (e.g., in inches).

It can be seen from the graph of FIG. 14 that the load distribution among the cutting elements 9-1 to 9-6 within the array corresponding to dashed line 9, ranges from approximately 5.4 klbs (24 kN) at cutting element 9-6 farthest from gage to approximately 10.1 klbs (45 kN) at insert 9-1 closest to gage, and an overall spread between the highest and lowest load cutting elements is approximately 4.7 klbs (21 kN). Notably, the difference between the load on the highest load cutting element and the load on the next radially inward cutting element is about 1.7 klbs (7.6 kN) as described with respect to FIG. 9. Since cutting element 9-1 experiences a considerably higher load than adjacent cutting element 9-2, cutting element 9-1 is more susceptible to wear and will likely fail before cutting element 9-2. It is therefore desirable to decrease the load on cutting element 9-1 so that it is more similar to cutting element 9-2 or the baseline.

As illustrated by line 1401 representing array 2B of FIG. 10, this may be done by arranging the cutting elements within the array so they deviate from spline and are more level with horizontal. As can be seen from the graph, the range between the highest load cutting element 2B-12 and the lowest load cutting element 2B-1 is from approximately 6.4 klbs (28 kN) to 7.9 klbs (35 kN), which difference of 1.5 klbs (6.7 kN) is a lower overall spread than the conventional arrangement illustrated by line 9. In addition, the difference between the highest load cutting elements and the nearest radially inward cutting elements is much lower than was the case with the conventional array. For example, the difference in load between cutting element 2B-12 and cutting element 2B-11 is less than 1.5 klbs (6.7 kN), or 1.0 klbs (4.4 kN), or less. Thus, in the case of array 2B, the load is more evenly distributed among the cutting elements at the higher load positions (e.g. outermost positions from the bit axis). Said another way, the standard deviation of loads within the array is lower than for a conventional array as the load on one cutting element with respect to the other is similar to a load on an adjacent cutting element, or is within a desired range.

Accordingly, a bit may be designed by "stepping" an array and adjusting insert heights in order to achieve an array with more equal load distribution across each of the inserts in the array. Methods for designing a bit having more equal insert load distribution include increasing the load on one or more inserts experiencing a load less than the average load experienced by an insert in the array (by increasing the height of inboard radial positions), decreasing the load on one or more inserts experiencing a load greater than the average load for the array (by decreasing the height of outboard radial positions), or both. In some embodiments, after achieving a more equal load across the inserts in an array, the average load experienced by an insert in the array is substantially unchanged (e.g., within 70%, 80%, 85%, or 90%).

Figure 15:
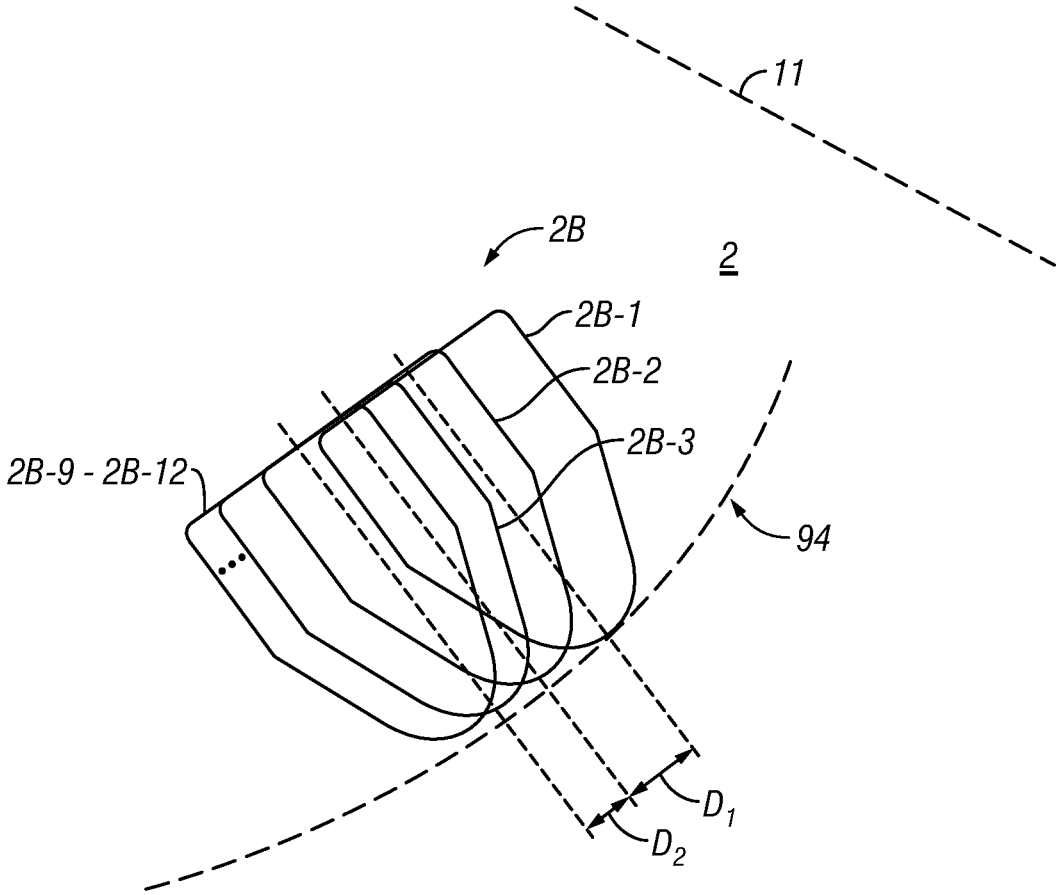
FIG. 15 is a magnified, partial view showing, in rotated profile, the cutting path of certain of the cutting elements in another embodiment of a cone of the bit of FIGS. 1 and 2.

In addition, it should be understood that in some cases, the various cutting element arrangements described herein (e.g. increased cutter count, uneven spacing, and stepping) may be combined within a single array, or used individually or in any combination in multiple arrays on a cone, to further improve the load distribution among cutting elements within the array. For example, FIG. 15 illustrates a rotated profile view of another array of cutting elements in which a combination of an increased cutter count at a particular radial position and uneven spacing arrangement is used to more evenly distribute the load among the cutting elements in array 2B. In particular, cutting elements 2B-9 to 2B-12 are shown at the same radial position (i.e. the cutter count at that position is increased) as discussed in reference to FIGS. 3A and 3B and the remaining cutting elements 2B-1 to 2B-8 are unevenly spaced as described in reference to FIGS. 7A and 7B. For example the spacing D1 between cutting elements 2B-1 and 2B-2 is greater than a spacing D2 between the more outboard, or radially outward, cutting elements 2B-2 and 2B-3. The spacing between cutting elements 2B-3 to 2B-9 may continue to decrease in a direction going away from bit axis 11 such that the count or density of cutting elements along the more outward or outboard end of array 2B, which may be subjected to the highest loads, increases.

Figure 16:
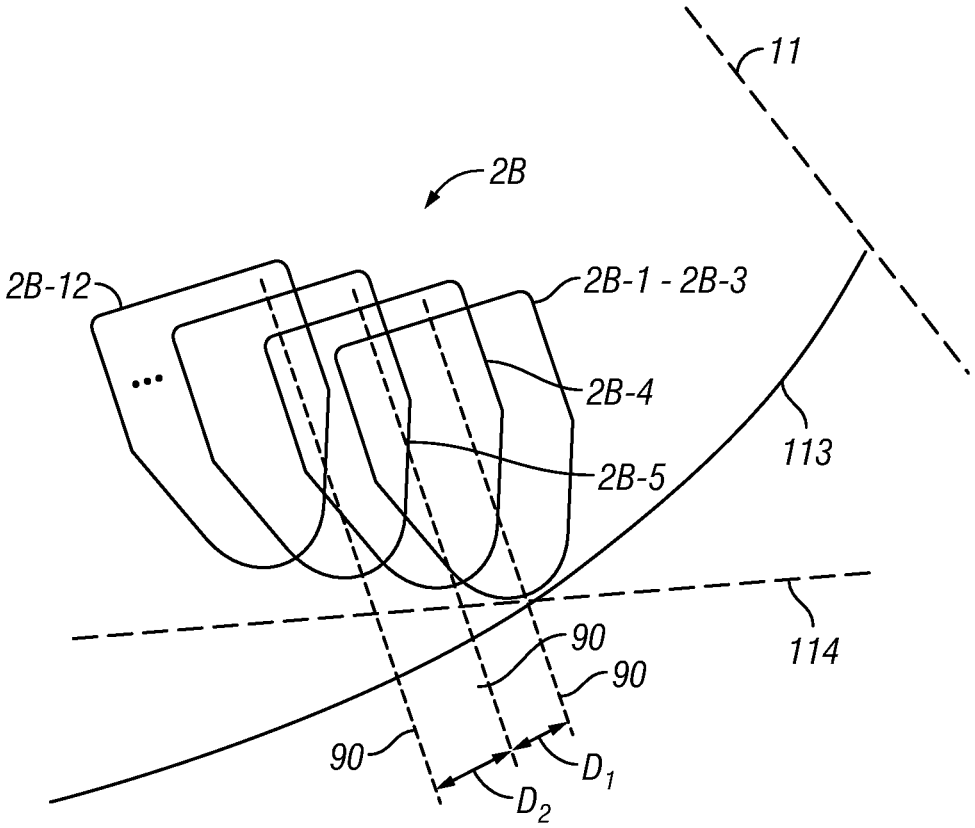
FIG. 16 is a magnified, partial view showing, in rotated profile, the cutting path of certain of the cutting elements in another embodiment of a cone of the bit of FIGS. 1 and 2.

FIG. 16 illustrates another cutting element variation within array 2B in which the count at one end of the array is increased as discussed in reference to FIGS. 3A and 3B, the spacing between cutting elements is uneven as discussed in reference to FIGS. 7A and 7B, and the cutting elements are more level with horizontal as discussed in reference to FIGS. 10 to 12. For example, cutting elements 2B-1 to 2B-12 are arranged within array 2B such that they are more level with horizontal 114 than is the spline 113. The more inboard cutting elements 2B-1 to 2B-3 within array 2B, which now may make the initial contact with the wellbore surface and may therefore be susceptible to increased load, are placed at the same radial position within array 2B. Additionally, a spacing between cutting elements may be uneven, and gets tighter as you go inboard from bit axis 11, or radial inward along the radius of array 2B. For example, a spacing or distance D1 between the most inboard cutting elements 2B-1 to 2B-3 and 2B-4, is less than the spacing or distance D2 between the farther outboard cutting element 2B-5. In this embodiment, the cutters within the array, which may now contact the wellbore first (e.g. cutting elements 2B-1 to 2B-5) during a drilling operation, are reinforced.

Figure 17A:
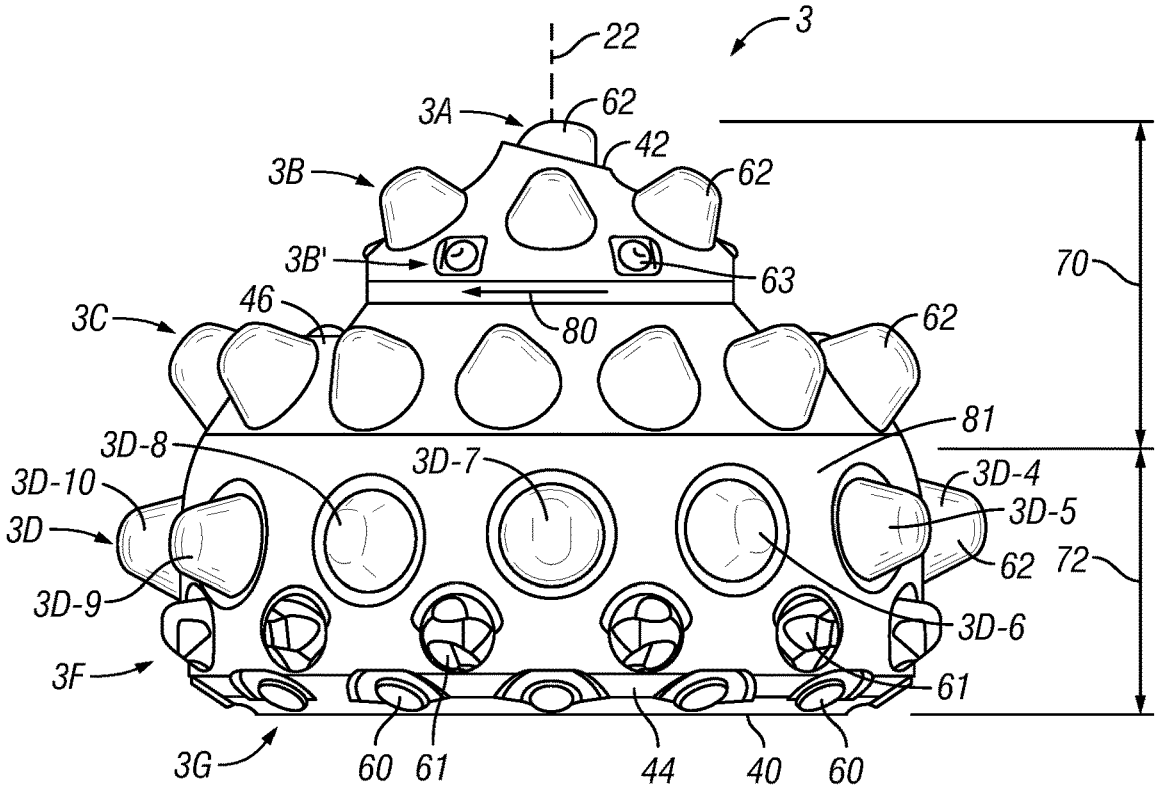
FIGS. 17A and 17B are front and rear elevation views, respectively, of another embodiment of a cone for the bit of FIGS. 1 and 2.
Figure 17B:
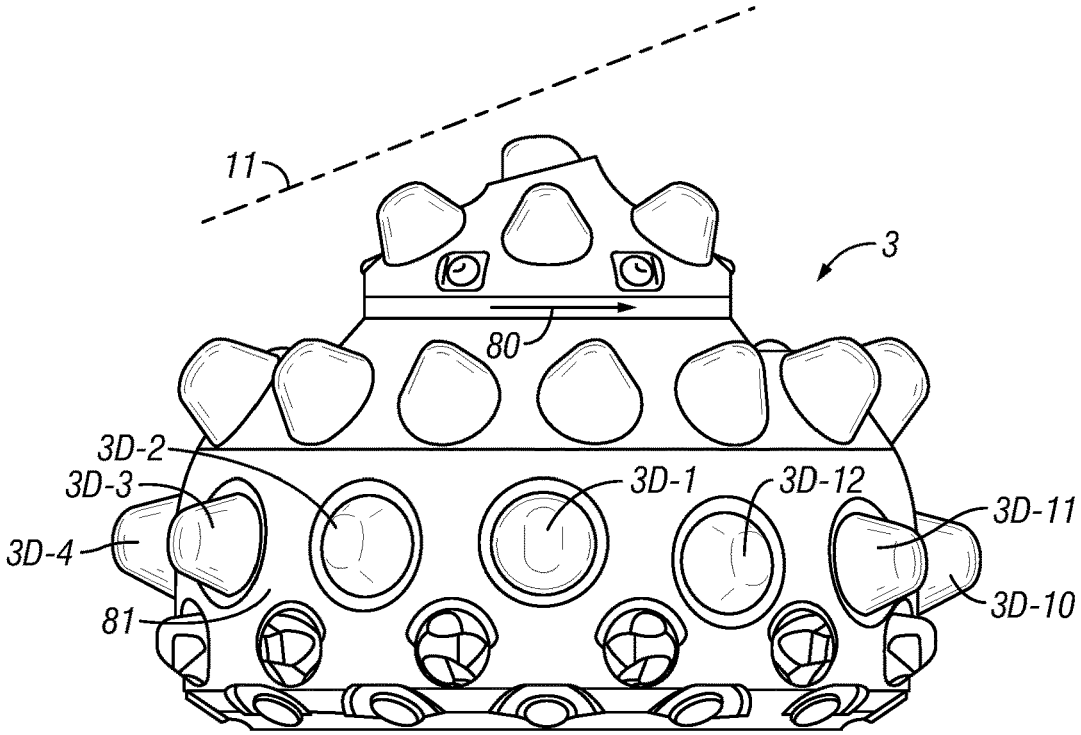

Some or each of the cones of a bit may be the same, or some or each of the cones may be different. The cones 1 and 3 the bit 10 of FIG. 1, for instance, which may include cones different than cone 2, will now be described in reference to FIGS. 17A-18B. In FIGS. 17A and 17B, cone 3 includes backface 40, nose 42, generally frustoconical heel surface 44, and generally conical surface 46. Likewise, cone 3 includes heel inserts 60, gage inserts 61, bottomhole inserts 62 and ridge cutting elements 63, as described herein. Bottomhole cutting elements 62 are arranged in a first row 3A (including a single insert 62), a spaced-apart circumferential row 3B, and another spaced-apart circumferential row 3C. In this embodiment, within each row 3B and 3C, each of the elements may have substantially the same radial position and may have overlapping and aligned cutting profiles and element axes. Between rows 3B and 3C, a circumferential row 3B" may include ridge cutting elements 63. Like cone 2, cone 3 includes a circumferential row 3G of heel inserts 60 spaced apart from a circumferential row 3F of gage inserts 61.

Between gage row 3F and inner row 3C may be a frustoconical region or land 81 upon which are arranged an array 3D of bottomhole cutting elements 62 (e.g., twelve cutting elements, although any number may be used), referenced herein as elements 3D-1 through 3D-12. Rows 3A through 3C may intermesh with rows of bottomhole cutting elements in cones 1 and 2 such that the region 70 may be described as the intermeshed region on cone 3, and the region 72 being the non-intermeshed region. As shown in FIG. 17B, cutting element 3D-1 is positioned closest to bit axis 11 while cutting element 3D-12 is farthest from bit axis 11. Between those cutting elements, elements 3D-2 through 3D-11 are mounted with each being at a different radial position and with each being progressively farther from bit axis 11 forming a spiral array of elements.

Figure 18A:
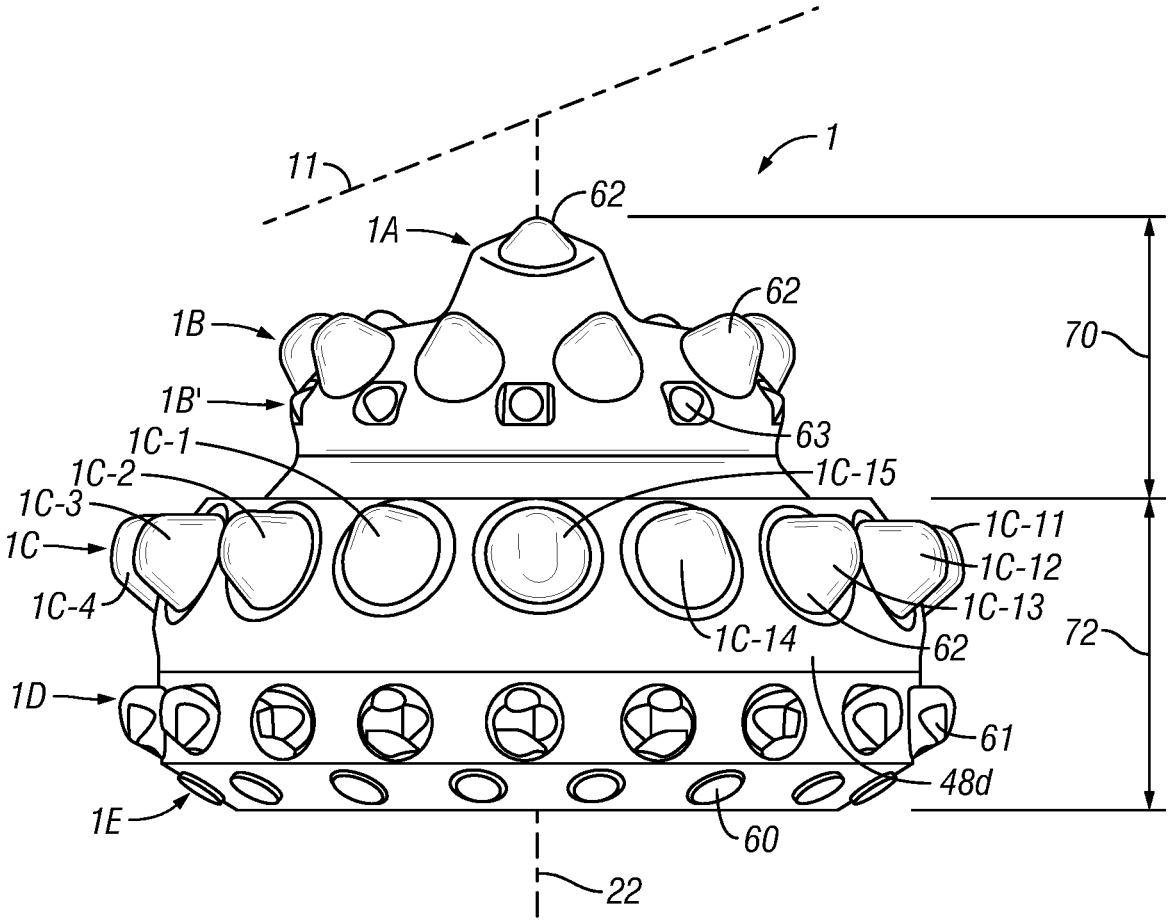
FIGS. 18A and 18B are front and rear elevation views, respectively, of still another embodiment of a cone for the bit of FIGS. 1 and 2.
Figure 18B:
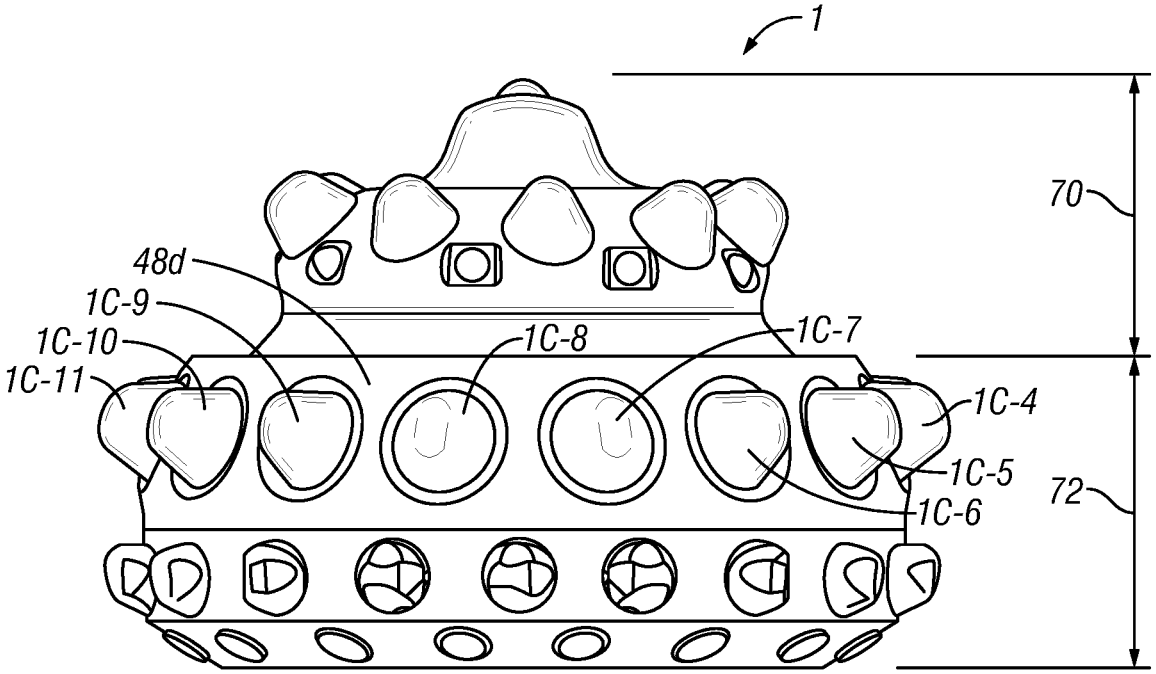

Referring now to FIGS. 18A and 18B, cone 1 includes backface 40, nose 42, generally frustoconical heel surface 44, and generally conical surface 46. Cone 1 also includes heel inserts 60, gage inserts 61, bottomhole inserts 62, and ridge cutting elements 63, as described herein. Bottomhole cutting elements 62 may be arranged in a first row 1A (including a single insert in this embodiment) and a spaced-apart circumferential row 1B. The cutting elements in row 1B may nominally have the same radial position and have overlapping and aligned cutting profiles and element axes. A circumferential row 1B' of ridge cutting elements 63 may be adjacent row 1B and an array 1C. Cone 1 may also include a circumferential row 1E of heel inserts 60, spaced apart from a circumferential row 1D of gage inserts 61.

Between gage row 1D and inner row 1B' is frustoconical region 48*d* upon which array 1C may be arranged, with fifteen bottomhole cutting elements 62, referenced here as elements 1C-1 through 1C-15. Rows 1A and 1B may intermesh with rows of bottomhole cutting elements 62 in cones 2 and 3 such that the region 70 may be described as the intermeshed region on cone 1, and the region 72 being the non-intermeshed region.

The fifteen inner row cutting elements 62 of array 1C may be arranged in multiple (e.g., two) separate spiral arrangements. Referring to FIG. 18A, cutting elements 1C-1 and 1C-15 are closest to the bit axis 11 and are at the same radial position in this example, and thus are redundant cutting elements. In relation to these two cutting elements, cutting elements 1C-2 through 1C-8 are positioned in a spiral, each being progressively farther from bit axis 11. Cutting elements 1C-14 through 1C-8 are likewise positioned progressively farther from bit axis 11 and are positioned in a spiral arrangement, but one that spirals in the opposite direction as the spiral including cutting elements 1C-2 through 1C-8. Thus, the cutting elements of the array 1C are arranged in two spirals (of eight elements each) that spiral in opposite directions. In this fifteen cutting element array, cutting element 1C-8, the cutting element farthest from bit axis 11, is part of each spiral.

It should be understood that any one or more of the various embodiments for array 2B in which the cutting elements are arranged to more evenly distribute the load among cutting elements within the array, may be used on any one or more of cones 1, 2, 3, alone or in combination. For example, one of cones 1, 2, 3 may include two or three different array arrangements on the same cone. For example, the same cone may include an array with an increased cutter count as described in reference to FIGS. 3A and 3B, an array with an uneven spacing between cutting elements as described in reference to FIGS. 7A and 7B, an array with a more leveled profile as described in reference to FIGS. 10 to 12, or some combination of the foregoing. In the same or other embodiments, any one or more of the array arrangements described herein may be used on different cones. For example, cone 1 may include an array with an increased cutter count, cone 2 may include an array with an uneven spacing between cutting elements, and cone 3 may include an array with a more leveled profile.

Figure 19A:
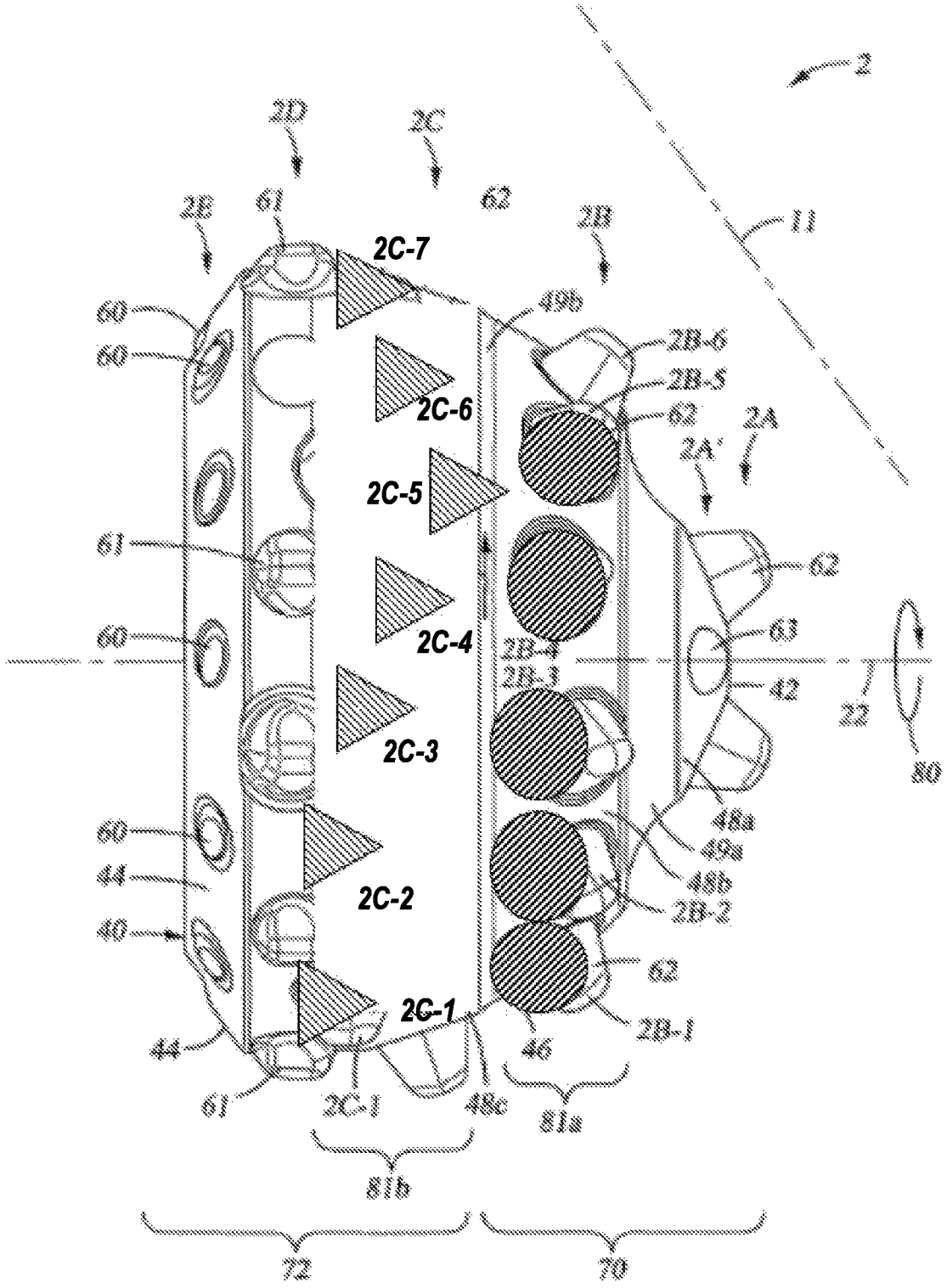
FIGS. 19A and 19B are front and top-down elevation views, respectively, of a cone for the bit of FIGS. 1 and 2.
Figure 19B:
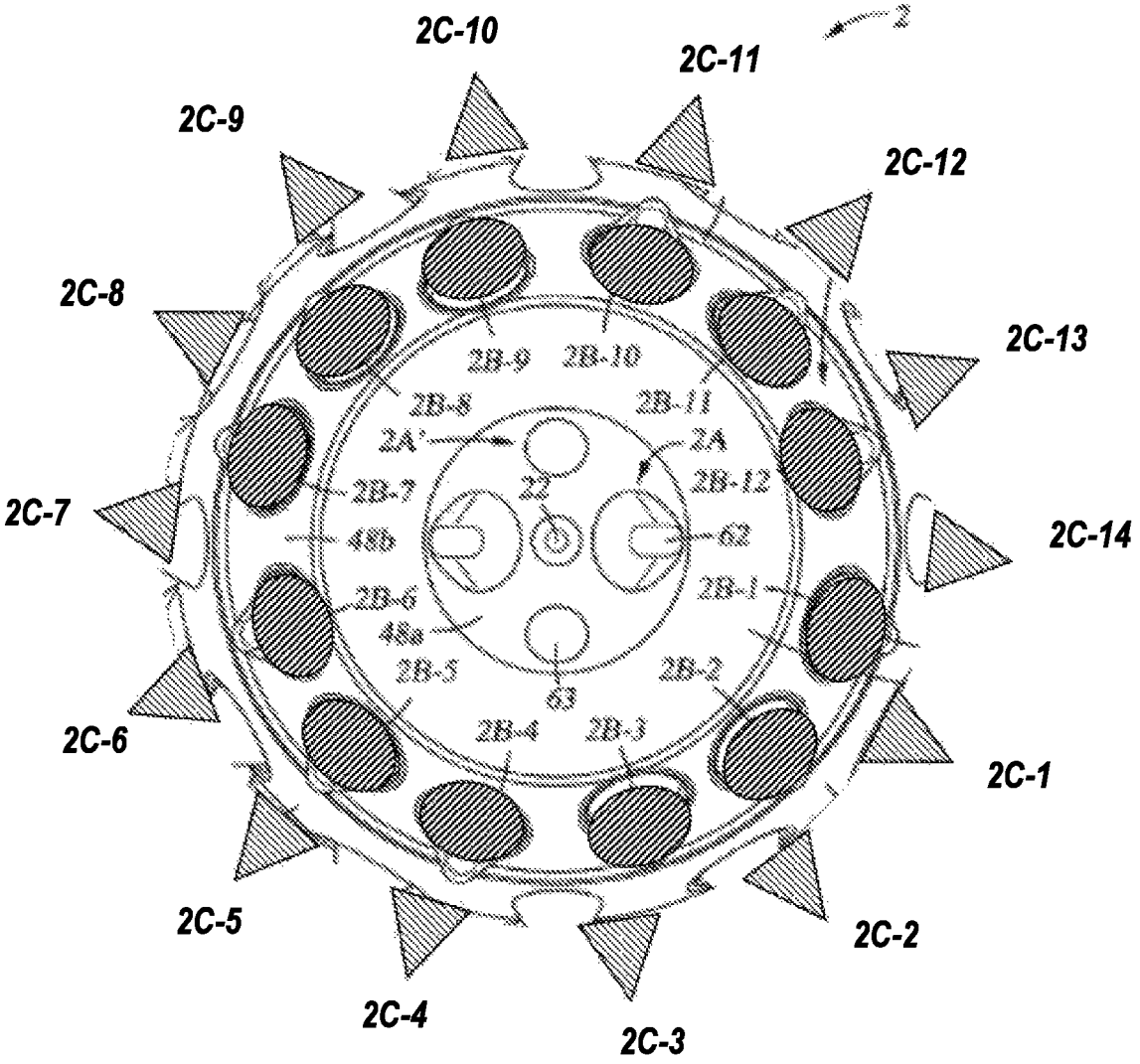

Referring now to FIGS. 19A and 19B, another embodiment of a cone 2 in which a load is more evenly distributed among the cutting elements is described. Cone 2 may include similar or the same features as discussed herein in reference to cones of a drill bit and, as such, a detailed discussion of each feature of cone 2 will be omitted for the sake of conciseness. In this embodiment, however, the cutting elements have been arranged in multiple spiral sets and a sinusoidal set instead of a single spiral. In particular, array 2B includes two spiral sets of elements 2B-1 to 2B-12. Each spiral set includes six cutting elements, the first including cutting elements 2B-1 to 2B-6 and the second including cutting elements 2B-7 to 2B-12. In some embodiments, array 2B includes four radial positions, with six elements (2B-1, 2B-2, 2B-3, 2B-7, 2B-8, 2B-9) located at one radial position, and two cutting elements located at each of the remaining radial positions. In some embodiments, array 2B experiences the greatest loads in the outboard-most radial position, and so the outboard-most radial position has the greatest number of cutting elements in order to spread the greater load over more cutting elements, as discussed herein.

Array 2C includes a sinusoidal arrangement, according to some embodiments of the present disclosure. A sinusoidal arrangement may include cutting elements in radial positions that spiral gradually back and forth between the innermost and outermost radial locations, resembling a sinusoidal curve or plot. For example, array 2C includes 14 cutting elements arranged in four radial positions. Elements 2C-1, 2C-2, 2C-8, and 2C-9 are located in the outermost radial position, elements 2C-3, 2C-6, 2C-10, and 2C-14 in the adjacent radial position, moving in the direction of the nose, 2C-4, 2C-6, 2C-11, and 2C-13 in the next radial position, and 2C-5 and 2C-12 in the inner-most radial position. In some embodiments, array 2C experiences the least load in the inboard-most radial position, and so the number of cutting elements in the inner-most radial position is less than the number of elements at more outboard radial positions.

The bias spacing approach (discussed with respect to FIGS. 7A-8) and levelling approach (discussed with respect to FIGS. 10-14) to achieving more equal loads across individual cutting elements may also be applied over spiral sets or sinusoidal sets as opposed to a single spiral arrangement of cutting elements.

Though the cones illustrated and discussed in this disclosure primarily include two arrays, cones including a single array or more than two arrays incorporating the arrangements of cutting elements and radial positions discussed herein are also within the scope of the present disclosure.

Figure 20A:
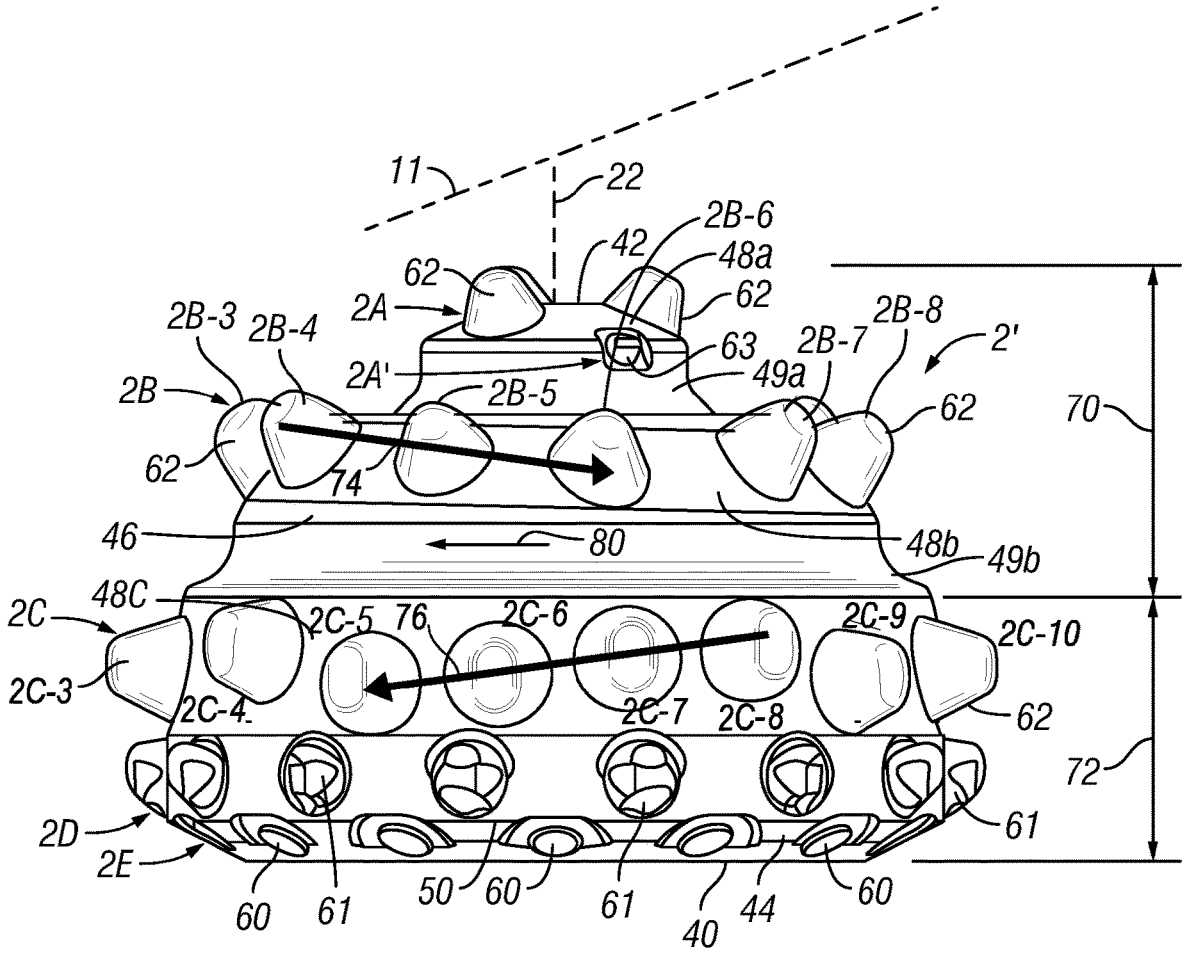
FIGS. 20A and 20B are front and rear elevation views, respectively, of a cone for the bit of FIGS. 1 and 2.
Figure 20B:
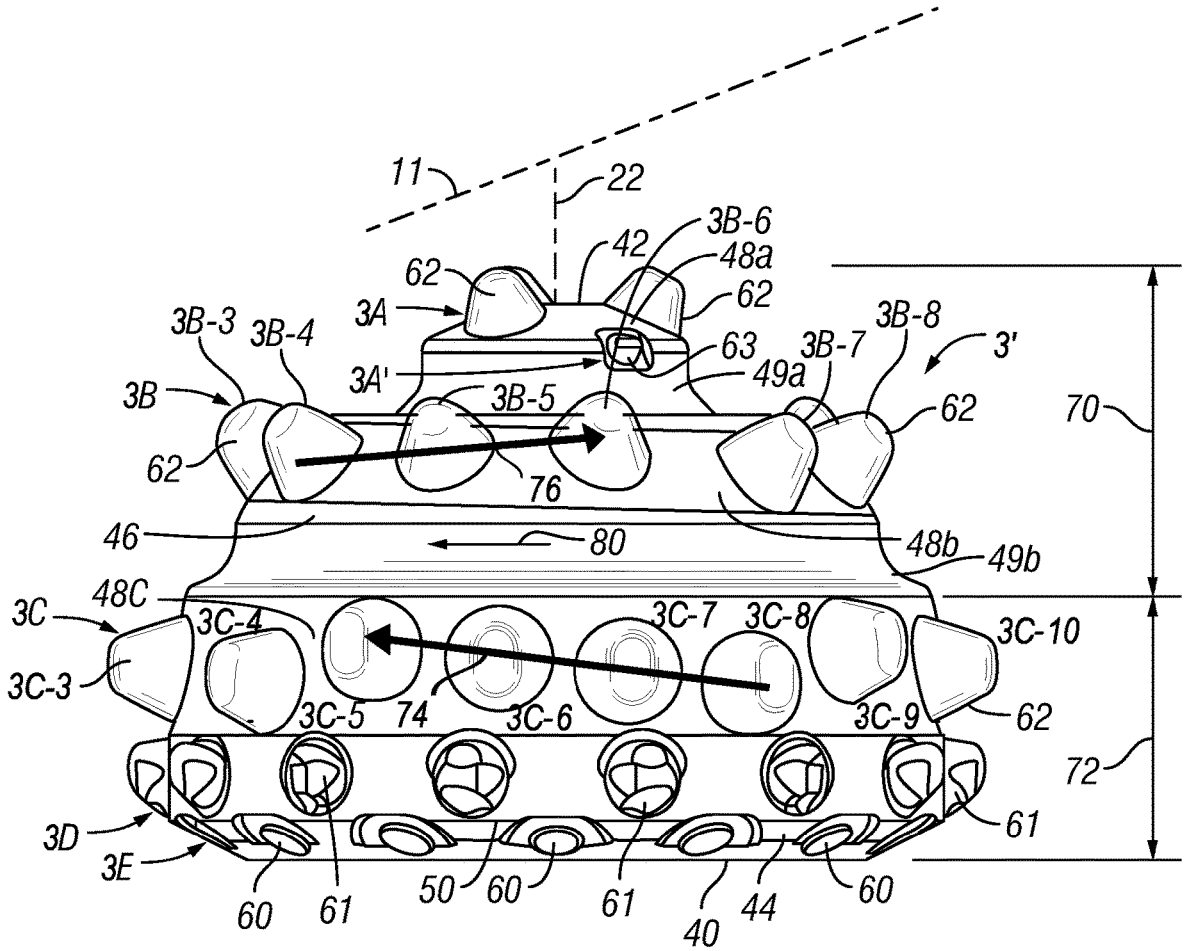

FIGS. 20A and 20B illustrate cutting element arrangements within arrays that may be used to improve ROP, according to embodiments of the present disclosure. A detailed discussion of each feature of cones 2' and 3' is omitted for conciseness, as cones 2' and 3' are similar to, and include features of, cones described herein. Cones 2' and 3' include spiral arrays 2B, 2C, 3B, 3C, each having a left hand or right hand arrangement. For example, cone 2' in FIG. 20A includes array 2B, having a left hand spiral arrangement indicated by left hand arrow 74. Cone 2' also includes array 2C having a right hand spiral arrangement indicated by right hand arrow 76. A left hand spiral arrangement is one where the cutting elements are arranged in one or more spirals that follow a line that, if compared to a thread on a screw, would correspond to a left hand screw. For example, in array 2B, element 2B-4 is positioned close to the nose 42, while elements 2B-5 and 2B-6, located increasingly counter-clockwise (when viewing looking down at nose 42) of element 2B-4, are positioned gradually closer to the backface 40. Element 2B-7 is then in a location closer to nose 42. The spiral set traced by arrow 74 therefore follows the trajectory of a left hand screw thread. Similarly, element 3C-8 is located in the radial position within array 3C closest to nose 42, while elements 3C-7, 3C-6, and 3C-5 are located in positions that get closer to backface 40 with increasing distance in the clockwise direction (viewing looking down at nose 42). The spiral set traced by arrow 76 therefore follows the trajectory of a right hand screw thread. Cone 3' in FIG. 20B includes array 3B, positioned between the nose 42 and array 3C, having a right hand spiral arrangement, and array 3C, positioned between array 3B and the backface 40, having a left hand spiral arrangement.

Figure 21:
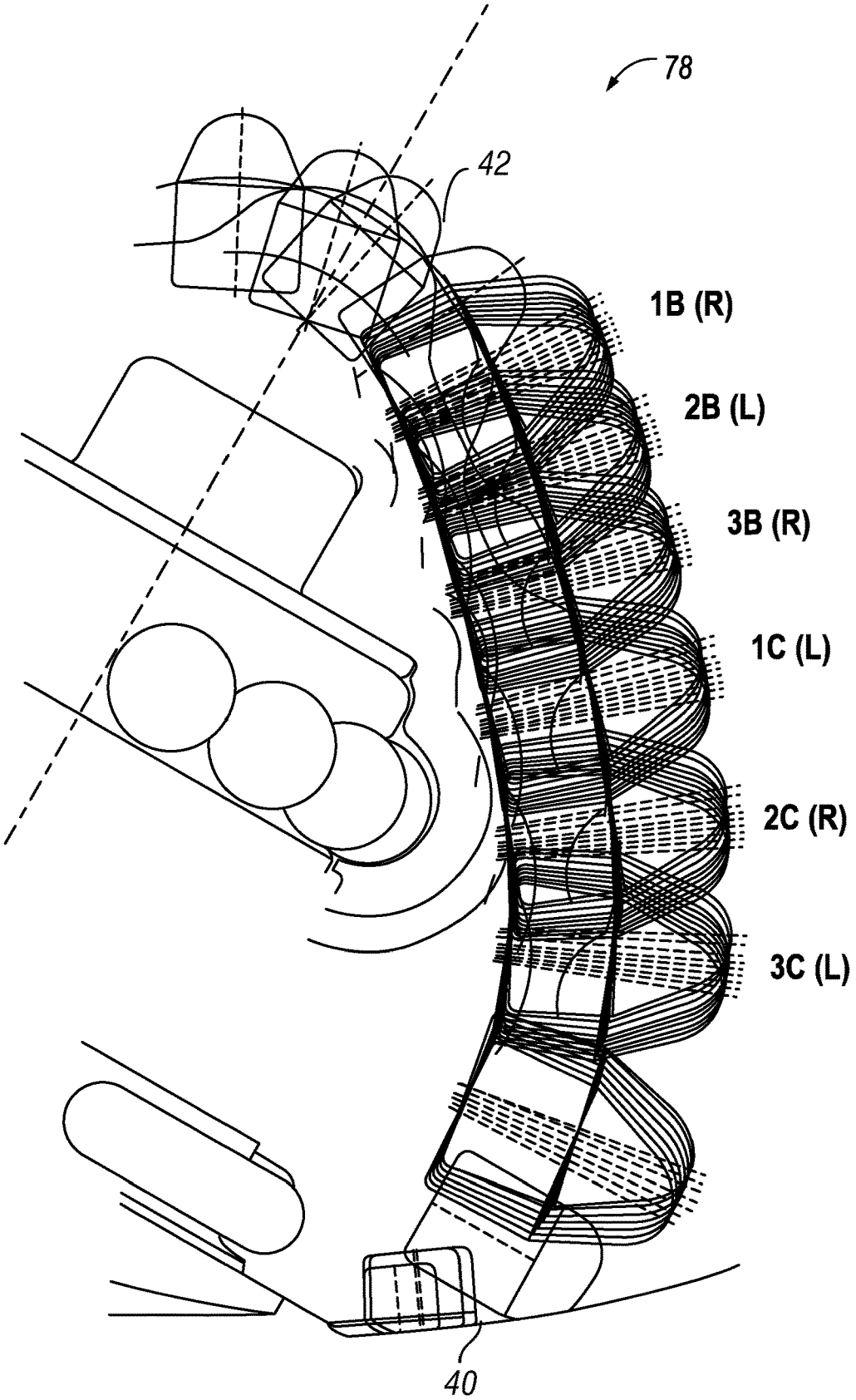
FIG. 21 is a magnified, partial, aggregated profile view showing the cutting paths of certain of the cutting elements in the cone of FIGS. 20A and 20B.

The inventors have found that the impact force or impact load on inserts or cutting elements which are closer to the maximum depth generally take more load or do more work during a drilling operation than cutting elements in the same array which are at positions having a depth farther up the bit axis, and that when a left hand spiral array is combined with a right hand spiral array on a single cone, improved ROP may be achieved. In particular, alternating the handedness of adjacent arrays—as viewed in rotated profile—may improve the bit ROP. FIG. 21 illustrates, in rotated profile, the cutting paths of certain of the cutting elements in the cones shown in FIGS. 20A and 20B. In some embodiments, array 1B of a cone (not illustrated) used with cones 2' and 3', is the closest array to the nose 42, and has a right-hand spiral arrangement. The directionality, or handedness, of each array 2B, 3B, 1B, 1C, 2C, and 3C alternates between left and right as the arrays become closer to the backface 40. The alternating handedness of the spiral arrays contributes to improved ROP and bit performance. It should be understood that different bits may have different numbers of cones or different numbers of arrays on the cones as compared to the embodiment illustrated in FIG. 21, and that less than each cone may have multiple arrays of spiral cutting paths, or may not have alternating left and right spirals.

According to some embodiments, a drill bit for drilling through earthen formations and forming a wellbore includes a bit body having a bit axis and at least a first cone and a second cone mounted on the bit body, each of the first and the second cone having a backface, and a nose opposite the backface. A first array of first cutting elements is mounted to at least one of the first and second cones between the backface and the nose, where the tip of each first cutting element is located in one of a plurality of radial positions. In some embodiments, a radial position is defined by a radial distance from the bit axis and a bottom hole depth relative to the bit axis. In some embodiments, the number of first cutting elements located at a first radial position having a maximum bottom hole depth within the first array is greater than a number of first cutting elements located at a second radial position having a minimum bottom hole depth within the first array. A second array of second cutting elements is mounted to at least one of the first and the second cones between the backface and the nose, where the tip of each second cutting element is located in one of a plurality of radial positions, and where the number of second cutting elements located at a third radial position having a maximum bottom hole depth within the second array is greater than a number of first cutting elements located at a fourth radial position having a minimum bottom hole depth within the second array. In some embodiments, the bit includes a non-intermesh region adjacent to the backface and an intermesh region between the non-intermesh region and the nose, an at least one of the first array or the second array is mounted within the intermesh region. In another embodiment, at least one of the first array of first cutting elements or the second array of second cutting elements are, when viewed in a rotated bottomhole profile, inboard with respect to radial positions on the cone having the maximum bottom hole depth and the cutting elements at the first and third radial positions are farther outboard with respect to the bit axis than the cutting elements at the second and fourth positions. In yet another embodiment, at least three cutting elements are at the same radial position within the first array, and the first array includes at least five radial positions. In another embodiment, a radial spacing between each of the radial positions within the first array or the second array is the same. In another embodiment, a radially-outermost radial position and a next radially inward radial position within the radius of the first array have a first radial spacing, and a radially-innermost radial position and a next radially outward radial position within the radius of the first array have a second radial spacing, and wherein the first radial spacing is less than the second radial spacing. In another embodiment, a number of cutting elements in fifth radial position located between the first radial position and the second radial position is less than the number of cutting elements located at the first radial position and greater than the number of elements located at the second radial position. In some embodiments, a number of cutting elements in a fifth radial position located between the first radial position and the second radial position is equal to the number of cutting elements located at the first radial position. The first array of cutting elements and the second array of cutting elements may be mounted to the first cone. In another embodiment, the first array of cutting elements is mounted to the first cone and the second array of cutting elements is mounted to the second cone.

Additional embodiments of a drill bit for drilling through earthen formations and forming a wellbore include a bit body having a bit axis and a plurality of cones mounted on the bit body, each cone having a backface, a nose opposite the back face and a cone axis of rotation. An array of cutting elements may be mounted between the backface and the nose of at least one of the cones, wherein the cutting element tips are located in radial positions defined by a radial distance from the bit axis and a bottom hole depth relative to the bit axis, where a first spacing between a first radial position within the array having the greatest bottom hole depth and a second radial position adjacent to the first radial position is less than a second spacing between a third radial position within the array having the least bottom hole depth and a fourth radial position adjacent to the third radial position. In some embodiments, the first and second radial positions are within a higher impact load area in the array and the third and fourth radial positions are within a lower impact load area in the array. In some embodiments, the first radial position is the furthest outboard radial position within the array and the third radial position is the furthest inboard radial position within the radius of the array. In some embodiments, the drill bit further includes a third radial spacing between adjacent radial positions that are located between the second radial position and the fourth radial position, wherein the third spacing is equal to the second spacing. In some embodiments, a radial distance between the remaining adjacent cutting elements gradually increases between the first radial position and the third radial position. In some embodiments, the first radial distance is within a range of from 0 to D/(2*(N−1)), where D is the distance from a furthest outboard radial position within the array to a furthest inboard radial position within the array, and N is the number of positions within the array. In some embodiments, each of the cutting elements within the array include a cutting surface, and at least some of the cutting surfaces, when viewed in rotated bottomhole profile, are more level with a horizontal perpendicular to the bit axis than a wellbore profile in the rotated bottomhole profile view of the array. In some embodiments, the array of cutting elements is a first array of cutting elements mounted to the at least one of the cones in a first band, the drill bit further includes a second array of cutting elements mounted to the at least one of the cones in a second band axially spaced apart from the first band, each of the cutting elements of the second array having cutting surfaces with different extension heights such that the cutting surfaces are more level with horizontal than a spline formed through cutting surfaces of cutting elements mounted to each of the other plurality of cones in a rotated profile view.

Further embodiments include a drill bit for drilling through earthen formations and forming a wellbore. The drill bit includes a bit body having a bit axis and a plurality of cones mounted on the bit body, each cone having a backface, a nose opposite the back face and a cone axis of rotation. In some embodiments, an array of cutting elements mounted to at least one of the cones between the backface and the nose. In some embodiments, the cutting elements are in at least two different radial positions, each including a radial distance from the bit axis and a bottom hole depth relative to the bit axis, where the cutting elements include cutting surfaces having cutter axes that, when viewed in rotated bottomhole profile, have a non-uniform spacing, and wherein the spacing between cutter axes of cutter surfaces closer to a horizontal line tangent to a spline of the cutting surfaces in the bottomhole profile is less than the spacing between cutter axes for cutting surfaces farther from the horizontal line. In some embodiments, the cutter surfaces closer to the horizontal line correspond to a cutting element at a furthest radially-outward position within the array and a next inward cutting element, and the cutter surfaces farther from the horizontal line correspond to a cutting element at a furthest radially-inward position within the array and a next outward cutting element. In some embodiments, the cutter surfaces closer to the horizontal line correspond to a cutting element at a furthest inboard position with respect to the bit axis and a next outboard cutting element, and the cutter surfaces farther from the horizontal line correspond to a cutting element at a furthest outboard position with respect to the bit axis and a next inboard cutting element. In some embodiments, a spacing between adjacent cutter axes closer to a bottom of a wellbore within the bottomhole profile is less than a spacing between adjacent cutter axes farther away from the bottom of the wellbore within the bottomhole profile. In some embodiments, at least two of the cutting elements are at a same radial position such that their cutter axes are aligned. In some embodiments, the non-uniform spacing between adjacent cutting elements is within a range of from 0 to D/(2*(N−1)), where D is the distance from the furthest outboard radial position within the array to the furthest inboard radial position within the array, and N is the number of positions within the array. In some embodiments, at least one of the cutting surfaces deviates from the spline, when viewed in rotated bottomhole profile.

According to some embodiments, a drill bit for drilling through earthen formations and forming a wellbore includes a bit body having a bit axis and a plurality of cones mounted on the bit body, each cone having a backface, a nose opposite the back face and a cone axis of rotation. In some embodiments, an array of cutting elements are mounted to at least one of the cones in a band that lies between the backface and the nose, each of the cutting elements are arranged at radial positions within a radius of the array and include cutting surfaces that, when viewed in rotated bottomhole profile, deviate from a spline formed through cutting surfaces of cutting elements mounted to each of the other plurality of cones such that the cutting surfaces of the cutting elements are more level with horizontal than the spline. In some embodiments, at least one of the cutting surfaces within the array of cutting elements that is closer to a bottom of a wellbore within the bottomhole profile has a greater deviation from the spline than another of the cutting surfaces within the array of cutting elements that is farther from the bottom of the wellbore, when viewed in rotated bottomhole profile. In some embodiments, at least one of the cutting surfaces within the array of cutting elements at an outboard position with respect to the bit axis deviates farther from the spline than another of the cutting surfaces within the array of cutting elements at a next inboard position within the array. In some embodiments, at least one of the cutting surfaces within the array of cutting elements at a most radially-outward radial position within the array deviates less from the spline than another of the cutting surfaces within the array of cutting elements at a next radially-inward position within the array. In some embodiments, an angle formed between a slope of the cutting elements within the array and horizontal is less than an angle formed between a slope tangent to the spline and horizontal. In some embodiments, each of the cutting surfaces having cutter axes that, when viewed in rotated bottomhole profile, have a non-uniform spacing. In some embodiments, a difference in an impact load between a cutting element within the array having a highest impact load force and a cutting element within the array having a lowest impact load force is less than 1500 pounds. In some embodiments, the array of cutting elements is a first array of cutting elements mounted to the at least one of the cones in a first band, the drill bit further including a second array of cutting elements mounted to the at least one of the cones in a second band axially spaced apart from the first band, each of the cutting elements of the second array having a cutter axes and a spacing between adjacent cutter axes at outboard radial positions within the second array is less than a spacing between adjacent cutter axes at inboard radial positions within the second array. In some embodiments, a spacing between adjacent cutter axes near a bottom of a wellbore within the bottomhole profile is less than a spacing between adjacent cutter axes farther away from the bottom of the wellbore within the bottomhole profile. In some embodiments, a cutting element at a furthest radially-outward radial position within the array and a cutting element at a next inward radial position within the array are at the same radial position within the array such that their cutter axes are aligned.

In some embodiments, a method for designing a roller cone drill bit including a bit body having a bit axis and a cone coupled to the bit body includes arranging the tips of a plurality of cutting elements in an array mounted on the cone at radial positions defined by a radial distance from the bit axis and a bottom hole depth relative to the bit axis, wherein each cutting element experiences a load and reducing the difference between a maximum load and a minimum load experienced by individual cutting elements in the array by increasing the number of cutting elements located at one or more radial positions having a bottom hole depth greater than an average bottom hole depth of the multiple radial positions within the array. The method may further include reducing the difference between the maximum load and minimum load experienced by individual cutting elements in the array by decreasing the number of cutting elements located at one or more radial positions having a bottom hole depth less than the average bottom hole depth of the combination of each radial positions within the array.

In other embodiments, a method for designing a roller cone drill bit having a bit body with a bit axis and a cone coupled to the bit body includes arranging the tips of a plurality of cutting elements in an array mounted on the cone at radial positions defined by a radial distance from the bit axis and a bottom hole depth relative to the bit axis, wherein each cutting element experiences a load and reducing the difference between the maximum load and minimum load experienced by individual cutting elements in the array by decreasing the spacing between two or more adjacent radial positions having bottom hole depths greater than an average bottom hole depth of the multiple radial positions within the array. The method may further include reducing the difference between the maximum load and minimum load experienced by individual cutting elements in the array by increasing the spacing between two or more adjacent radial positions having a bottom hole depth less than the average bottom hole depth of the multiple radial positions within the array.

According to some embodiments, a method for designing a roller cone drill bit having a bit body with a bit axis and a cone coupled to the bit body includes arranging the tips of a plurality of cutting elements in an array mounted on the cone at radial positions defined by a radial distance from the bit axis and a bottom hole depth relative to the bit axis, wherein each cutting element experiences a load and reducing the difference between the maximum load and minimum load experienced by individual cutting elements in the array by adjusting the bottom hole depth of one or more radial positions.

In some embodiments, a drill bit includes a bit body having a bit axis and a first cone coupled to the bit body. The first cone may include a backface, a nose opposite the backface, a first array of cutting elements mounted to the first cone and located at a radius from the bit axis between the nose and the radius of a third array of cutting elements, wherein the cutting elements in the first array have a right hand spiral arrangement, and a second array of cutting elements mounted to the first cone and located at a radius from the bit axis between the third array and a fourth array, wherein the cutting elements in the second array have a left hand spiral arrangement. The bit may include a second cone mounted to the bit body including a backface, a nose opposite the backface, the third array of cutting elements mounted to the second cone and located at a radius from the bit axis between the radius of the first array and the radius of the second array, wherein the cutting elements in the third array have a left hand spiral arrangement, and the fourth array of cutting elements mounted to the second cone and located at a radius from the bit axis between the radius of the second array and the backface, wherein the cutting elements in the second array have a right hand spiral arrangement. The drill bit may further include a third cone mounted to the bit body, where the third cone includes a backface, a nose opposite the backface, a fifth array of cutting elements mounted to the third cone and located at a radius from the bit axis between the radius of the third array and the radius of the second array, wherein the cutting elements in the first array have a right hand spiral arrangement, and the sixth array of cutting elements mounted to the third cone and located at a radius from the bit axis between the radius of the fourth array and the backface, wherein the cutting elements in the second array have a left hand spiral arrangement.

In some embodiments, a drill bit includes a bit body having a bit axis, a first cone coupled to the bit body and including a first array of cutting elements mounted to the first cone, wherein the cutting elements in the first array have a right hand spiral arrangement, and a second cone coupled to the bit body and including a second array of cutting elements mounted to the second cone, wherein the cutting elements in the second array have a left hand spiral arrangement. In other embodiments, a drill bit includes a bit body having a bit axis and a cone coupled to the bit body. The cone may include a first array of cutting elements mounted to the cone, wherein the cutting elements in the first array have a right hand spiral arrangement and a second array of cutting elements mounted to the cone, wherein the cutting elements in the second array have a left hand spiral arrangement.

In some embodiments, methods for designing drill bits, methods for evaluating cutting structures for drill bits, and methods for optimizing a spiral cutting arrangement for a drill bit are disclosed. Example embodiments also provide a novel method that can be used to calculate scores for spiral cutting arrangements proposed for drill bits.

Some prior art roller cone drill bits have been found to provide poor drilling performance due to problems such as tracking and slipping. Tracking occurs when cutting elements on a drill bit fall into previous impressions formed in the formation by cutting elements at a preceding moment in time during revolution of the drill bit. Slipping is related to tracking and occurs when cutting elements strike a portion of previous impressions and slide into the previous impressions.

In the case of roller cone drill bits, the cones of the bit typically do not exhibit true rolling during drilling due to action on the bottom of the borehole (hereafter referred to as "the bottomhole"), such as slipping. Because cutting elements do not cut effectively when they fall or slide into previous impressions made by other cutting elements, tracking and slipping should be avoided. In particular, tracking is inefficient since there is no fresh rock cut, and thus a waste of energy. Ideally every hit on a bottomhole cuts fresh rock. Additionally, slipping should also be avoided because it can result in uneven wear on the cutting elements which can result in premature failure. It has been found that tracking and slipping often occur due to a less than optimum spacing of cutting elements on the bit. In many cases, by making proper adjustments to the arrangement of cutting elements on a bit, problems such as tracking and slipping can be significantly reduced. This is especially true for cutting elements on a drive row of a cone on a roller cone drill bit because the drive row is the row that generally governs the rotation speed of the cones.

Tracking and slipping may be partially addressed by arranging cutting elements into arrays, where inserts are positioned in three, four, or more different radial locations relative to the bit axis to produce a spiral or staggered arrangement. For an array, successive hits in the same general area of the bottomhole may be by inserts in different radial locations, enhancing bottomhole coverage and reducing the likelihood of an insert hitting exactly the same depression as the previous insert.

Embodiments of the present disclosure relate to a method for scoring a drill bit, a method for evaluating a spiral cutting arrangement for a drill bit, a method for designing a drill bit including a spiral array, and a method for selecting the optimal number of spiral sets in an array within a cutting arrangement for a drill bit. In another aspect, embodiments of the present disclosure provide improved spiral cutting arrangements for a roller cone drill bit.

Figure 26:
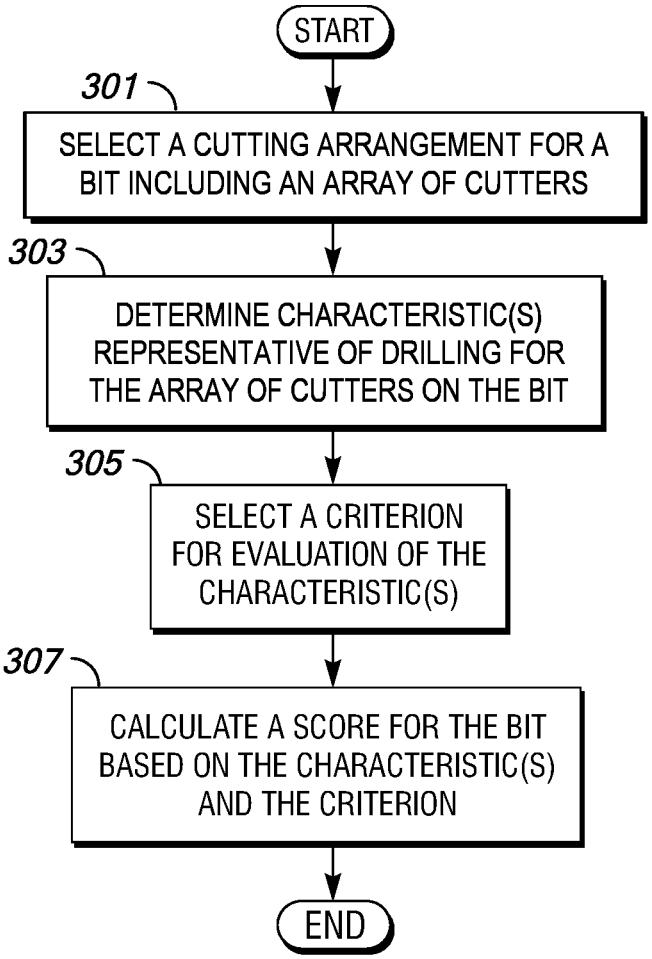
FIG. 26 shows a flow chart of a method in accordance with one embodiment of the present disclosure that may be used to evaluate a quality of a spiral cutting arrangement for a drill bit.

A flow chart showing one example of a method for scoring a drill bit in accordance with the present disclosure is shown in FIG. 26. This method may also be adapted and used to evaluate a cutting arrangement for a drill bit or to optimize a cutting arrangement on a drill bit. The method includes selecting a cutting arrangement for a drill bit including at least one array of cutting elements 301 and determining at least one characteristic representative of drilling for the array of cutters on the drill bit 303. The method also includes selecting a criterion for evaluating the at least one characteristic 305, and calculating a score for the arrangement based on the at least one characteristic and the criterion 307.

In one or more embodiments, the method may additionally include adjusting at least one parameter of the cutting arrangement, repeating the determining of the at least one characteristic, but this time for the adjusted arrangement, and calculating a score for the adjusted arrangement. Cutting arrangement parameters may include, for example, the total number of inserts in an array, the number of spiral sets in an array, and the pitch (axial spacing) between each individual insert. These additional steps can be repeated a selected number of times to obtain a plurality of scores corresponding to a plurality of different arrangements. A preferred arrangement for the drill bit can then be selected from the plurality of different arrangements based on a comparison of the scores for the different arrangements. Preferably, the arrangement having the most favorable score or a combination of a favorable score and more favorable additional characteristics (i.e., more favorable arrangement characteristics, more favorable drilling characteristics, etc.) is selected as the arrangement for the drill bit. More favorable arrangement characteristics may include things such as a more preferable number of spiral sets in an array. More favorable drilling characteristics may include a higher rate of penetration, a more stable dynamic response during drilling, etc.

Examples related to this aspect of the present disclosure are further developed below. In the examples below, the selected characteristic representative of drilling is the bottomhole pattern produced by the selected cutting arrangement. The selected criterion for evaluating the cutting element arrangement is a preferred bottomhole pattern. Those skilled in the art will appreciate that in view of the above description and the examples below, other characteristics and criterion may be selected and used for other embodiments of the present disclosure. For example, the selected criterion may be a preferred value for a drilling parameter, such as a preferred rate of penetration, weight on bit, axial force response, lateral vibration response, or other characteristic representative of drilling that can be adjusted or altered by altering a parameter of a spiral cutting arrangement. Other parameters may include, for example, the radial width of the array, the spacing between spiral sets, the spacing within spiral sets, the spacing between radial locations of a spiral array, etc.

For one or more embodiments of the present disclosure, methods, such as the methods disclosed in U.S. Pat. Nos. 6,516,293 and 6,785,641, which are assigned to the assignee of the present application and incorporated herein by reference, may be used in determining the characteristic representative of drilling for the drill bit, or a drilling tool assembly including the drill bit, having the selected cutting arrangement. In addition, for one or more embodiments of the present disclosure, methods such as those disclosed in U.S. Pat. Nos. 7,234,549 and 7,292,967, which are assigned to the assignee of the present disclosure and incorporated herein by reference, may be used in calculating a score for a cutting arrangement.

The examples developed in detail below are described with reference to a roller cone drill bit, similar to the one shown in FIG. 1. However, those skilled in the art will appreciate that in view of this disclosure, similar methods may be developed for fixed cutter bits, which do not depart from the spirit of the present disclosure.

Figure 22A:
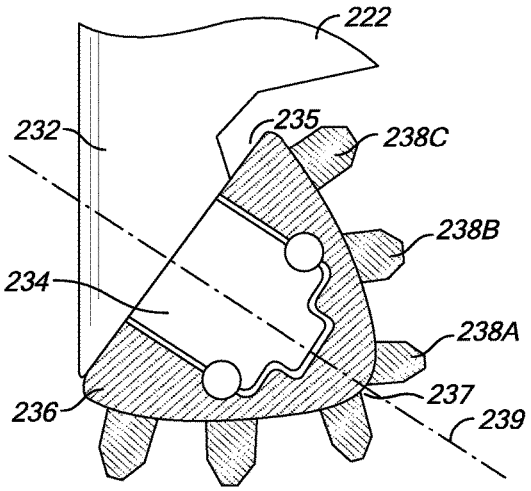
FIG. 22A shows a partial cross-sectional view of one leg of a roller cone drill bit with a roller cone mounted thereon.

A partial cross section view of one leg of a roller cone drill bit is shown in FIG. 22A. The leg 232 extends downward from the main portion of the bit body 222 and includes a bearing shaft pin 234 which extends downward and inwardly with respect to the bit body 222. The roller cone 236 is rotatably mounted on the bearing shaft pin 234. Roller cone 236 includes a nose 237 and a heel 235. The cutting elements 238 disposed on the conical surface of the cone 236 may be arranged in rows or arrays 238A-C that are axially spaced apart with respect to the cone axis 239. Typically, each of the rows or arrays of cutting elements 238 on one cone are axially offset from rows or arrays of cutting elements arranged on the other cones (not shown) to provide an intermeshing of cutting elements between the cones. Intermeshing cutting element arrangements are desired to permit high insert protrusion to achieve competitive rates of penetration while preserving the longevity of the bit. Though three rows/arrays 238A-C are illustrated in FIG. 22A, cutting arrangements may include any number of rows and arrays of cutting elements. For example, a single array may span the entire cone from nose 237 to heel 235.

A row of cutting elements includes a number of elements each having the same radial location, but located at different circumferential positions relative to one another. A spiral array of cutting elements includes elements located at a number of different radial locations within the radial width of the array, and at different circumferential positions relative to one another. An array may include fewer radial locations than the number of cutting elements in the array, in which case the cutting elements are arranged into spiral sets, or the array may include a different radial location for each cutting element in the array (i.e., one spiral set). The radial locations in a spiral set generally result in overlapping cutting element profiles, when viewed in a rotated projection.

Figure 22B:
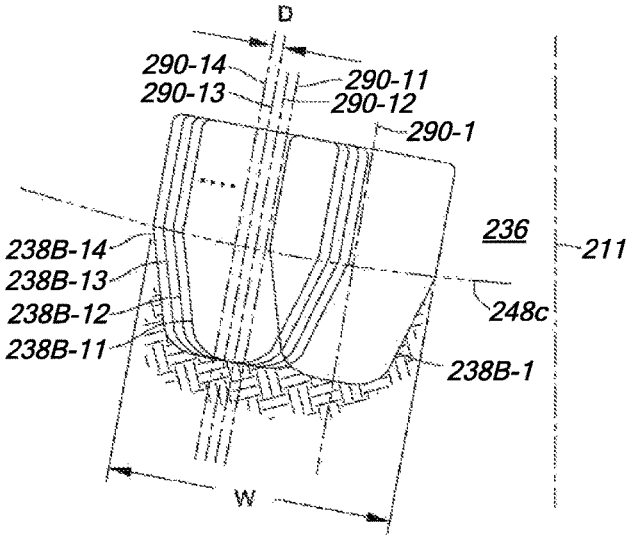
FIG. 22B shows a rotated profile view of a spiral array cutting element arrangement.

FIG. 22B illustrates a rotated profile view of the array of cutting elements 238B. Each cutting element 238 of array 238B is disposed at a different radial location, which is the distance from the bit axis 211, measured along a line perpendicular to the bit axis to the point at which the cutter axis 290 intersects the tip of the cutting element. For purposes of illustration, cutting elements in array 238B are labelled 238B-1 through 238B-14, with the understanding that 238B-2 through 238B-10 have been omitted for clarity. Cutting elements 238B-1 through 238B-14 are disposed on a generally frustoconical-shaped region or band 248*c* which encircles the cone 236, and is located between rows 238A and 238C (shown in FIG. 22A). In this embodiment, cutting element 238B-1 is located in the radial location within array 238B that is closest to the nose 237 of the cone, while 238B-14 is positioned in the radial location closest to the heel 35 of the cone. This array 238B of cutting elements, where a series of adjacent elements are positioned progressively further (or closer) to the bit axis, is generally described herein as a spiral arrangement or spiral array.

The cutter element axis 290-1 through 290-14 of each of the cutter elements 238B-1 through 238B-14 is spaced a uniform distance D from the element axis of the immediately adjacent cutter elements across the width W of the array 238B. In another embodiment, the distance between adjacent cutting elements, or adjacent radial locations, is not uniform across the width W of the array. The overlapping and relatively close positioning, in rotated profile, of the cutter elements 238 in array 238B prevent ridges from forming on the bottomhole surface.

For one or more embodiments of the present disclosure, spiral and staggered cutter arrangements, such as those disclosed in U.S. Pat. Nos. 7,370,711 and 7,686,104, which are assigned to the assignee of the present disclosure and incorporated herein by reference, may be used in association with embodiments of the present disclosure.

In general, cutting element arrangements for drill bits can be generally defined by the location of each cutting element in the arrangement. The location of each cutting element may be expressed with respect to a bit coordinate system or a cone coordinate system, depending on the type of drill bit being considered. In some cases, such as for drill bits having cutting elements generally arranged in rows and arrays, the cutting element arrangements may be even more simply defined by the "pitch" (or spacing) between cutting elements in a row on the face of a roller cone or bit body and the radial location of the row on the cone or bit (as described above).

Those skilled in the art will appreciate that, for clarity, simplified examples are presented herein and described below. In these examples, the cutting elements are described as generally arranged in one or more spiral sets. It should be understood that the present disclosure is not limited to these simplified arrangements. Rather, other embodiments of the present disclosure may be adapted and used for other arrangements, such as staggered arrays, or any array-based arrangement including a number of different radial locations within a radial width of a cone, or an array encompassing the entire cone.

Figure 23:
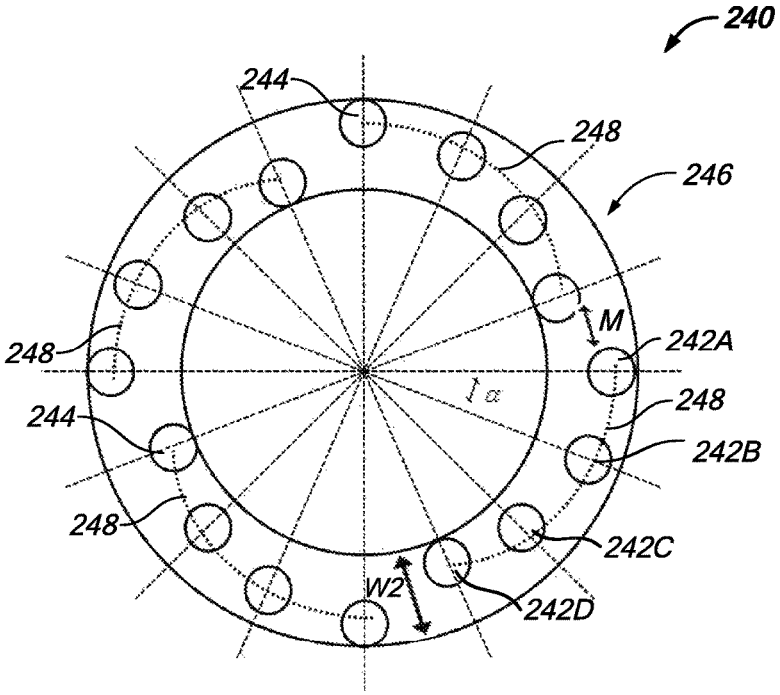
FIG. 23 shows a schematic layout illustrating a spiral cutting element arrangement for a row on a roller cone of a drill bit.

Referring to FIG. 23, one example of a cutting element arrangement 240 proposed for an array 246 of a roller cone of a roller cone drill bit is shown. The arrangement includes sixteen cutting elements 244. In this case, cutting elements 244 are spaced apart and arranged in four spiral sets 248 about the conical surface of the roller cone. The amount of spacing between each pair of adjacent cutting elements 244 is defined in terms of a pitch angle, $\alpha i$. This type of spacing arrangement for a row of cutting elements on a roller cone of a roller cone drill bit is often referred to as a "spacing pattern" or a "pitch pattern" for a row.

Each spiral set 248 includes four radial locations 242A-D, optionally spread out evenly over the width W of array 246. Array 246 has a median radial location M and a width W2, which, among other bit design factors, may affect how many inserts may be included in the array. Median radial location M may be, in an embodiment, half of the distance between the innermost radial location in the array 246 and the outermost radial location in the array 246. While four spiral sets 248 of four cutting elements 244 are shown, other cutting arrangements for an array having the same dimensions as array 246 may include a different number of spiral sets or a different number of total inserts in the array. For example, two spiral sets of eight cutting elements, or one spiral set of sixteen. Another possible arrangement may include three spiral sets of five each. Yet another arrangement may include three spiral sets where two sets each include five cutting elements and one set includes six elements. In general, the number of spiral sets in an array can vary from a single set to the total number of inserts in the entire array divided over three or more radial locations.

Figure 24:
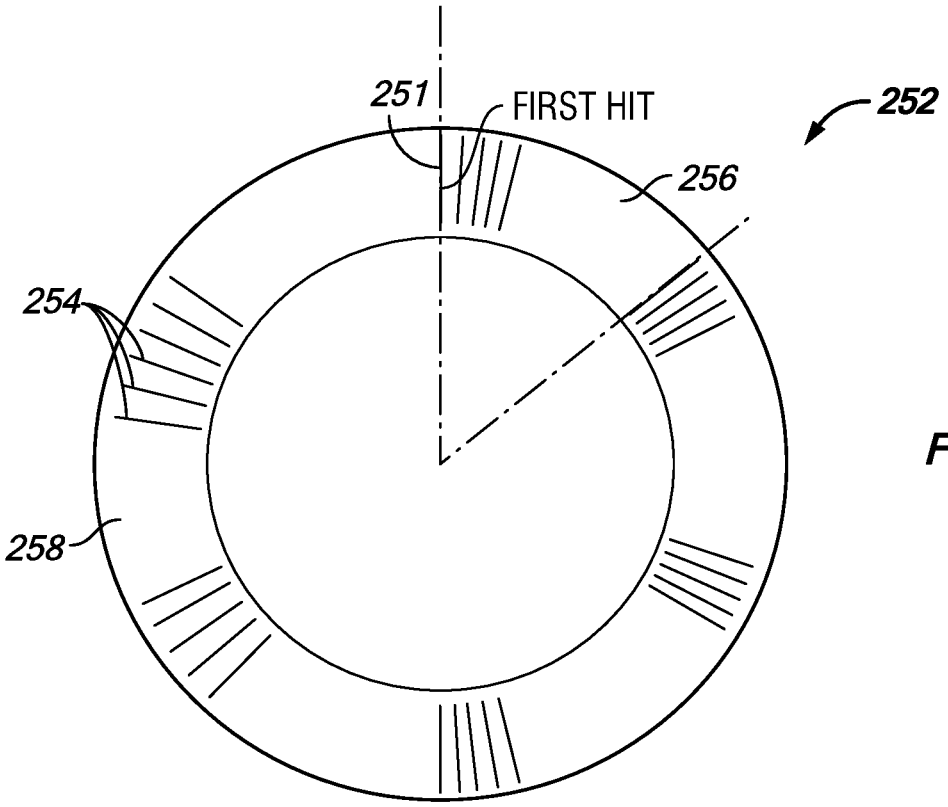
FIG. 24 shows a schematic layout illustrating a bottomhole hit pattern made by a cutting element arrangement for a row of a roller cone of a drill bit during a number of revolutions of the bit.

One example of a pattern of impressions made on a hole bottom by cutting elements in an array on a roller cone of a roller cone drill bit (such as array 246 in FIG. 23) is shown in FIG. 24. In this example, each impression made by a cutting element that contacted the bottomhole during the rotation of the bit is referred to as a "hit." Although the actual impression made by a cutting element on a roller cone drill bit is more of an area of scrape and impact often resulting in the formation of a crater, in the example shown and discussed below, each impression will be simply represented by a hit centered on a point located on the line shown in FIG. 24. The location of each hit on the bottomhole will be referred to as a "bottomhole hit location." The collection of hits made on the bottomhole during a selected number of revolutions of the bit will be referred to as a "bottomhole hit pattern."

The bottomhole hit pattern 252 shown in FIG. 24 includes a number of hits 254 made on the bottomhole 256 by all or a subset of the cutting elements in one array on a roller cone of a roller cone drill bit (not shown) during a selected number of revolutions of the bit on the bottomhole 256. Most of the hits 254 in this example occurred in close proximity to other hits made which resulted in a bottomhole hit pattern 252 with wide gaps 258 of uncut formation separating clustered hits on the bottomhole 256.

The bottomhole hit pattern shown in FIG. 24 is typically considered undesirable because the hits occur in close proximity to previous hits with wide gaps of uncut formation remaining. This type of pattern typically signifies a high likelihood of tracking and slipping during drilling. This bottomhole hit pattern may also indicate a poor use of hits when the crater sizes corresponding to each hit are larger than the distances between the hits.

Figure 25:
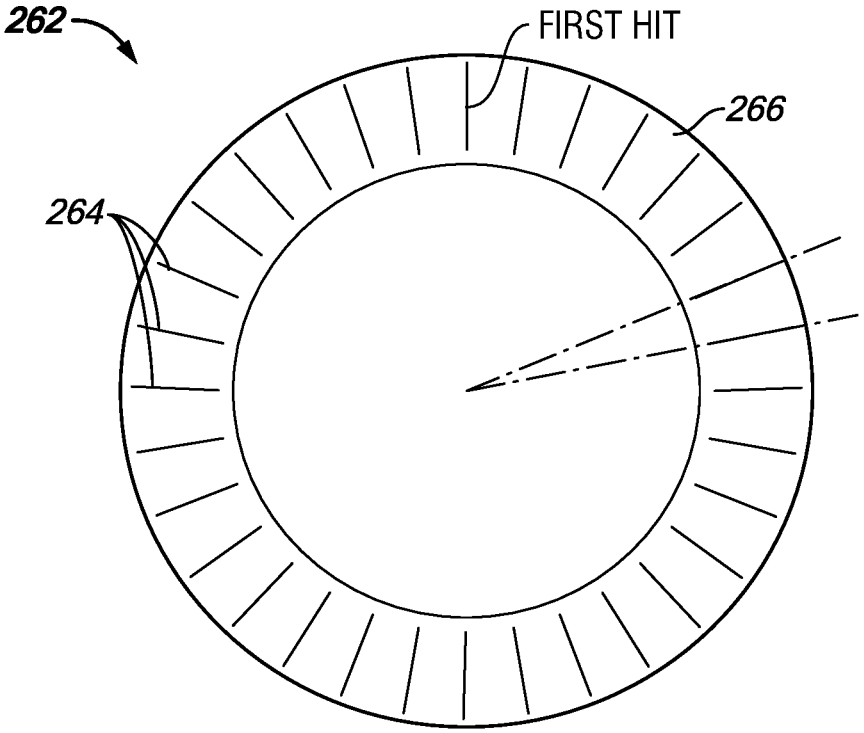
FIG. 25 shows a schematic layout illustrating a preferred bottomhole hit pattern in comparison to the bottomhole hit pattern shown in FIG. 5.

To minimize a potential for tracking and slipping and/or to improve a cutting efficiency of a cutting arrangement, an arrangement may be desired that results in a more even distribution of hits on the bottomhole during a selected number of revolutions of the drill bit. For example, a bottomhole hit pattern 262 as shown in FIG. 25 may be considered more preferable than the bottomhole hit pattern shown in FIG. 24 because this bottomhole hit pattern 262 includes a plurality of hits 264 that are substantially evenly spaced about the section of the bottomhole 266 cut by the cutting arrangement.

Figure 27:
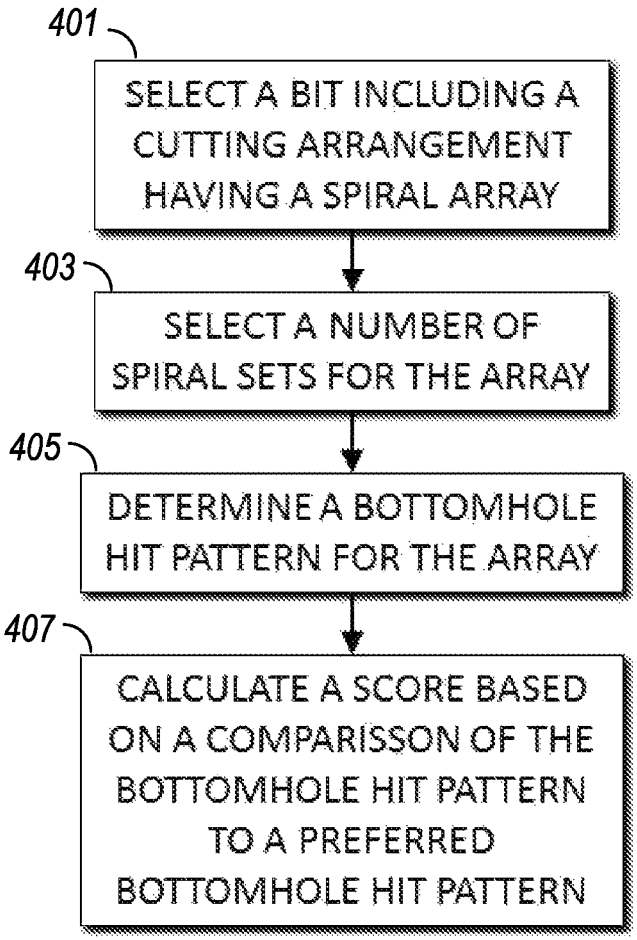
FIG. 27 shows a flow chart of a method in accordance with one embodiment of the present disclosure that may be used to evaluate a quality of a cutting arrangement for a drill bit.

Referring to FIG. 27, in accordance with the aspect of the present disclosure shown in FIG. 26, in one or more embodiments, a method for evaluating a cutting arrangement for a drill bit includes: selecting a design for a drill bit having a cutting arrangement including a spiral array 401; selecting a number of spiral sets for the array 403, determining a bottomhole hit pattern for the array including the selected number of spiral sets 405; and calculating a score for the arrangement 407. For example, the score may be calculated by comparing the bottomhole hit pattern (such as that shown in FIG. 24) to a desired bottomhole hit pattern (such as that shown in FIG. 25). In this embodiment, determining the characteristic representative of drilling (303 in FIG. 26) can be carried out by numerically calculating (generating) a bottomhole hit pattern, and the criterion selected for evaluating this characteristic (305 in FIG. 26) is the percentage of bottomhole coverage. As such, the score for the arrangement is calculated based on a comparison of the bottomhole hit pattern (such as that shown in FIG. 24) to a preferred hit pattern (such as that shown in FIG. 25). In an embodiment, a bottomhole hit pattern similar to the preferred bottomhole hit pattern indicates increased bottomhole coverage as compared to a bottomhole hit pattern that is less similar to the preferred hit pattern.

In one embodiment, the bottomhole pattern may be determined based on the hits for each individual cutting element in the array. In another embodiment, a single radial location is selected so that one insert from each spiral set is modeled as a representation of the entire spiral set.

Figure 28B:
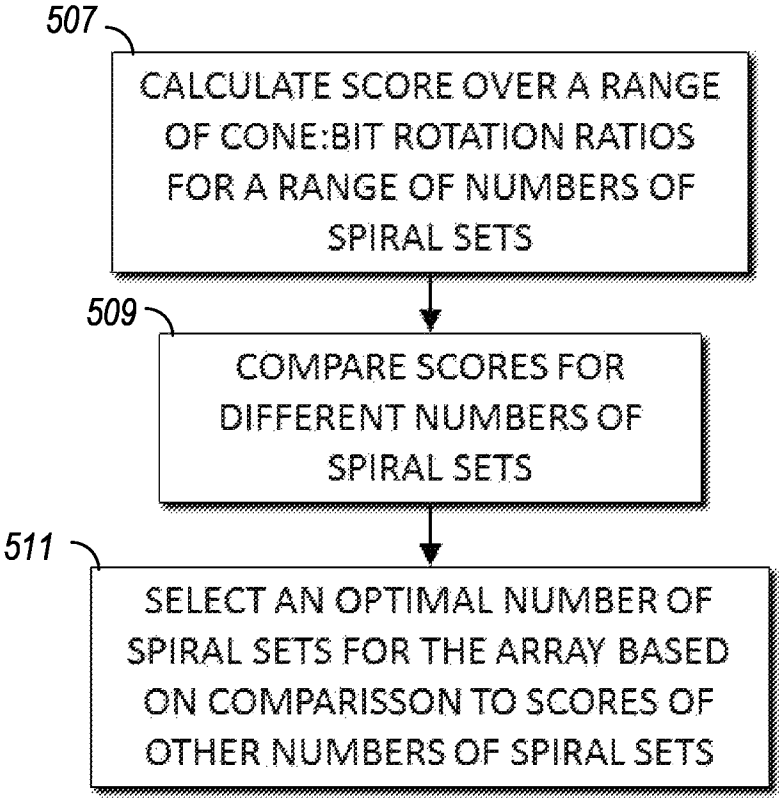
FIG. 28B shows a flow chart of a method in accordance with one embodiment of the present disclosure that may be used to select an optimal number of spiral sets for a spiral cutting element arrangement in an array of a roller cone of a drill bit.
Figure 28A:
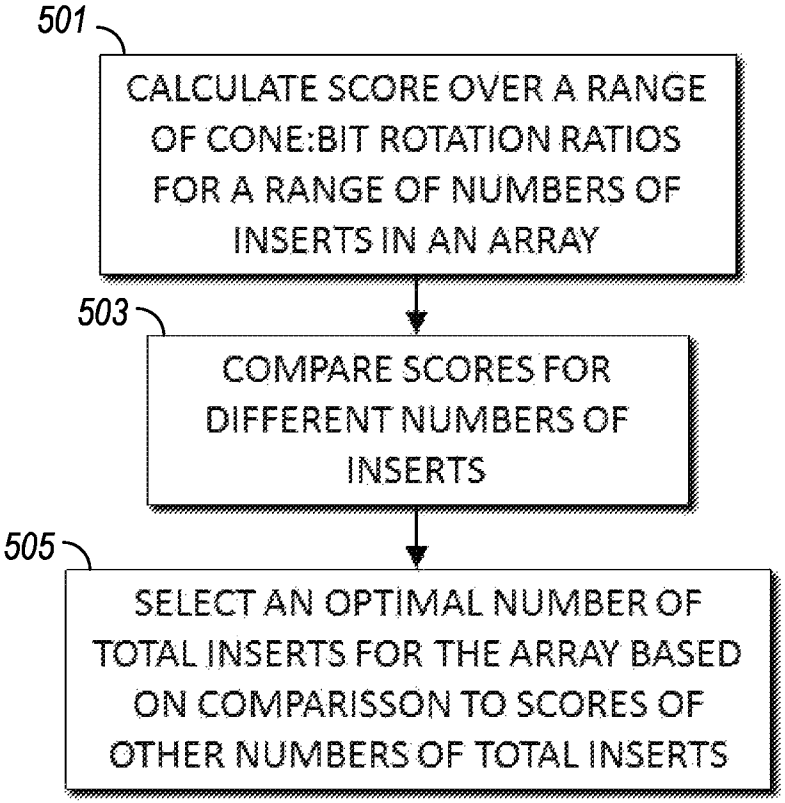
FIG. 28A shows a flow chart of a method in accordance with one embodiment of the present disclosure that may be used to select an optimal number of inserts for a spiral array cutting element arrangement of a roller cone of a drill bit.

The score calculated in the method of FIG. 27 may be used to determine the preferred total number of cutting elements in an array (FIG. 28A), and/or the number of spiral sets in a cutting element array of a bit design (FIG. 28B). These examples are simplified examples specifically configured for selecting the number of cutting elements and the number of spiral sets of cutting elements to be used in a particular array portion of a cutting arrangement on a roller cone of a roller cone drill bit. Referring to FIG. 28A, a score may be calculated for each of a range of a total number of cutting elements in an array over a range of cone to bit rotation ratios 501. Each of scores calculated for each number of cutting elements may be compared 503. Then, the number of cutting elements having the score closest to a desired score may be selected for a bit design 505. While it may seem logical that an maximum possible number of cutting elements in an array would increase bottom hole coverage and drilling efficiency, the inventors have noted that—in some embodiments—if loads are sufficiently balanced across cutting elements, a number of cutting elements less than the maximum possible for the dimensions of an array may lead to higher bit ROP, as the balanced loads are concentrated on fewer cutting elements, resulting in an overall more aggressive cutting structure.

Once the total number of cutting elements has been determined via the method in FIG. 28A—or selected via some other method—the cutting elements may be arranged into an optimal number of spiral sets. Referring to FIG. 28B scores may be calculated over a range of cone to bit rotation ratios (or cone to bit speed ratios) for a range of spiral set numbers 507. The scores for different numbers of spiral sets may be compared at a target cone to bit rotation ratio 509. An optimal, or preferred, number of spiral sets may then be selected based on the comparison of the different scores for each potential number of spiral sets in the array 511. It is to be understood that each of the methods illustrated in FIGS. 28A and 28B may be used either independently or together for a particular bit design. Further, the methods of FIGS. 28A and 28B may include manufacturing a bit having the optimal number of total inserts for an array, the optimal number of spiral sets for an array, or both.

Figure 29:
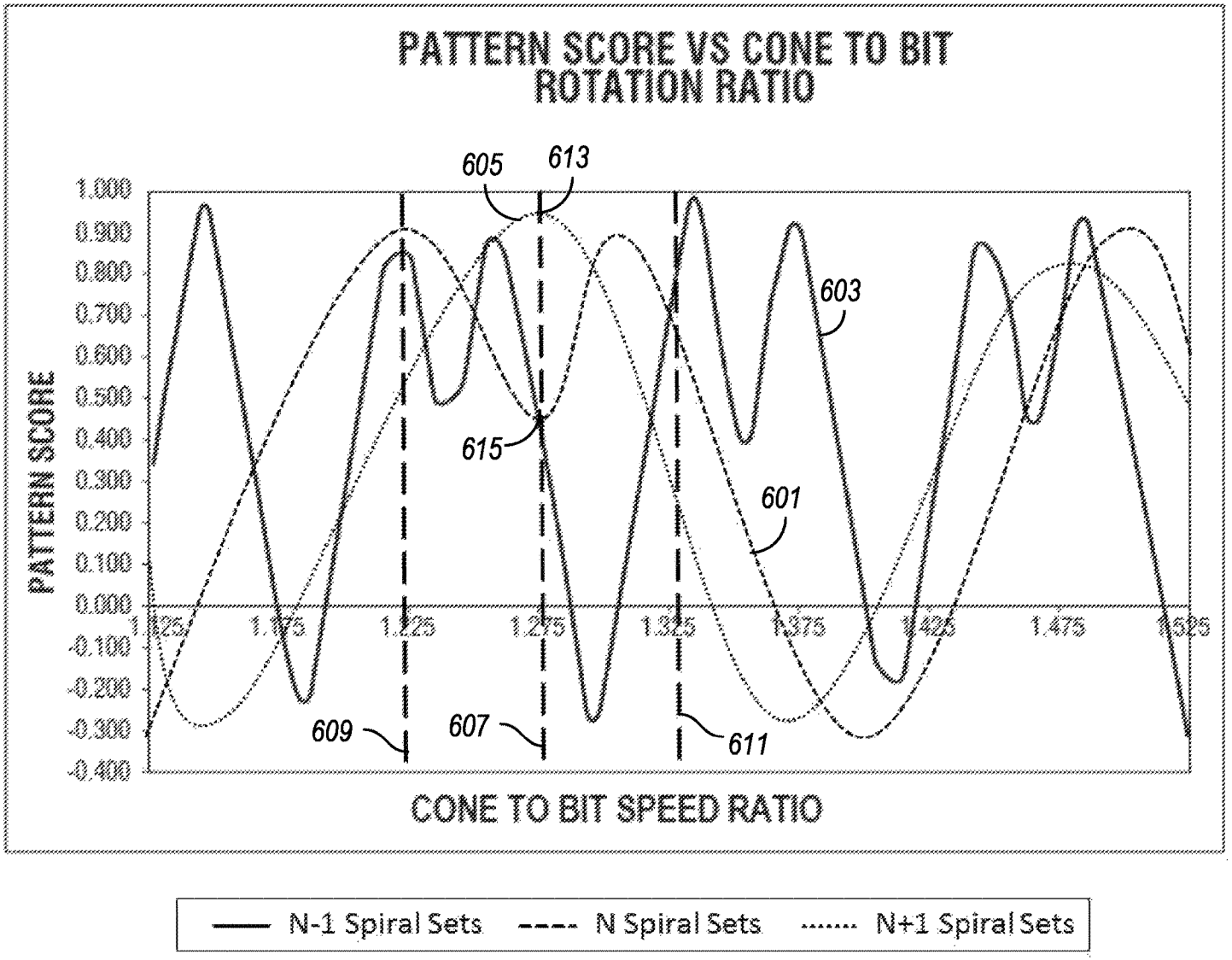
FIG. 29 shows one example of a plurality of score curves, each generated for a different spiral cutting element arrangement for an array of a roller cone drill bit.

FIG. 29 illustrates a plot of cutter pattern scores over a range of cone to bit rotation ratios, according to an embodiment of the present disclosure. Scores are plotted for arrays including N−1 spiral sets 603, N spiral sets 601, and N+1 spiral sets 605. The target cone to bit rotation ratio 607, along as the minimum ratio 609 and maximum ratio 611 are also indicated. One of ordinary skill in the art will understand in view of the present disclosure that the range of cone to bit rotation ratios illustrated in FIG. 29 is only illustrative. Indeed, target ratio 607, minimum ratio 609, and maximum ratio 611 may have different values from those illustrated, and will depend on the particulars of the bit design. Several approaches may be used to select a number of spiral sets for an array based on a pattern score. The set number having the highest score at the target cone to bit rotation ratio may be selected. In this case, N+1 spiral sets 605 has the highest score 613 at the target cone to bit rotation ratio 607, while N spiral sets 601 and N−1 spiral sets have the lowest score 615. The number of spiral sets may also be selected based on the maximum score over the range of cone to bit rotation ratios from the minimum ratio 609 to the maximum ratio 611. This may be determined by identifying the score curve having the maximum area under the curve; in this case, N spiral sets 601. In addition, the number of spiral sets may be selected based on the shape or trend of the curve. For example, while N+1 spiral sets 605 has a higher score at the target cone to bit rotation ratio 607, the score falls off steeply in both directions toward minimum ratio 609 and maximum ratio 611, while N spiral sets 601 generally increase in the direction of minimum ratio 609 and maximum ratio 611. In cases where the cone to bit rotation ratio may be expected to vary within minimum ratio 609 and maximum ratio 611, spiral set N may be selected due to the increased scores within the ratio range. However, if the variance is expected to be tighter around the target cone to bit speed ratio for a particular design or application, then N+1 spiral sets may be selected.

Figure 30:
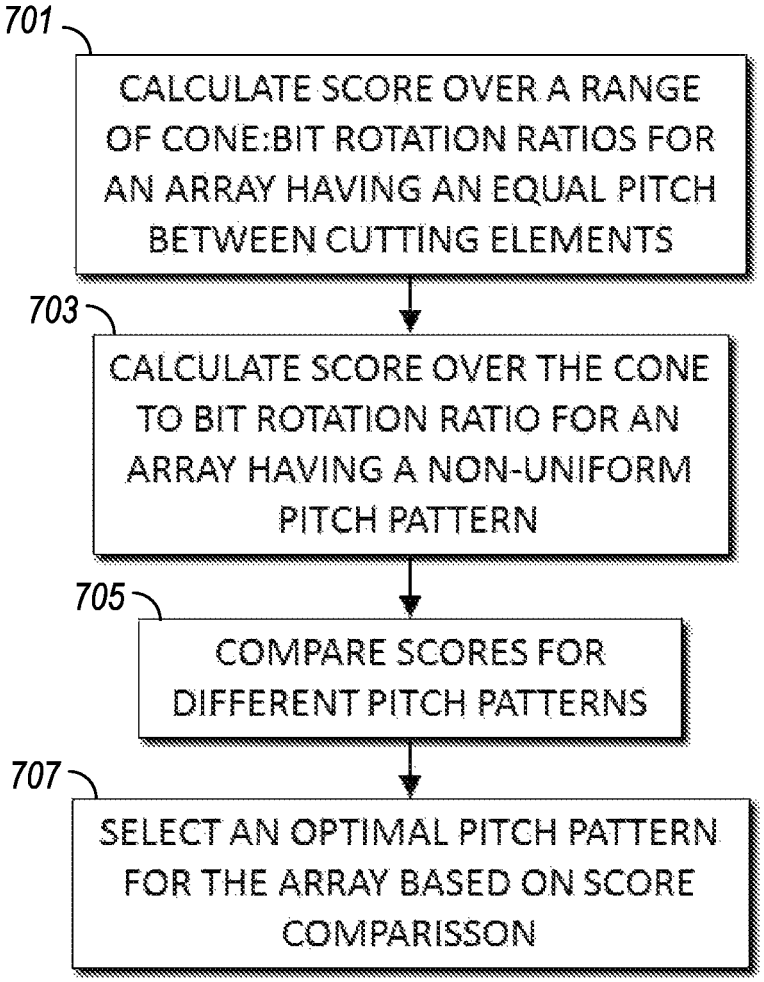
FIG. 30 shows a flow chart of a method in accordance with one embodiment of the present disclosure that may be used to select optimal pitches, or angular spacings, between adjacent cutting elements in a spiral array arrangement of a roller cone of a drill bit.
Figure 31:
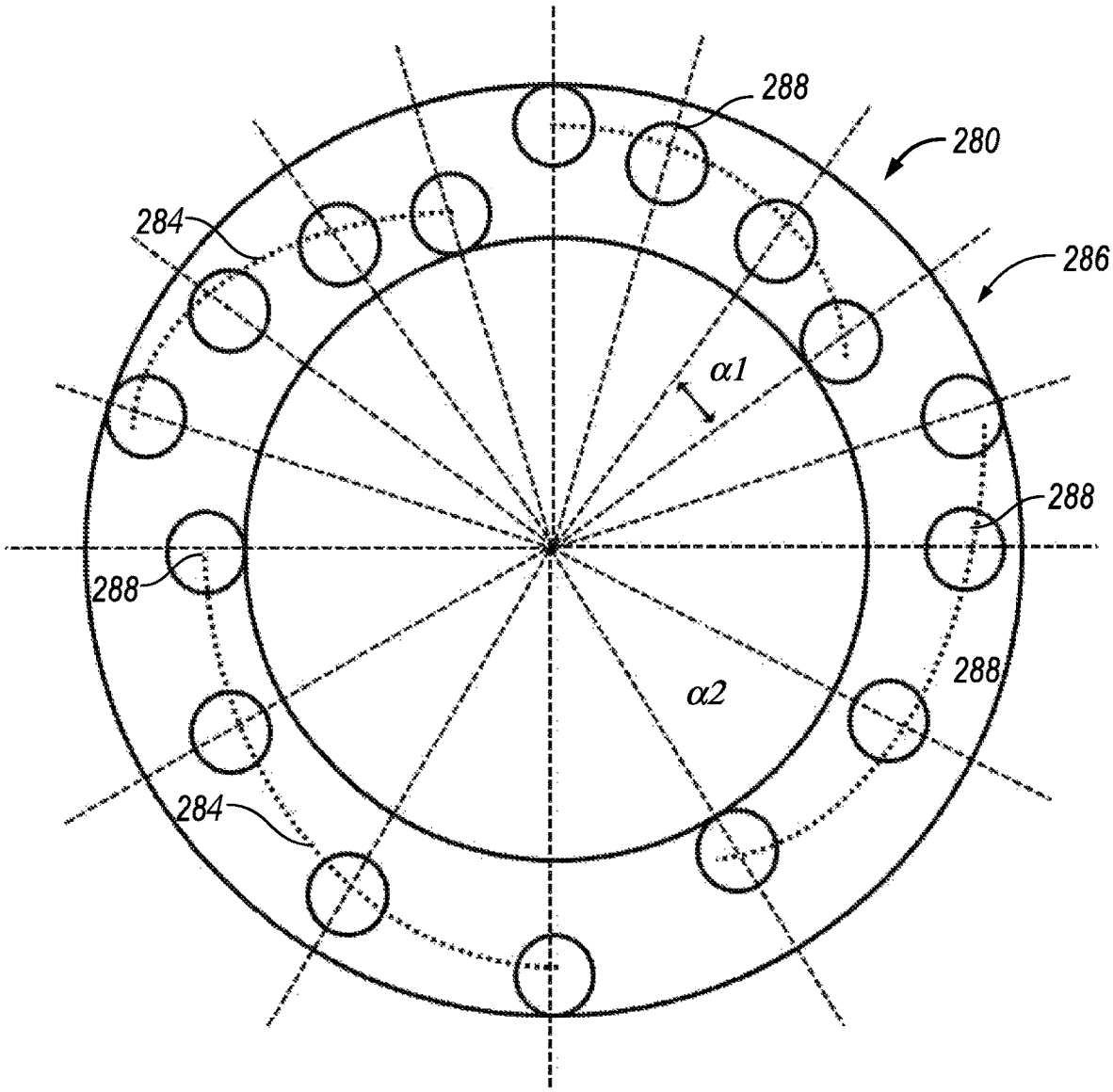
FIG. 31 shows one example of a pitch pattern for a row of a roller cone drill bit in accordance with an aspect of the present disclosure.

Once the total number of cutting elements and the number of spiral sets have been determined via the methods in FIGS. 28A and 28B—or selected via some other method—the pitch pattern of the cutting elements may be adjusted to further improve the performance score of a design. Adjusting the pitch pattern may occur prior to manufacture and use of the bit including the spiral sets on one or more cones thereof. Referring to FIG. 30, a score may be calculated over a range of cone to bit rotation ratios for a pitch pattern having an equal pitch between cutting elements 701. An example of such an equal pitch is shown in FIG. 23, according to an embodiment. A score is calculated for a pitch pattern having non-uniform spacing 703. An example of a pitch pattern including non-uniform, or unequal pitch spacing is shown in FIG. 31, according to an embodiment of the present disclosure. The scores for the different pitch patterns may be compared 705. An optimal, or preferred, pitch pattern may then be selected based on the comparison of the different scores for each potential pitch pattern for the array 707. It is to be understood that each of the methods illustrated in FIGS. 28A, 28B, and 30 may be used either independently or together for a particular bit design. Referring to FIG. 31, one example of a cutting element arrangement 280 proposed for an array 286 of a roller cone of a roller cone drill bit is shown. The arrangement includes sixteen cutting elements 288. In this case, cutting elements 288 are spaced apart and arranged in four spiral sets 284 about the conical surface of the roller cone. According to an embodiment of the present disclosure, cutting element arrangement 280 includes two different pitch angles, $\alpha 1$ and $\alpha 2$. In this case, $\alpha 1$ is less than $\alpha 2$. In an embodiment, the larger $\alpha 2$ angles are oriented on one half of the cutting element arrangement, while the smaller $\alpha 1$ angles are oriented on the opposing half of the arrangement. Introducing such incongruence into a pitch pattern may help improve a performance score by reducing tracking over a target range of cone to bit rotation ratio. Additional details of optimizing pitch in a cutting element arrangement based on a performance score are further described in U.S. Pat. No. 7,234,549, incorporated by reference.

Certain bit designs may incorporate more than one array on a single cone, and across all of the multiple cones. In such cases, each row may be analyzed separately in order to select the preferred number of spiral sets. In another embodiment, the entire cone or bit may be analyzed as a whole in order to determine the appropriate number of spiral sets for each array in the design.

The calculations in this example may be performed by a computer program, such as a C-program or a program developed using Microsoft® Excel®. Alternatively, these steps may be carried out manually and/or experimentally as determined by a system or bit designer.

Advantageously, embodiments in accordance with this aspect of the present disclosure provide a roller cone drill bit having a cutting arrangement that breaks up the pattern laid down by a previous revolution of the bit. By selecting an appropriate number of spiral sets, the probability of tracking for a given array may be reduced, and the bottomhole coverage of the array and of the bit may be increased. The desired degree of tracking and bottomhole coverage may be selected to optimize ROP for a given bit design, drilling conditions, rock formations, etc.

In some embodiments, a method for evaluating a design for a drill bit includes selecting an arrangement of cutting elements on the drill bit including a first array of a plurality of cutting elements, calculating a first score for a first number of spiral sets within the first array, calculating a second score for a second number of spiral sets within the first array, comparing the first score to the second score, and selecting a number of spiral sets for the design based on the comparison.

The above method may include spiral sets each having a plurality of cutting elements and/or the first array may be located on a first rolling cone. Any of such methods may include selecting a second arrangement of cutting elements including a second array of cutting elements, calculating a third score for a third number of spiral sets within the second array, calculating a fourth score for a fourth number of spiral sets within the second array, comparing the third score to the fourth score, and selecting a second number of spiral sets for the design based on the comparison. This method may include a second array located on a second rolling cone or on the first rolling cone. Any of these methods may also include a score selected from the group consisting of representative of rate of penetration, weight on bit, axial force response, and lateral vibration response. In any such methods, each of the first score and the second score is calculated over a range of cone to bit rotation ratios, and the comparison of the first score and second score includes comparing values over the range of cone to bit rotation ratios.

Another method for creating a drill bit design including an array of cutting elements having an optimized number of spiral sets includes: (a) selecting an arrangement of cutting elements for the drill bit, the arrangement comprising the array having a first number of spiral sets; (b) calculating a score for the arrangement; (c) adjusting the number of spiral sets; (d) repeating (b) and (c) until the score satisfies a performance criterion; and (e) designing the drill bit using the number of spiral sets having the score satisfying the performance criterion. In this method, the performance criterion may be selected from the group consisting of representative of rate of penetration, weight on bit, axial force response, and lateral vibration response. The array may be located on a rolling cone and/or the score may be calculated over a range of cone to bit rotation ratios.

Optionally, the performance criterion includes a minimum score over the range of cone to bit rotation ratios.

A bit may be designed and/or manufactured using the foregoing methods. In one example, a drill bit includes a roller cone including an array of cutting elements, with the cutting elements arranged into a plurality of spiral sets. The number of spiral sets is optionally selected based on a desired performance score, and the performance score may be selected from the group consisting of representative of rate of penetration, weight on bit, axial force response, and lateral vibration response. The bit may include a second array having a second number of spiral sets, and/or the second array may be located on a second roller cone.

The terms "couple" or "couples," as well as similar words such as "attach" or "attaches," "connect" or "connects," "mount" or "mounts," "secure" or "secures," and the like, are intended to mean either an indirect or direct connection. Thus, if a first device couples to a second device, that connection may be through a direct connection, or through an indirect connection via other devices and connections. Such terms also include integral components. Thus, if a first component is integrally formed with a second component as a single, monolithic body, the first component is coupled to the second component.

While some embodiments have been described or shown, whenever the shapes, relative positions, and other aspects of the parts described in the embodiments is not clearly defined as limited to a particular configuration, the scope of the embodiments is not limited to the parts shown and described, which are meant merely for the purpose of illustration. Also, while numerous details are set forth, it is understood that some embodiments may be practiced without these details. In other instances, well-known structures and techniques have not been shown in detail so as not to obscure the understanding of this description. Thus, the illustrated and described embodiments should not be interpreted, or otherwise used, as limiting the scope of the disclosure, including the claims. In addition, one skilled in the art will understand that the following description has broad application, and the discussion of any embodiment is meant to be illustrative of that embodiment, and not intended to suggest that the scope of the disclosure, including the claims, is limited to that embodiment. Rather, features and elements of any embodiments may be combined in any combination, unless such features are mutually exclusive.

What is claimed is:

1. A drill bit for drilling through earthen formations and forming a wellbore, the drill bit comprising:

a bit body having a bit axis;

at least a first cone and a second cone coupled to the bit body, each of the first and the second cone having a backface and a nose opposite the backface;

a first array of first cutting elements coupled to at least one of the first or second cones between the backface and the nose, a tip of each first cutting element being located in one of a plurality of radial positions defined by a radial distance from the bit axis and a bottom hole depth relative to the bit axis, and a number of first cutting elements located at a first radial position having a maximum bottom hole depth within the first array being greater than a number of first cutting elements located at a second radial position having a lesser bottom hole depth within the first array; and a second array of second cutting elements coupled to at least one of the first or the second cones between the backface and the nose, wherein a tip of each second cutting element is located in one of a plurality of radial positions, a number of second cutting elements located at a third radial position having a maximum bottom hole depth within the second array being greater than a number of second cutting elements located at a fourth radial position having a lesser bottom hole depth within the second array.

2. The drill bit of claim 1, further comprising a non-intermesh region adjacent to the backface and an intermesh region between the non-intermesh region and the nose, at least one of the first array or the second array being within the intermesh region.

3. The drill bit of claim 1, at least one of the first array or the second array being, when viewed in a rotated bottomhole profile, inboard with respect to radial positions on the cone having the maximum bottom hole depth and the cutting elements at the first and third radial positions being farther outboard with respect to the bit axis than the cutting elements at the second and fourth radial positions.

4. The drill bit of claim 1, the first array including at least five distinct radial positions, and at least three cutting elements of the first array being at a same radial position.

5. The drill bit of claim 1, a radial spacing between differing, adjacent radial positions within the first array or the second array being the same.

6. The drill bit of claim 1, a radially-outermost radial position and a next radially inward radial position within a radius of the first array having a first radial spacing, and a radially-innermost radial position and a next radially outward radial position within the radius of the first array have a second radial spacing, the first radial spacing being less than the second radial spacing.

7. The drill bit of claim 1, a number of first cutting elements in a fifth radial position located between the first radial position and the second radial position being less than the number of first cutting elements located at the first radial position and greater than the number of first cutting elements located at the second radial position.

8. The drill bit of claim 1, a number of first cutting elements in a fifth radial position located between the first radial position and the second radial position being equal to the number of first cutting elements located at the first radial position.

9. The drill bit of claim 1, the first array of first cutting elements being coupled to the first cone and the second array of second cutting elements being coupled to the second cone.

10. A drill bit for drilling through earthen formations and forming a wellbore, the drill bit comprising:

a bit body having a bit axis;

a plurality of cones coupled to the bit body, each cone having a backface, a nose opposite the back face, and a cone axis of rotation, and an array of cutting elements between the backface and the nose of at least one of the plurality of cones, the cutting elements being located at radial positions defined by a radial distance from the bit axis and a bottom hole depth relative to the bit axis, a first spacing between a first radial position within the array having a greatest bottom hole depth and a second radial position adjacent the first radial position being less than a second spacing between a third radial position within the array having a least bottom hole depth and a fourth radial position adjacent the third radial position.

11. The drill bit of claim 10, the first and second radial positions being within a higher impact load area in the array and the third and fourth radial positions being within a lower impact load area in the array.

12. The drill bit of claim 10, the first radial position being the farthest outboard radial position within the array and the third radial position being the farthest inboard radial position within the array.

13. The drill bit of claim 10, further comprising a third radial spacing between adjacent radial positions that are located between the second radial position and the fourth radial position, the third spacing being equal to the second spacing.

14. The drill bit of claim 10, a radial distance between remaining adjacent cutting elements gradually increasing between the first radial position and the third radial position.

15. The drill bit of claim 10, the first radial distance being within a range of from 0 to D/(2*(N−1)), where D is a distance from a farthest outboard radial position within the array to a farthest inboard radial position within the array, and N is a number of positions within the array.

16. The drill bit of claim 10, each of the cutting elements in the array including a cutting surface, and at least some of the cutting surfaces, when viewed in rotated bottomhole profile, being more level with a horizontal that is perpendicular to the bit axis than is a wellbore profile in the rotated bottomhole profile view of the array.

17. The drill bit of claim 10, the array of cutting elements being a first array of cutting elements in a first band of the at least one of the cones, the drill bit further comprising a second array of cutting elements in a second band of the at least one of the cones, the second band being axially spaced from the first band, each of the cutting elements of the second array having cutting surfaces with different extension heights such that the cutting surfaces of the cutting elements of the second array are more level with a horizontal than a spline formed through cutting surfaces of cutting elements mounted to each of the other cones of the plurality of cones in a rotated profile view.

18. A drill bit for drilling through earthen formations and forming a wellbore, the drill bit comprising:

a bit body having a bit axis;

a plurality of cones coupled to the bit body, each cone having a backface, a nose opposite the back face, a heel surface adjacent the backface, and a generally conical surface between the heel surface and the nose, and a cone axis of rotation; and an array of cutting elements coupled to the generally conical surface of at least one of the cones, the array of cutting elements including cutting elements in at least two different radial positions, each of the at least two different radial positions including a radial distance from the bit axis and a bottom hole depth relative to the bit axis, the cutting elements of the array including cutting surfaces having cutter axes that, when viewed in rotated bottomhole profile, have a non-uniform spacing, and the spacing between cutter axes of cutter surfaces closer to a horizontal line tangent to a spline of the cutting surfaces in the bottomhole profile being less than the spacing between cutter axes of cutting surfaces farther from the horizontal line.

19. The drill bit of claim 18, the cutter surfaces closer to the horizontal line corresponding to:

a cutting element at a farthest radially-outward position within the array and a next inward cutting element, and the cutter surfaces farther from the horizontal line corresponding to a cutting element at a farthest radially-inward position within the array and a next outward cutting element; or a farthest inboard position with respect to the bit axis and a next outboard cutting element, and the cutter surfaces farther from the horizontal line corresponding to a cutting element at a farthest outboard position with respect to the bit axis and a next inboard cutting element.

20. The drill bit of claim 18, wherein:

a spacing between adjacent cutter axes closer to a bottom of a wellbore within the bottomhole profile is less than a spacing between adjacent cutter axes farther away from the bottom of the wellbore within the bottomhole profile;

at least two of the cutting elements are at a same radial position and have aligned cutter axes; and;

at least one of the cutting surfaces deviates from the spline when viewed in rotated bottomhole profile.

* * * * *